US011759917B2

(12) United States Patent
Pedersen et al.

(10) Patent No.: US 11,759,917 B2
(45) Date of Patent: Sep. 19, 2023

(54) ADJUSTABLE SUPPORT SYSTEM FOR HANGING CABINET DOORS

(71) Applicant: Kreg Enterprises, Inc., Huxley, IA (US)

(72) Inventors: Jens Michael Pedersen, Des Moines, IA (US); Stacy Allan Peterson, Ames, IA (US); Kyong S. Choi, Nevada, IA (US)

(73) Assignee: Kreg Enterprises, Inc., Ankeny, IA (US)

( * ) Notice: Subject to any disclaimer, the term of this patent is extended or adjusted under 35 U.S.C. 154(b) by 152 days.

(21) Appl. No.: 17/496,911

(22) Filed: Oct. 8, 2021

(65) Prior Publication Data

US 2022/0111493 A1 Apr. 14, 2022

Related U.S. Application Data

(60) Provisional application No. 63/091,696, filed on Oct. 14, 2020.

(51) Int. Cl.
*B25B 11/02* (2006.01)
*B25B 11/00* (2006.01)

(52) U.S. Cl.
CPC ..... *B25B 11/02* (2013.01); *B25B 11/002* (2013.01)

(58) Field of Classification Search
CPC ..... B25B 11/02; B25B 11/002
USPC ..... 248/317, 323, 309.4, 206.5; 269/95; 312/351.1, 351.9
See application file for complete search history.

(56) References Cited

U.S. PATENT DOCUMENTS

| | | | | |
|---|---|---|---|---|
| 5,294,099 | A * | 3/1994 | Dalfino | B25B 11/00 269/133 |
| 6,231,034 | B1 | 5/2001 | Walker et al. | |
| 6,248,172 | B1 | 6/2001 | Shirotani | |
| 6,581,921 | B2 * | 6/2003 | Griggs | B25B 11/00 254/93 H |
| 7,281,338 | B2 | 10/2007 | Ziegmann | |
| 7,798,095 | B2 | 9/2010 | Navarro | |
| 7,930,811 | B2 | 4/2011 | Yoshida et al. | |
| 8,898,877 | B2 | 12/2014 | Lee et al. | |

(Continued)

OTHER PUBLICATIONS

Walcraft Custom Refacing Hand Tools; Brochure Jan. 1, 2019.
Fast Cap; Mag Shims magnet screenshots; https://www.fastcap.com/product/mag-shims, Jan. 1, 2019.

*Primary Examiner* — Todd M Epps
(74) *Attorney, Agent, or Firm* — BrownWinick Law Firm; Christopher A. Proskey

(57) ABSTRACT

A support system for hanging of a cabinet door is provided having support arm and a main body with a top member and a front member. The upper end of the front member is operably connected to the forward end of the top member. The front member has lock features located at a plurality of positions between the upper end and the lower end on a front surface. The support arm has an elongated shape extending between a connection end and a support end. The support arm has lock features configured to engage and lock with lock features of the front member. The support end of the support arm having a platform configured to support the cabinet door during installation onto a cabinet. The support arm is movable between the plurality of positions to facilitate adjustment of a height at which the cabinet door is supported.

49 Claims, 86 Drawing Sheets

(56) References Cited

U.S. PATENT DOCUMENTS

| | | | | |
|---|---|---|---|---|
| 9,115,526 | B2 * | 8/2015 | Houser | E04F 21/0007 |
| 9,188,277 | B2 * | 11/2015 | VanOrden | F16M 13/02 |
| 10,501,968 | B2 | 12/2019 | Maher | |
| 10,646,979 | B1 * | 5/2020 | Schiveley | B25B 11/02 |
| 2015/0121794 | A1 * | 5/2015 | Koetje | B25B 11/00 52/745.19 |
| 2016/0068207 | A1 | 3/2016 | Moyart | |

* cited by examiner

ADJUSTABLE SUPPORT SYSTEM FOR HANGING CABINET DOORS

CROSS REFERENCE TO RELATED APPLICATIONS

This application claims benefit from U.S. Provisional Application No. 63/091,696, which was filed Oct. 14, 2020, the entirety of which is incorporated herein fully by reference.

FIELD OF THE DISCLOSURE

This disclosure relates generally to support systems for fabrication, installation and repair of components or articles. More specifically, and without limitation, this disclosure is directed to an adjustable support system configured to facilitate hanging of doors on a cabinet.

OVERVIEW OF THE DISCLOSURE

There are many forms of supports systems or jigs, which are used to hold objects in a stationary convenient position to facilitate performance of various tasks (e.g., fabrication, installation, and/or repair). Some supports systems, like sawhorses, are general purpose support systems applicable to a number of various tasks. These support systems typically have strength and durability sufficient to support workpieces of various weights. Other supports systems, are special purpose support systems, specifically tailored for a particular task and/or workpiece.

Presently there is no existing and available support system that adequately and conveniently holds cabinet doors during the installation process. Existing general purpose and special purpose supports are not well suited for use for installing cabinet doors. For example, many supports have wider base for stability that prevents use of the support to hold a door at a position adjacent to the cabinet face for installation. As another example, many supports are not adjustable or are only adjustable in increments that are too large to facilitate accurate installation of doors at the proper location. Furthermore, when using a typical support that is adjustable, a carpenter might need to repeatedly adjust the support during cabinet installation to support cabinet doors at a correct height above a floor. Such repeated adjustment increases the time required for cabinet installation.

Therefore, for all the reasons stated above, and the reasons stated below, there is a need in the art for an adjustable support system for installation of cabinet doors. It is a primary object of the disclosure to provide a support system configured to support a cabinet door at a selectable height relative to the cabinet face.

Another object of the disclosure is to provide a support system that is easily and quickly adjusted to support a cabinet door at multiple heights.

Yet another object of the disclosure is to provide a support system that can adjust the height at which a door is supported with fine granularity.

Another object of the disclosure is to provide a support system that can be used to install cabinet doors on either the right or left side.

Yet another object of the disclosure is to provide a support system that is strong.

Another object of the disclosure is to provide a support system that is robust.

Yet another object of the disclosure is to provide a support system that is durable.

Another object of the disclosure is to provide a support system that provides unique functionality.

Yet another object of the disclosure is to provide a support system that is fast to use.

Another object of the disclosure is to provide a support system that is safe to use.

Yet another object of the disclosure is to provide a support system that saves time.

Another object of the disclosure is to provide a support system that is compact in size.

Yet another object of the disclosure is to provide a support system that is easily stored.

Another object of the disclosure is to provide a support system that is portable.

Yet another object of the disclosure is to provide a support system that is easy and intuitive to use.

Another object of the disclosure is to provide a support system that has a long useful life.

Yet another object of the disclosure is to provide a support system that is high quality.

Another object of the disclosure is to provide a support system that prevents doors or other supported objects from slipping.

Yet another object of the disclosure is to provide a support system that has a high coefficient of friction.

These and other objects, features, or advantages of the disclosure will become apparent from the specification, figures and claims.

SUMMARY OF THE DISCLOSURE

Figure 1:
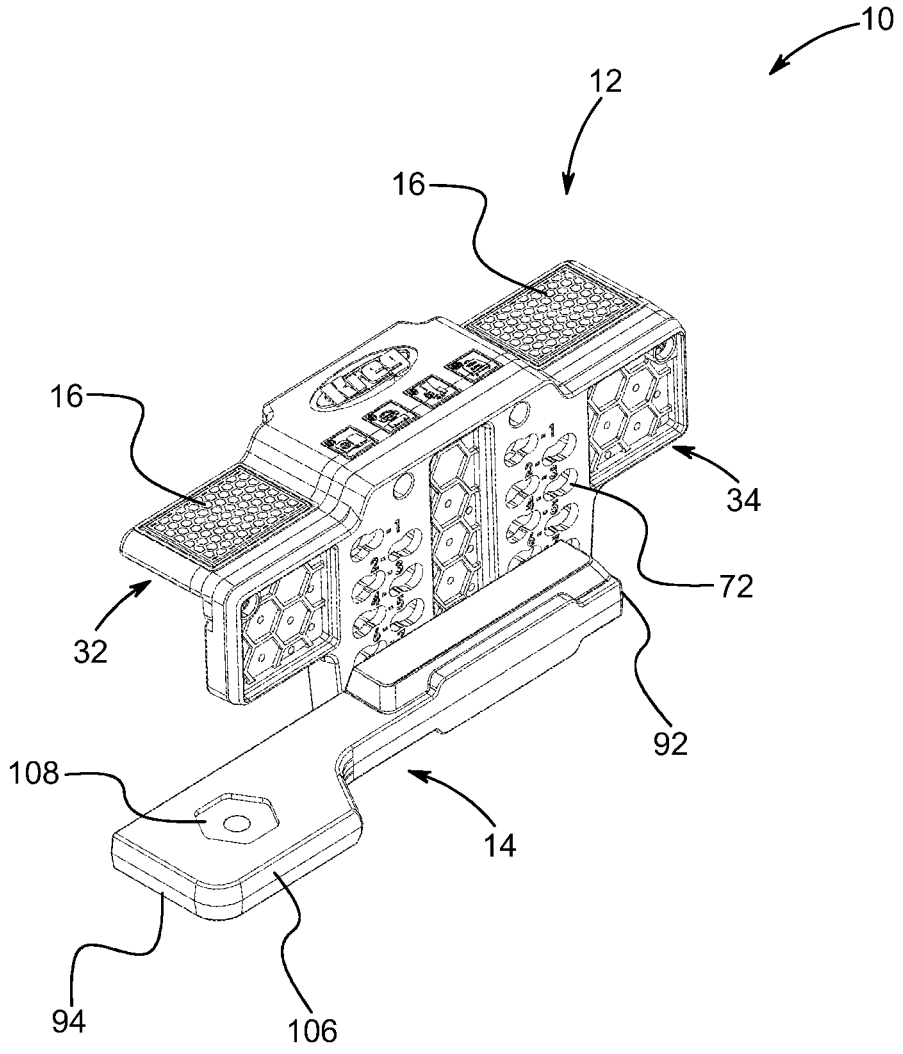
FIG. 1 is a perspective view of an adjustable support system for hanging cabinet doors, the view showing a main body and a support arm; the main body includes a top member and a front member with grip pads on the top member and lock features on the front member; the support arm shows a support end and a connection end; the support end has both a support platform and connection features on the support platform.
Figure 2:
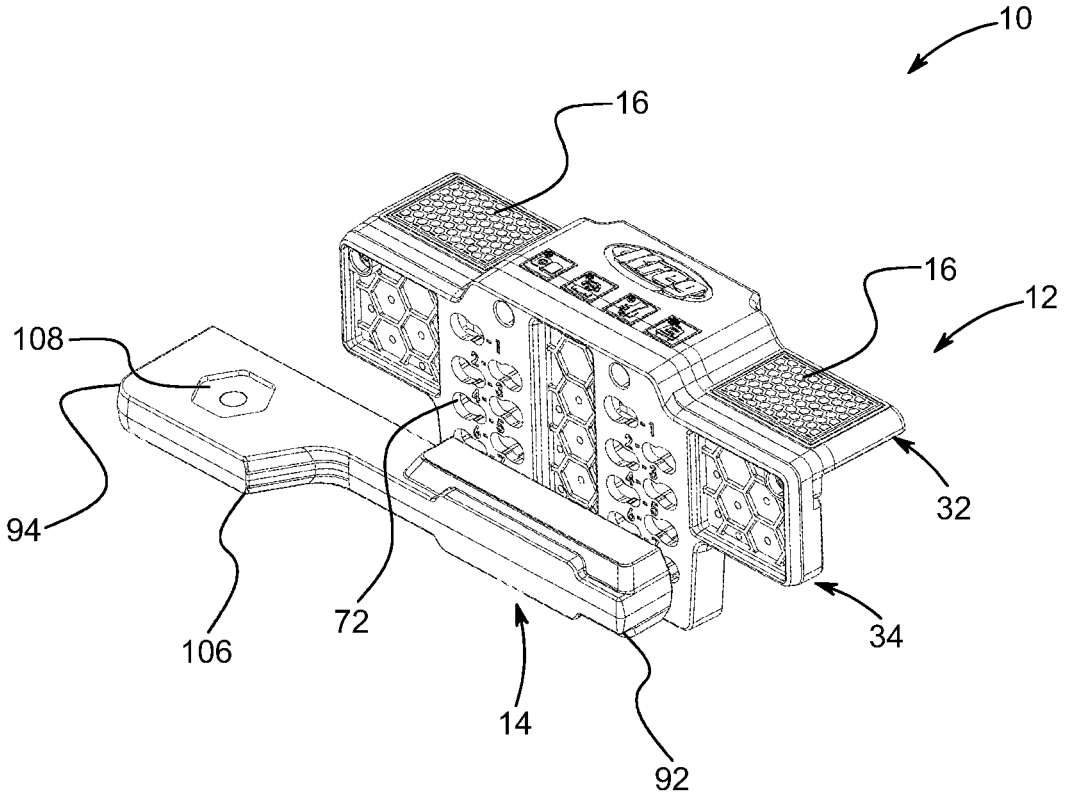
FIG. 2 is an alternate perspective view of the adjustable support system for hanging cabinet doors shown in FIG. 1, the view showing an alternate view of the support arm connecting to the main body.
Figure 3:
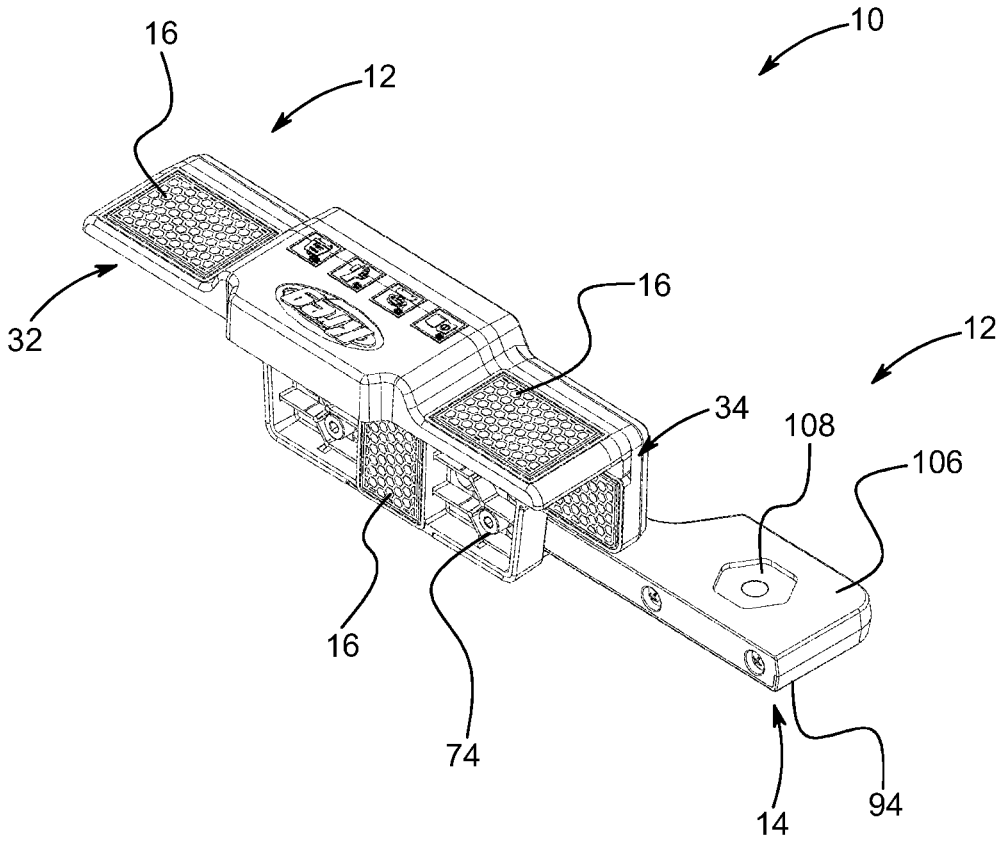
FIG. 3 is a rear perspective view of the adjustable support system for hanging cabinet doors shown in FIG. 1, the view showing the back side of the front member with additional grip pads and the back side of the lock features.
Figure 4:
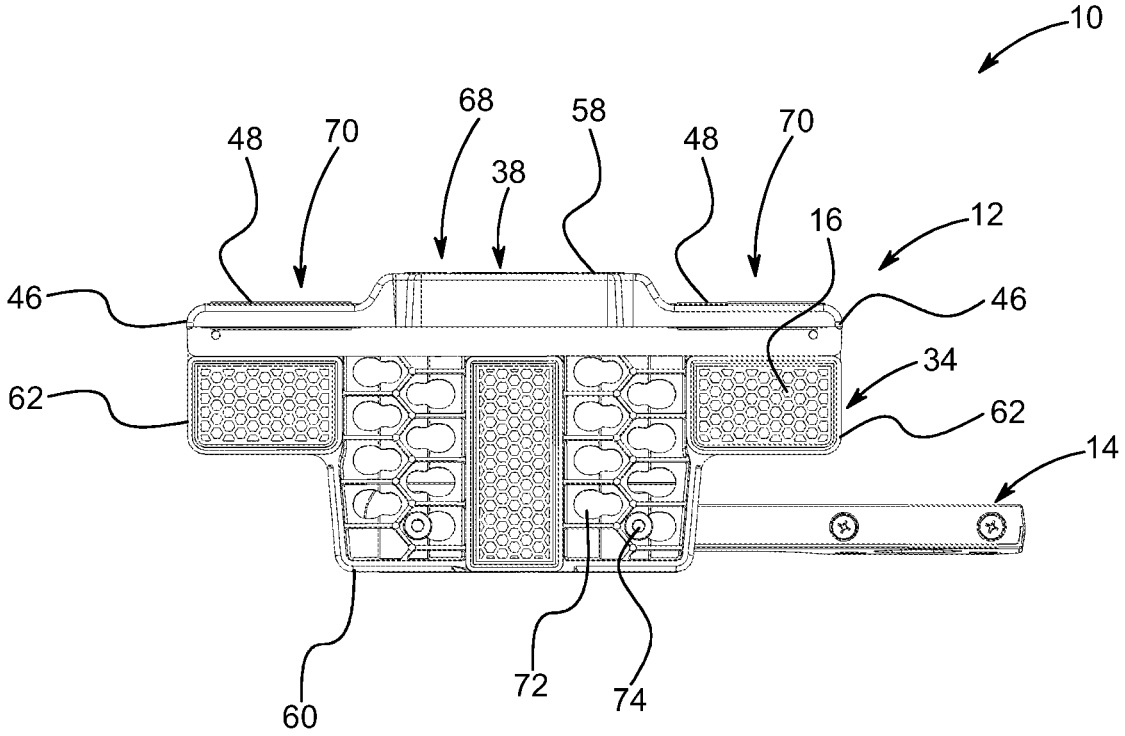
FIG. 4 is an additional rear perspective view of the adjustable support system for hanging cabinet doors shown in FIG. 1, the view showing the entirety of the back side of the front member with additional grip pads and the support arm operably connected through the lock features. The view also showing platform areas of the top member.
Figure 5:
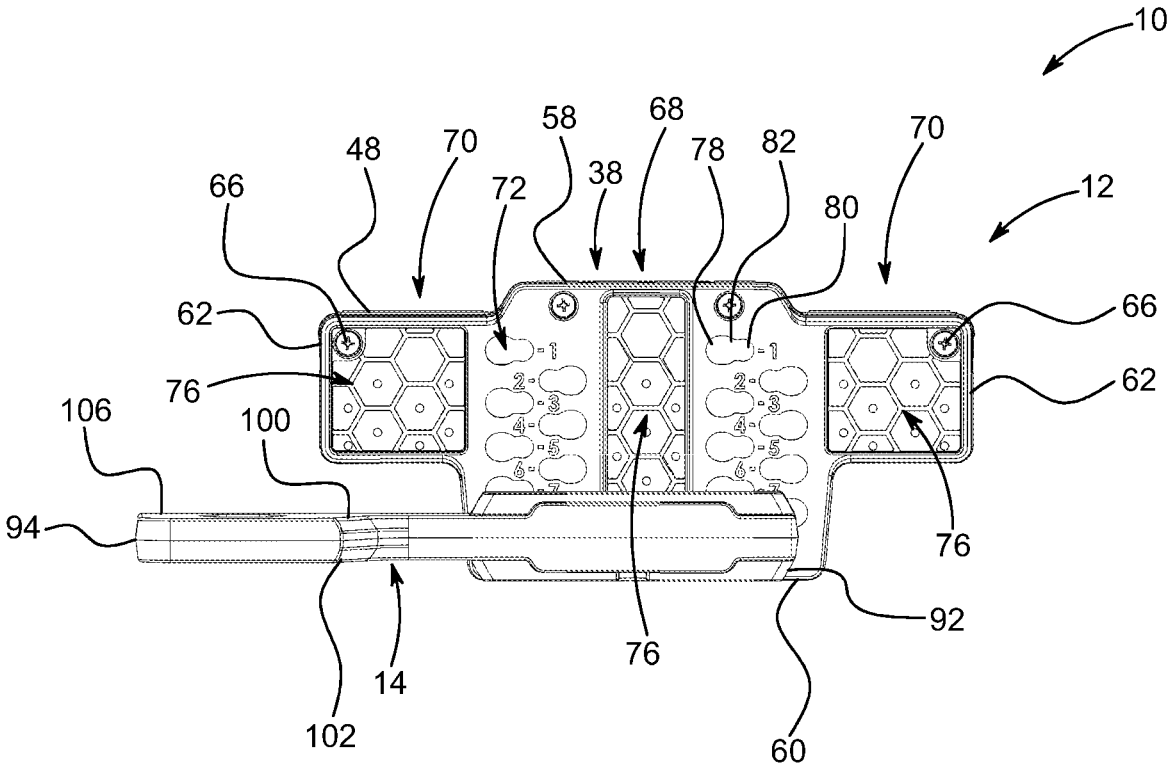
FIG. 5 is a front perspective view of the adjustable support system for hanging cabinet doors shown in FIG. 1, the view showing the entirety of the front side of the front member with fasteners of the main body connecting the top member to the front member; the top member having platform areas and the front member having opposing sides; the support arm operably connected to the main body and the front member having lock features; the lock features of front member comprising a slot.
Figure 6:
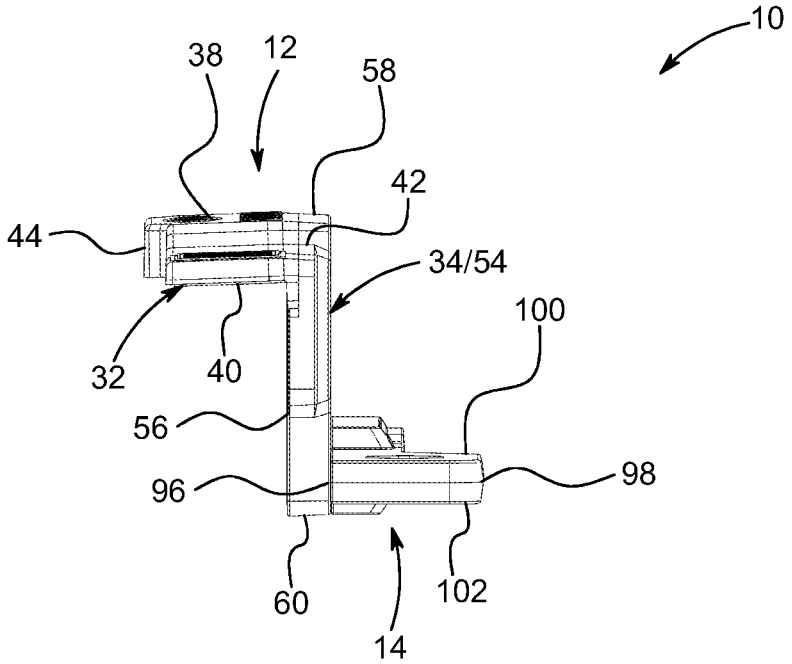
FIG. 6. is a side perspective view of the support system shown in FIG. 1.
Figure 7:
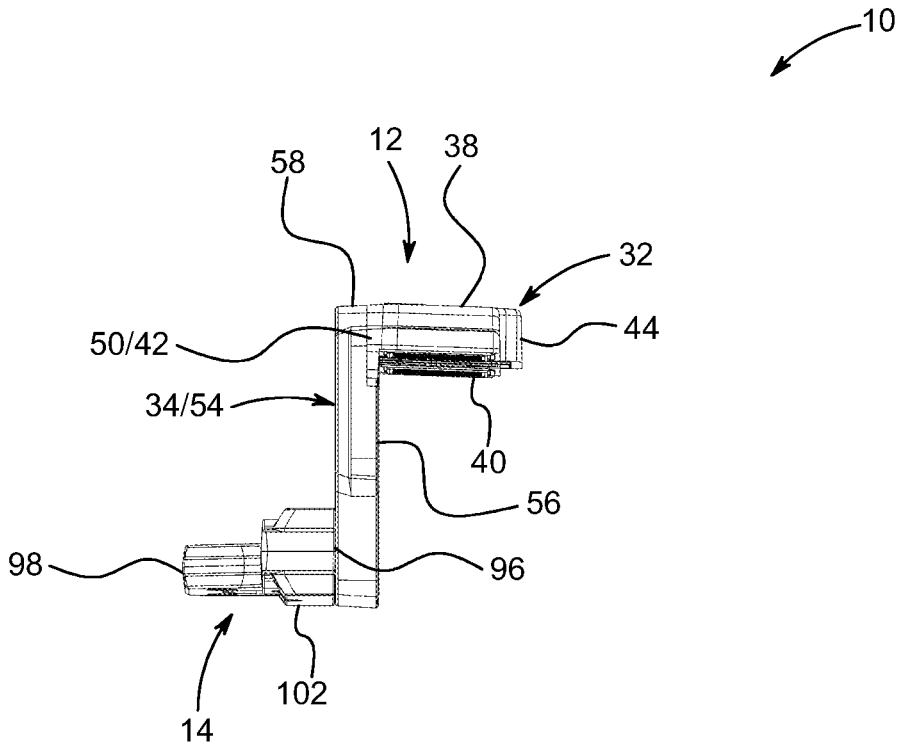
FIG. 7 is a side perspective view of the support system shown in FIG. 1; the view showing the perspective from the opposing side.
Figure 8:
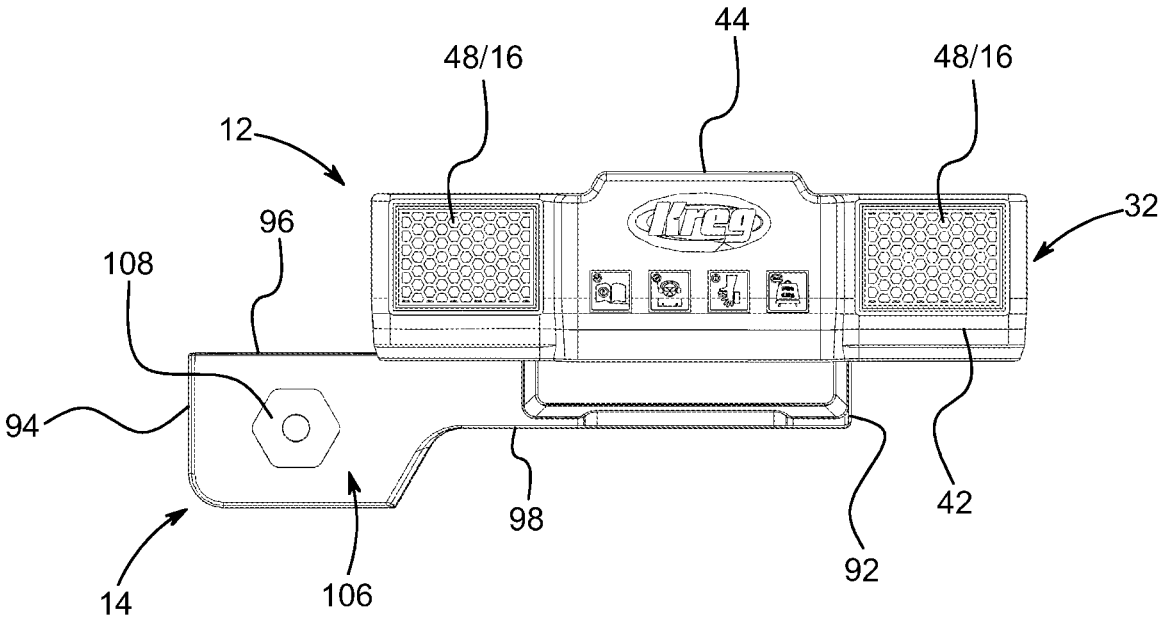
FIG. 8. is a top elevation view of the support system shown in FIG. 1.
Figure 9:
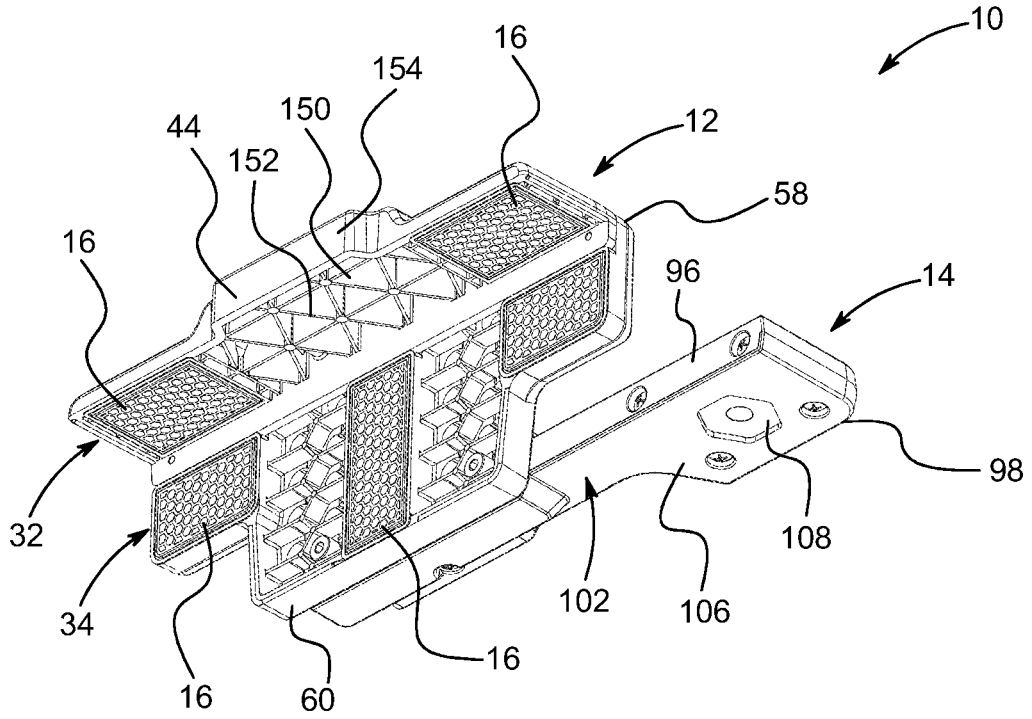
FIG. 9 is a bottom perspective view of the support system shown in FIG. 1., the view showing the cells which make up the support structures of the top member.
Figure 10:
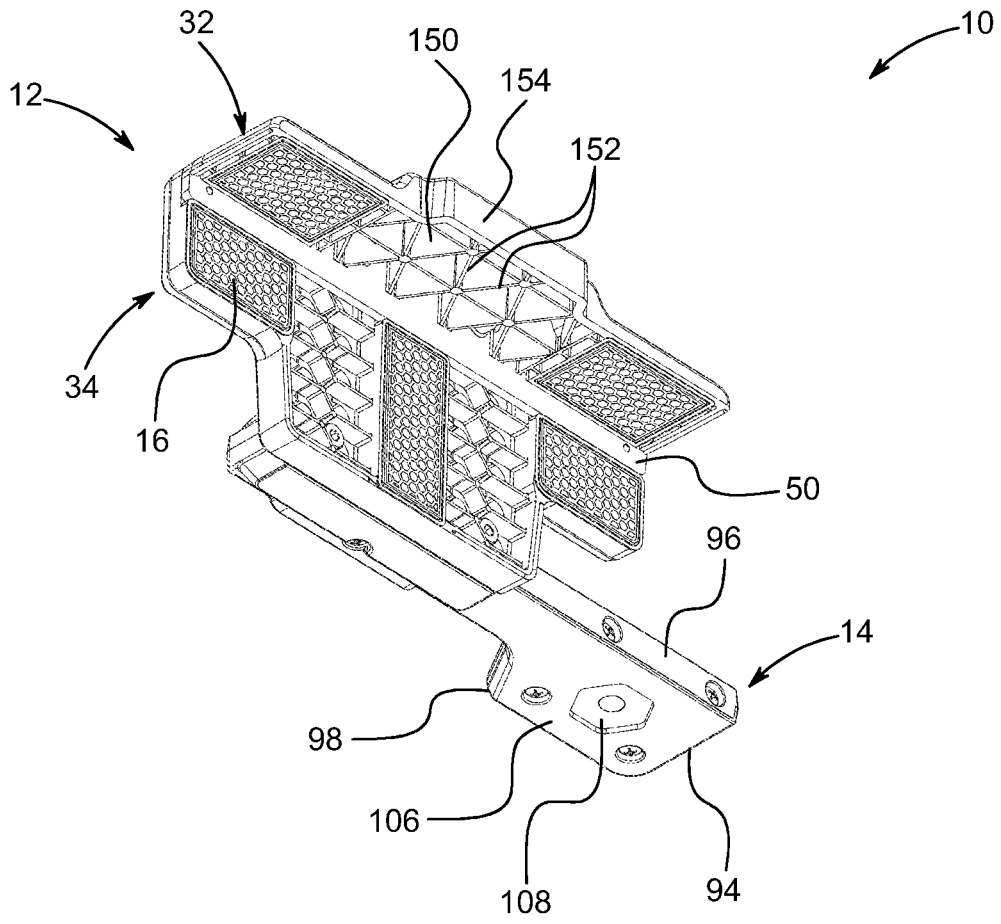
FIG. 10 is an alternate, bottom perspective view of the support system shown in FIG. 1.
Figure 11:
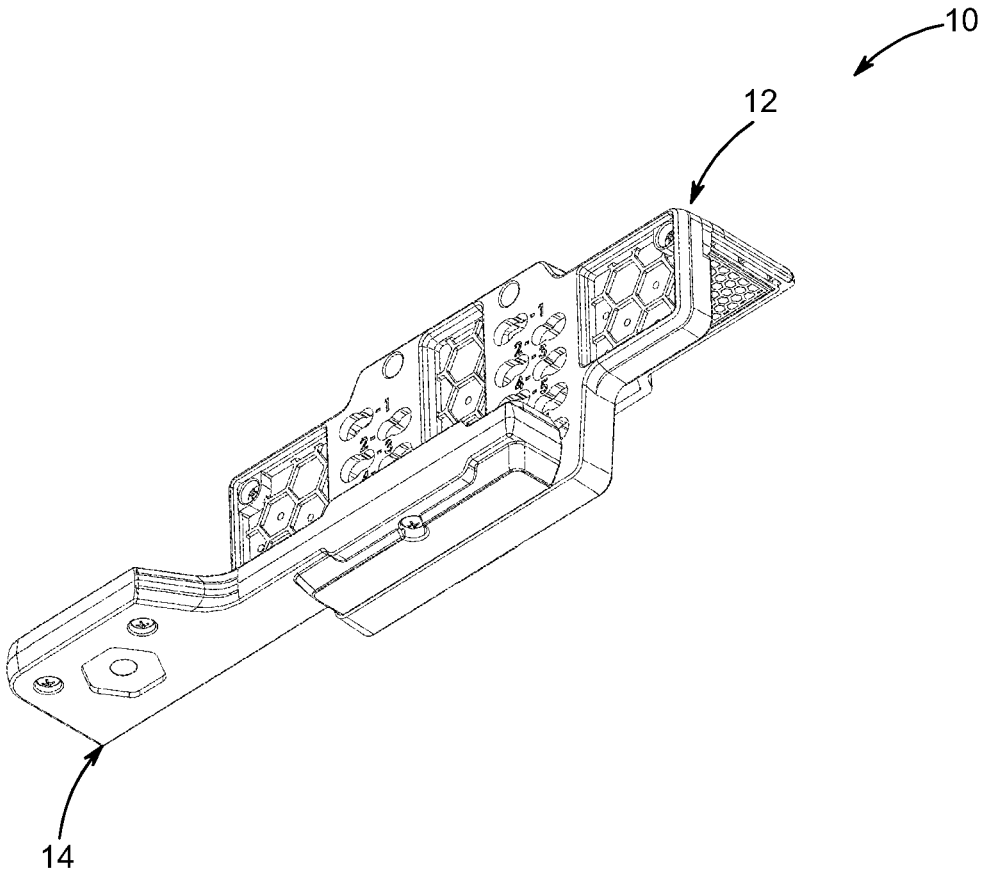
FIG. 11 is an alternate, bottom perspective view of the support system shown in FIG. 1, the view showing the bottom of the support arm operably connected to the main body.
Figure 12:
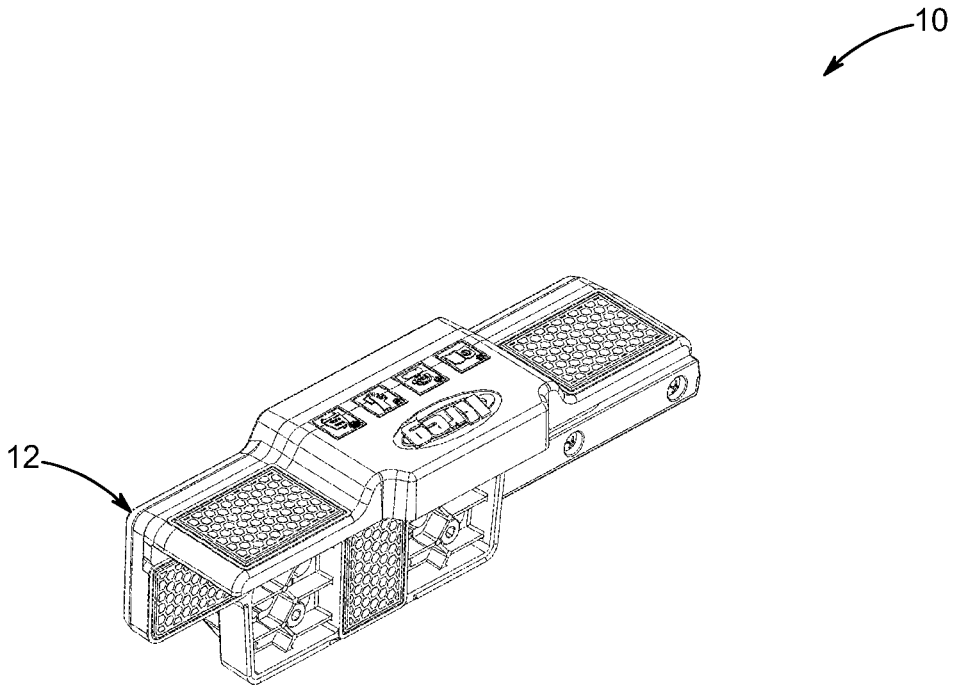
FIG. 12 is a top perspective view of the support system shown in FIG. 1, the view showing the main body with top member and front member.
Figure 13:
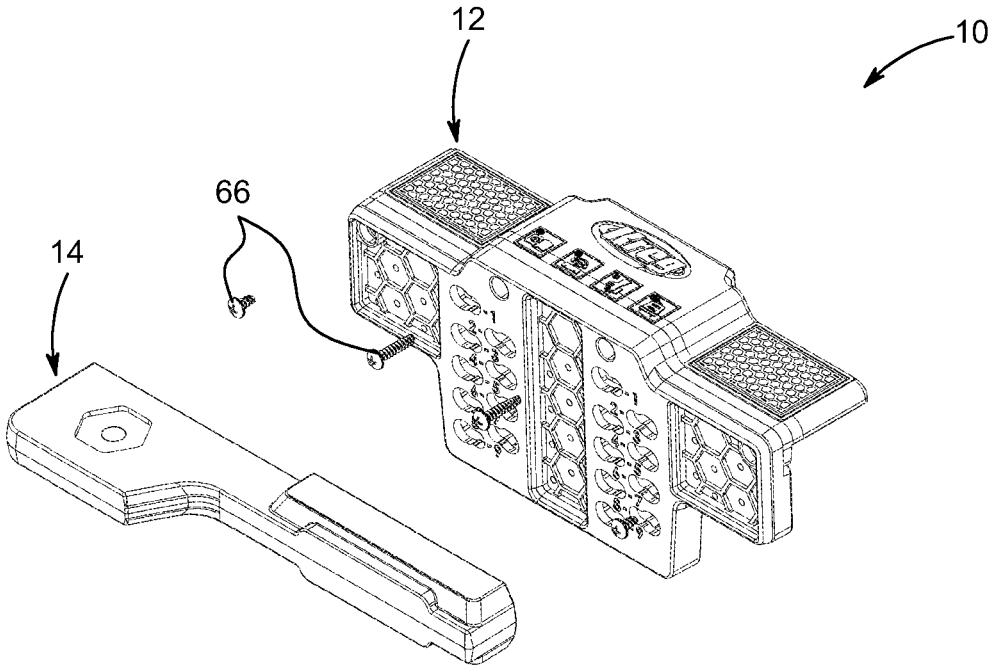
FIG. 13 is an exploded view of the support system shown in FIG. 1, the view showing the main body, support arm, and fasteners connecting the front member of the main body to the top member of the main body.
Figure 14:
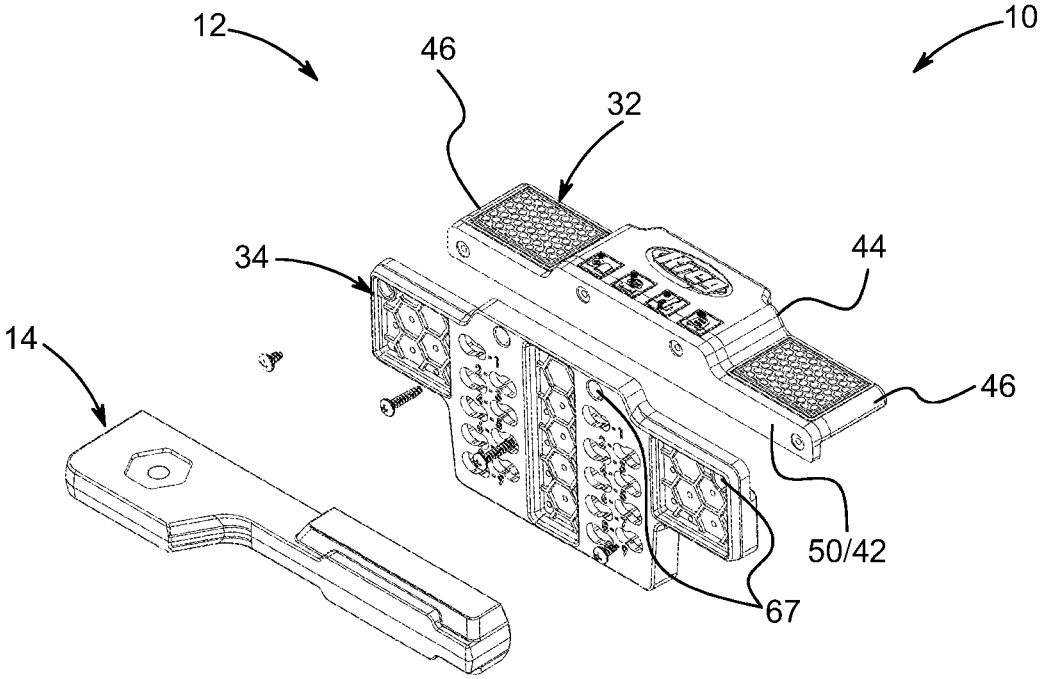
FIG. 14 is an alternate exploded view of the support system shown in FIG. 1., the view showing the top member of the main body, the front member of the main body, and the support arm; the front member of the main body having holes for fasteners to secure the front member to the top member.
Figure 15:
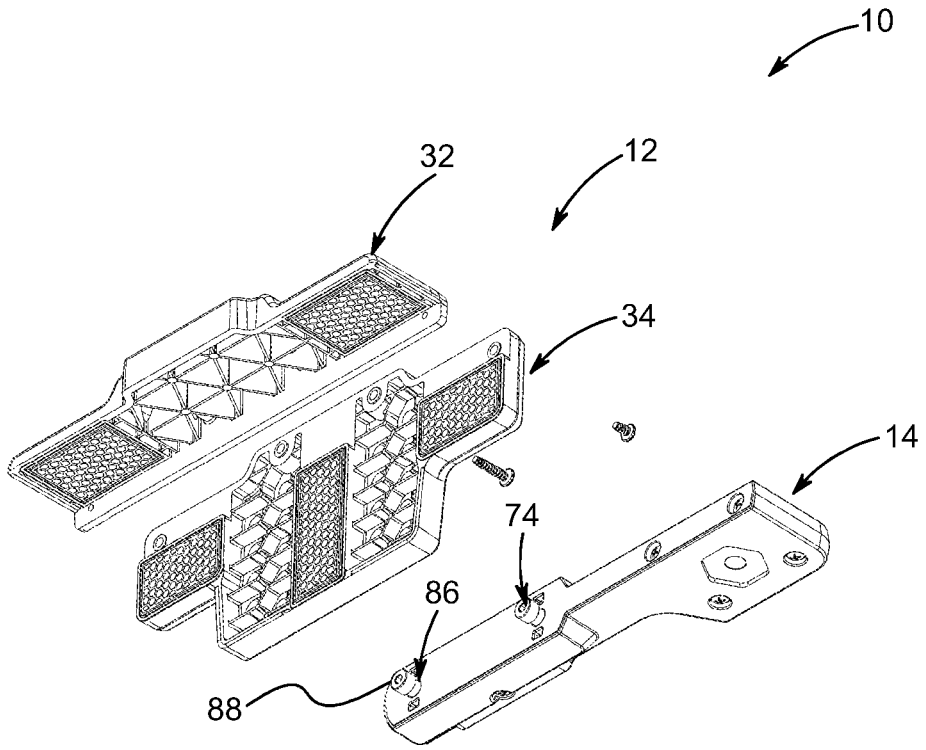
FIG. 15 is an exploded bottom view of the support system shown in FIG. 1, the view showing the lock features of the support arm having a head and a shaft with are configured to connect to the slots of the lock features of the front member.
Figure 16:
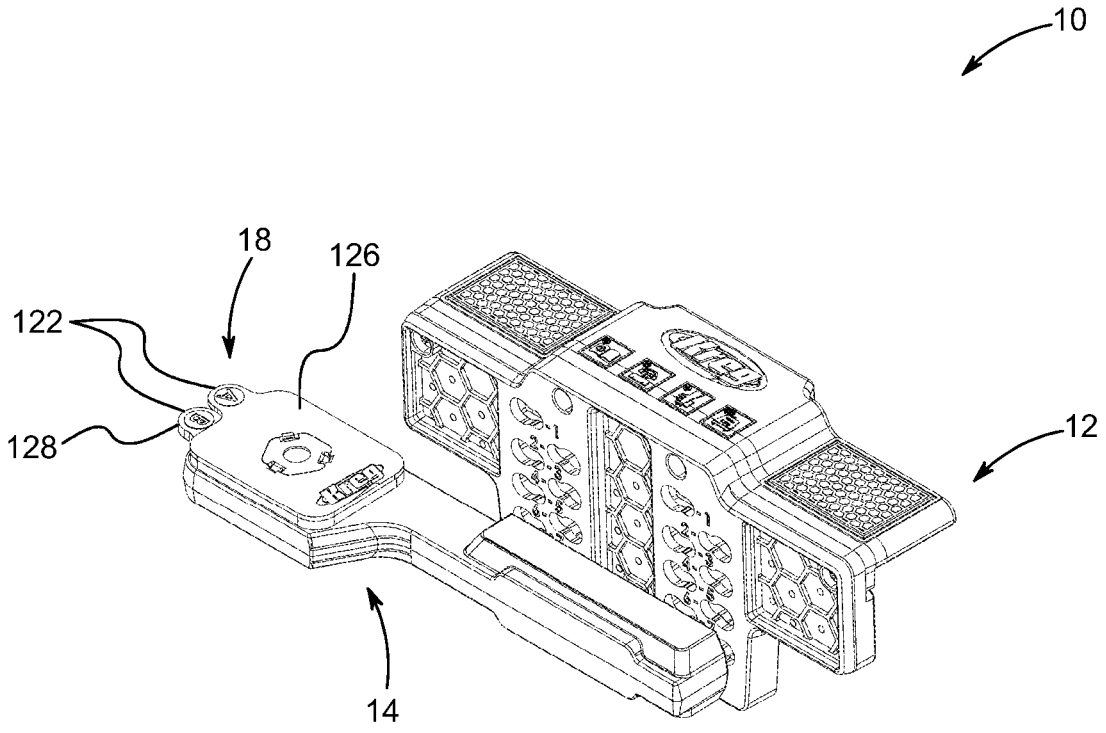
FIG. 16 is a perspective view of the support system shown in FIG. 1, the view showing the use of shims to customize the thickness of the platform area of the support arm; the view also showing a thinner shim and a thicker shim both having a tab and being used in combination.
Figure 17:
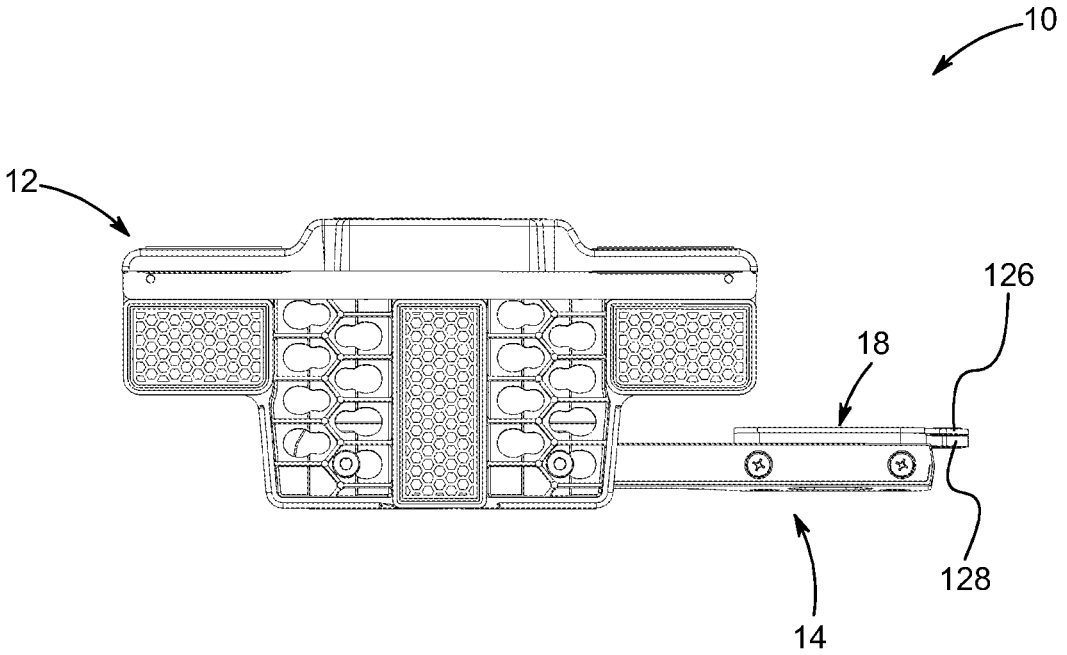
FIG. 17 a back perspective view of the support system used with both thin and thick shims shown in FIG. 16.
Figure 18:
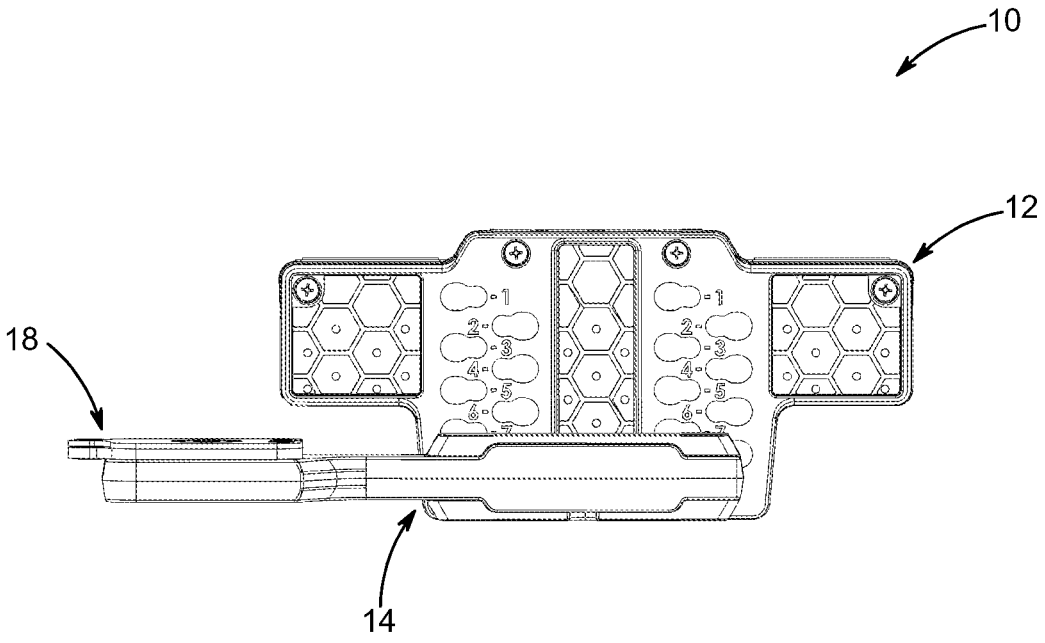
FIG. 18 is a front perspective view of the support system used with both thin and thick shims shown in FIG. 16.
Figure 19:
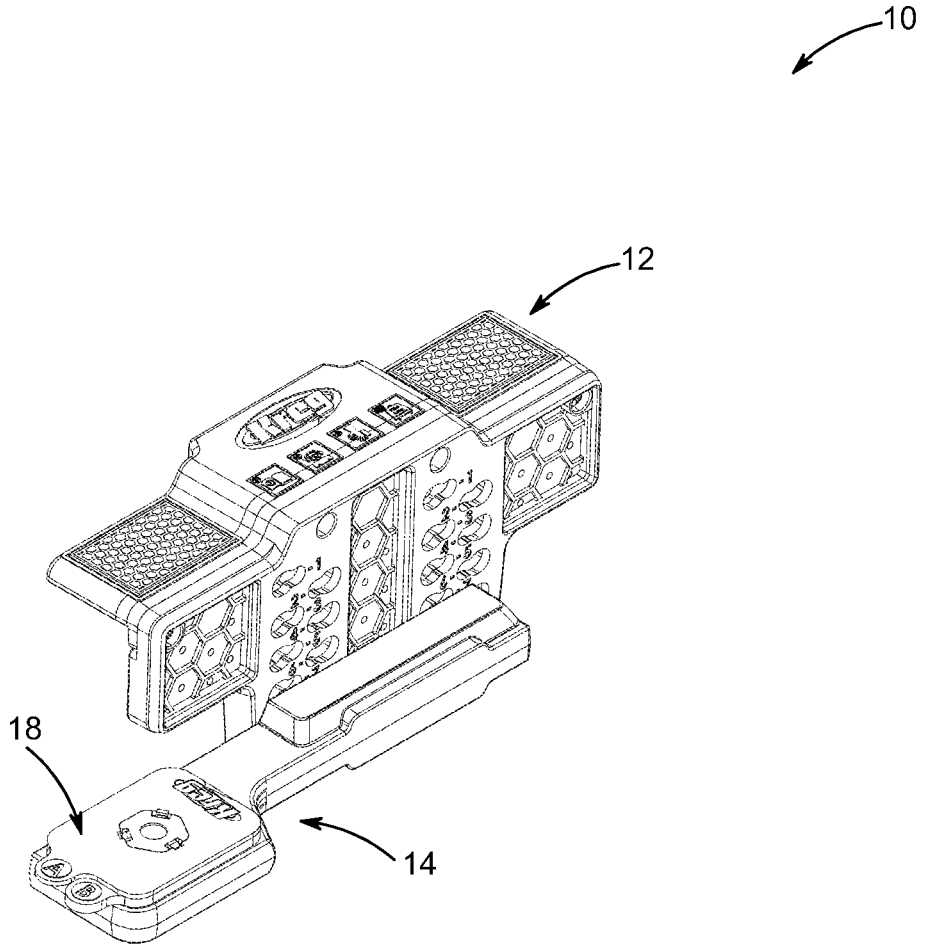
FIG. 19 is a side perspective view of the support system used with both thin and thick shims shown in FIG. 16.
Figure 20:
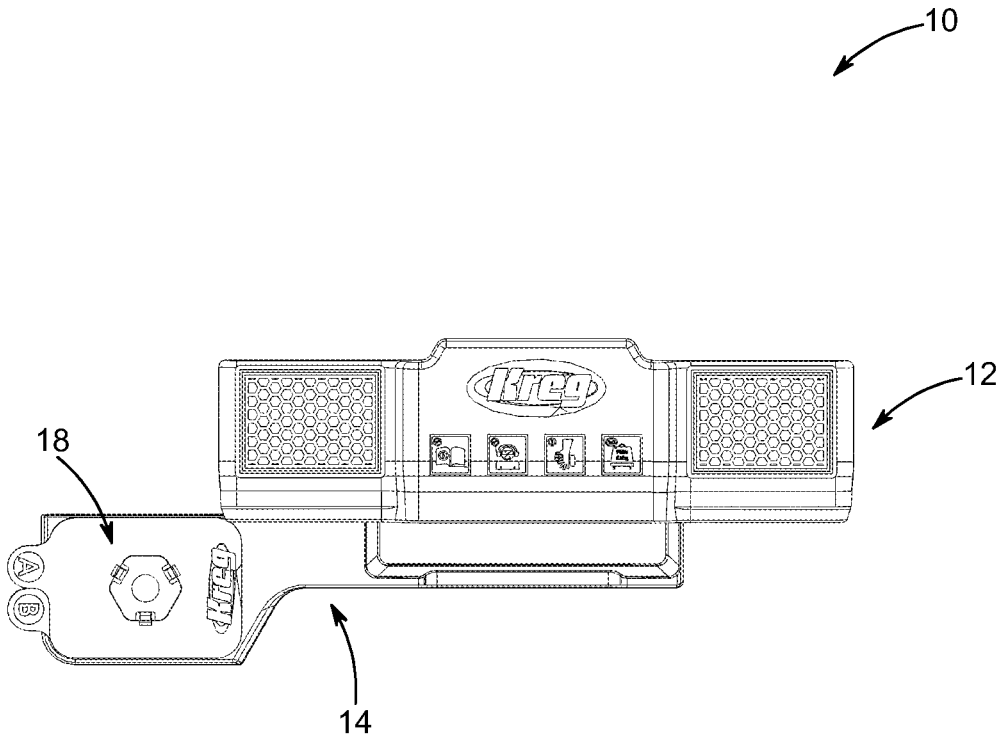
FIG. 20 is a top elevation view of the support system used with both thin and thick shims in shown FIG. 16.
Figure 21:
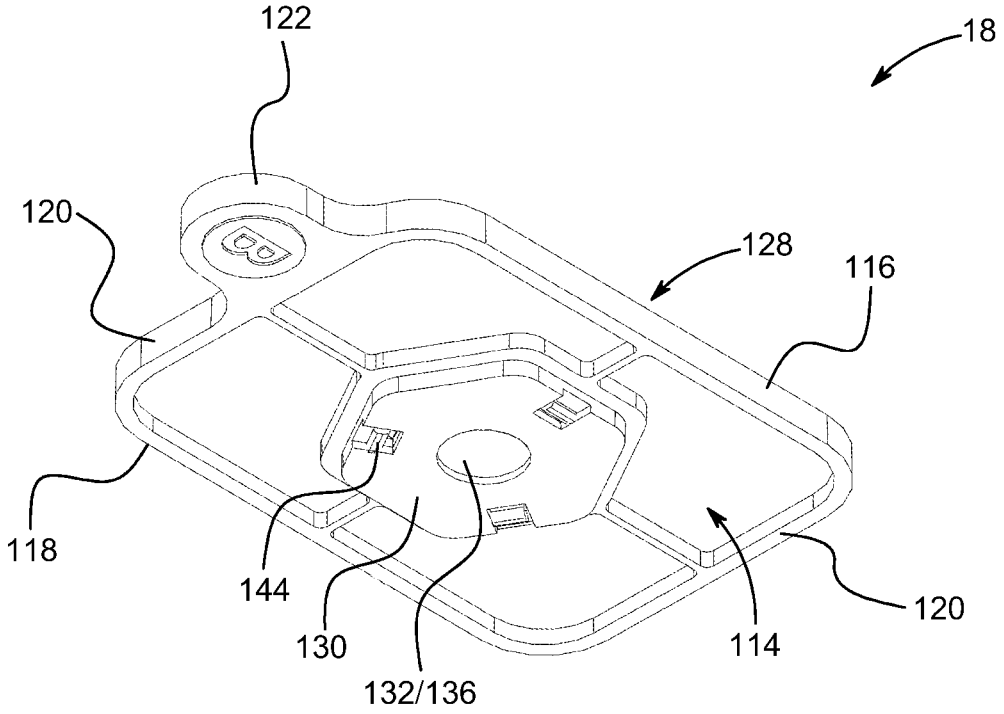
FIG. 21 is a bottom perspective view of a thick shim, the view showing the front and the rear of the shim with two opposing sides; one of the opposing sides has a tab to indicate the thickness of the shim; the bottom has snap features, connection features, and lock features assisted by magnetically attracted materials.
Figure 22:
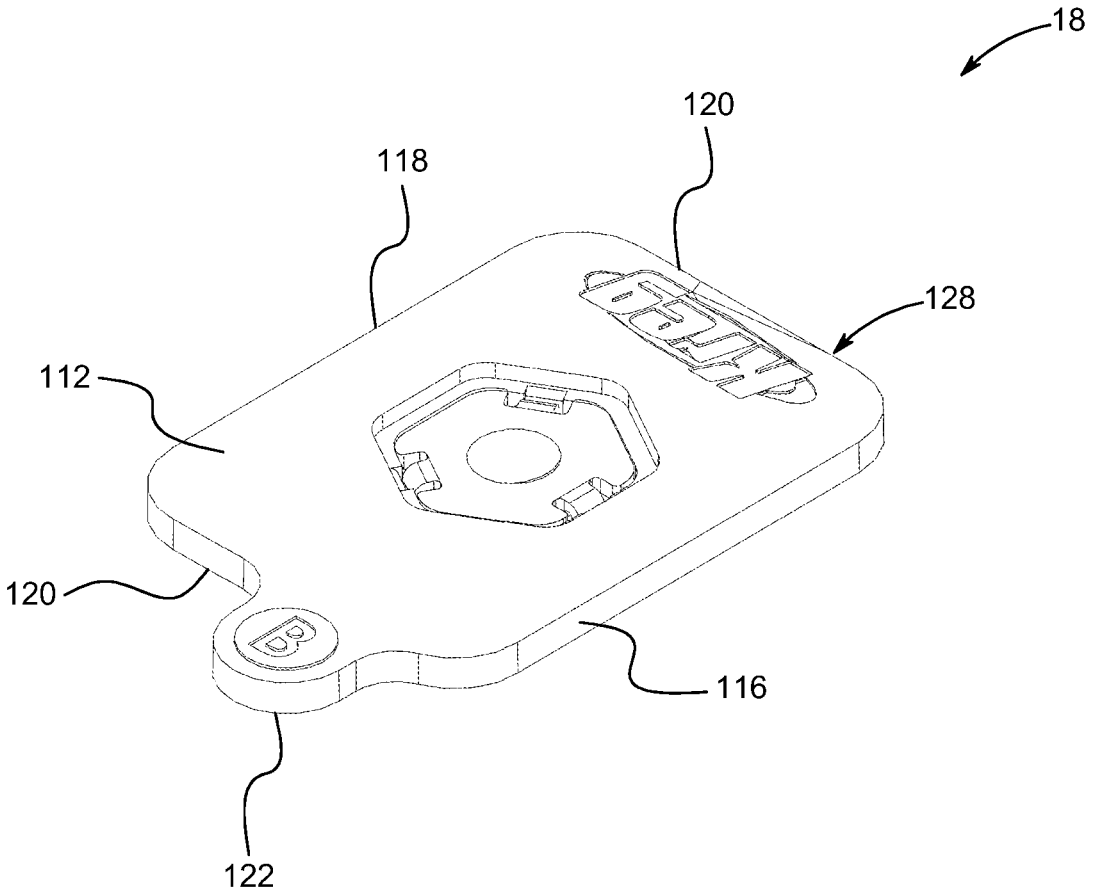
FIG. 22 is a top perspective view of a thick shim shown in FIG. 21, the view showing the recess which allows for the securing of an additional shim on top.
Figure 23:
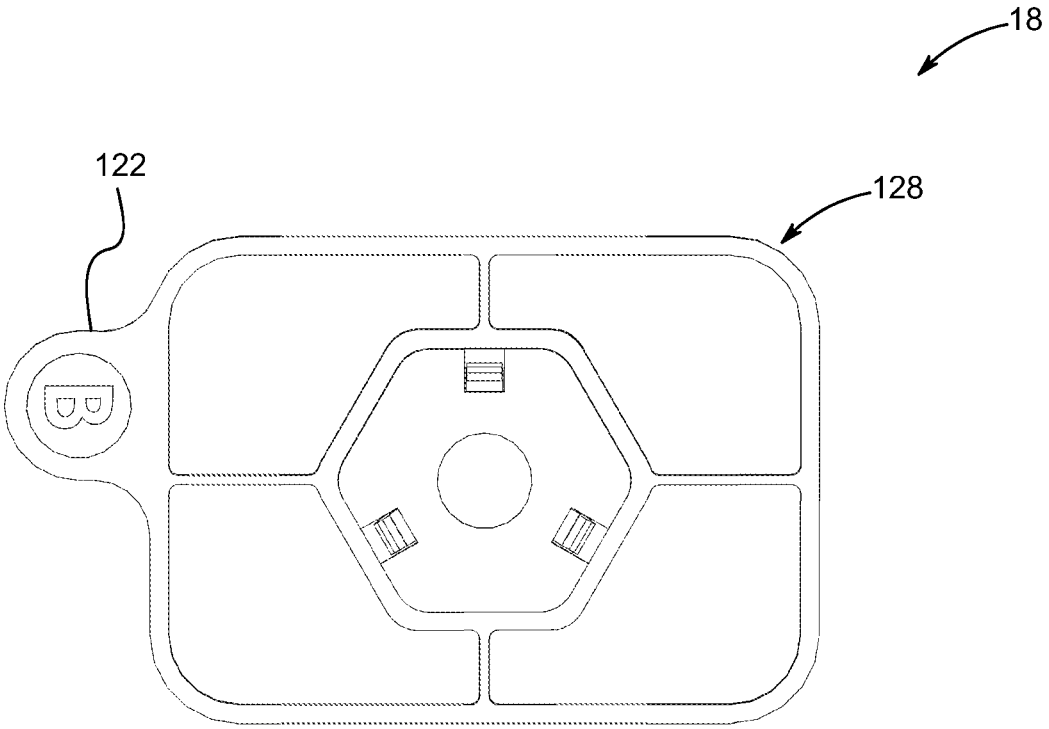
FIG. 23 is a bottom elevation view of a thick shim shown in FIG. 21.
Figure 24:
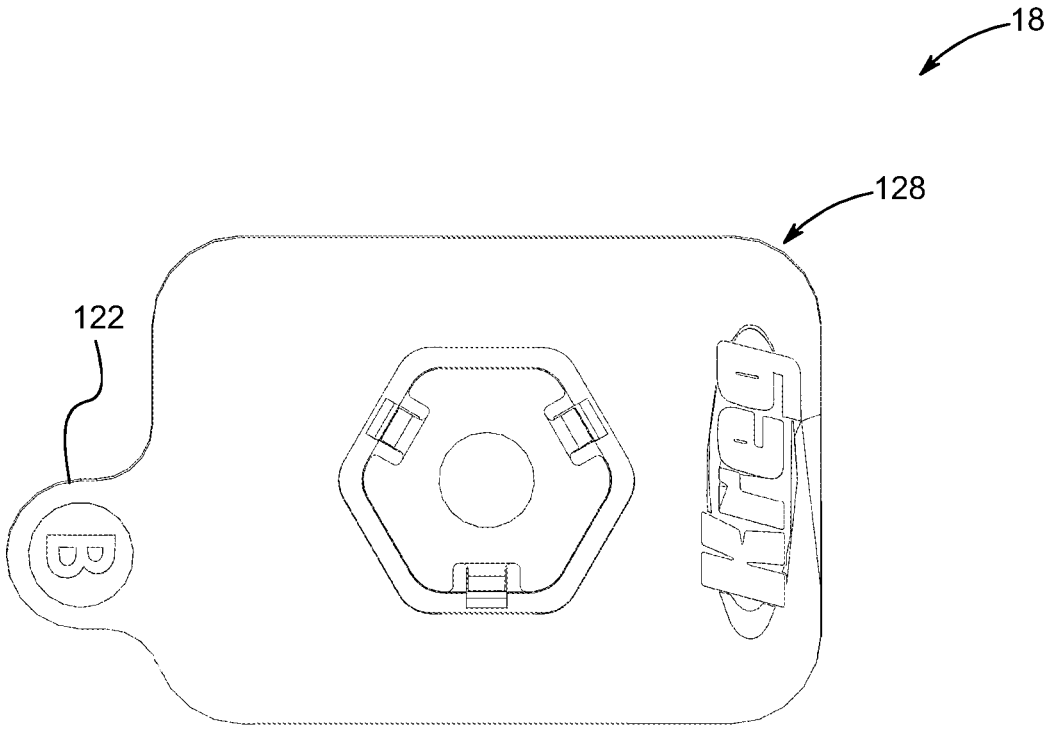
FIG. 24 is a top elevation view of a thick shim shown in FIG. 21.
Figure 25:
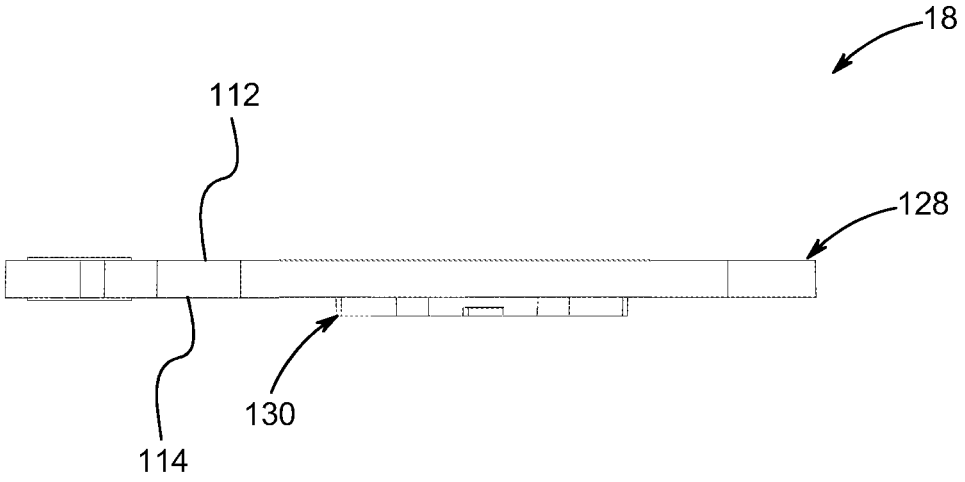
FIG. 25 is a side view of a thick shim shown in FIG. 21.
Figure 26:
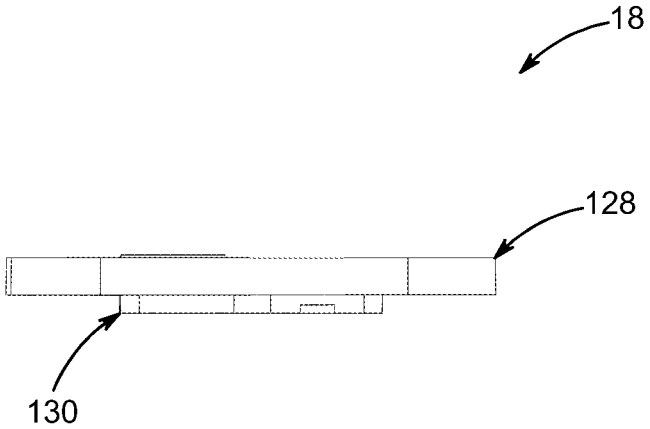
FIG. 26 is an alternate side view of a thick shim shown in FIG. 21.
Figure 27:
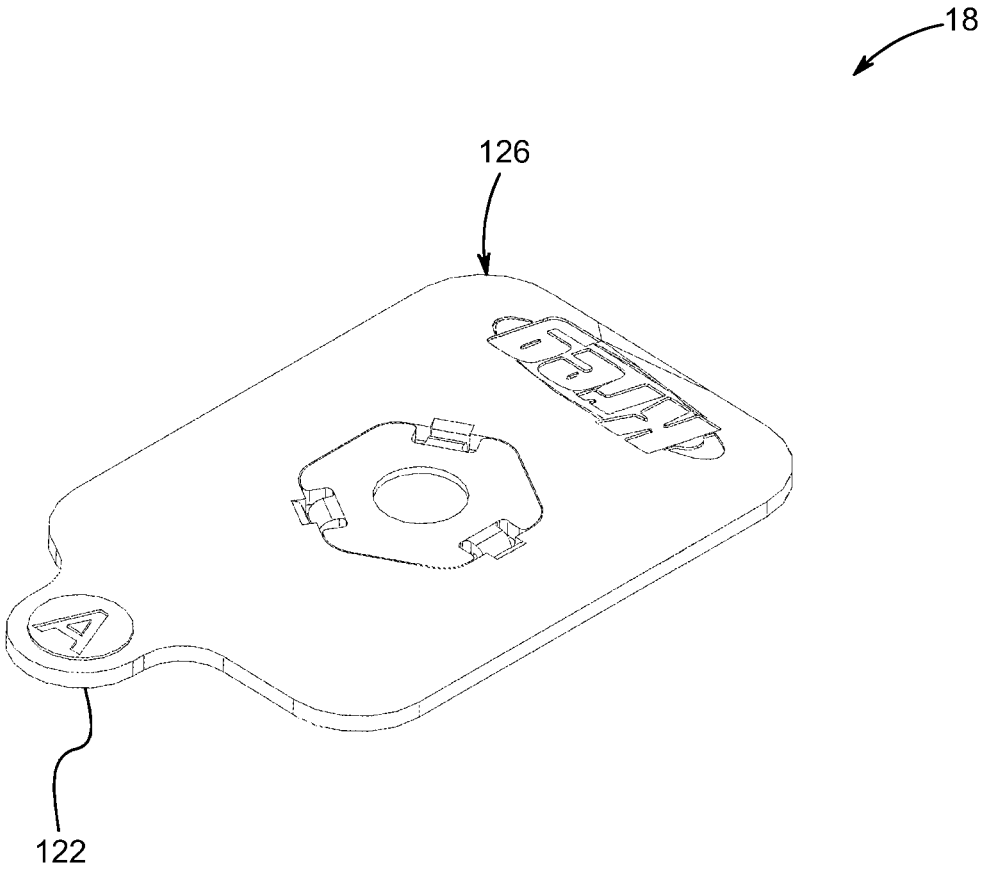
FIG. 27 is a top perspective view of a thin shim, the view showing the recess which allows for the securing of an additional shim on top.
Figure 28:
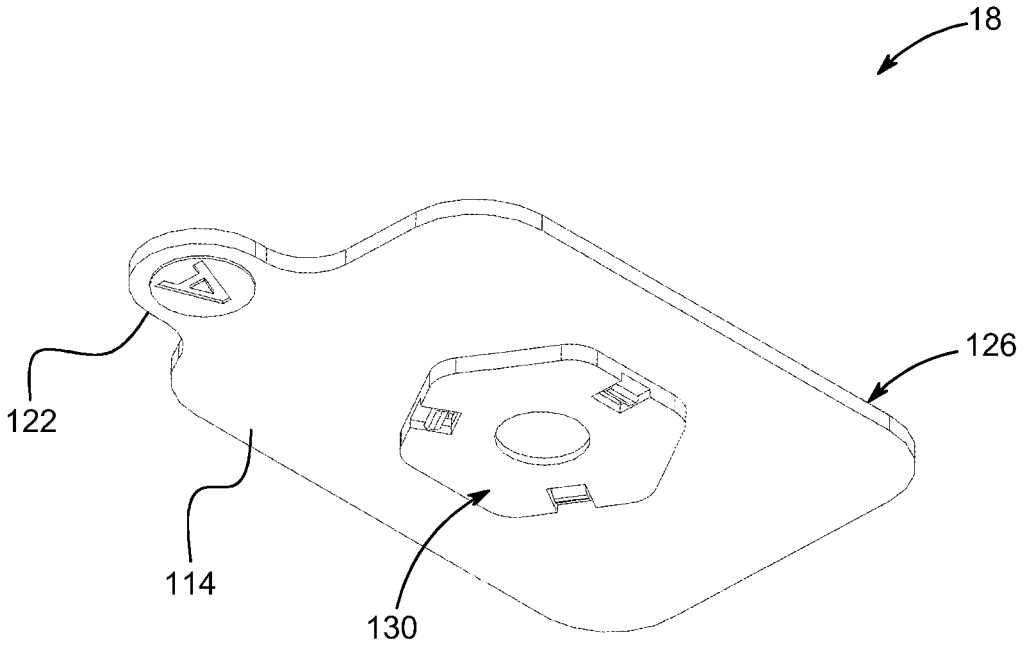
FIG. 28 is a bottom perspective view of a thin shim shown in FIG. 27, the view showing the connection features of the thin shim.
Figure 29:
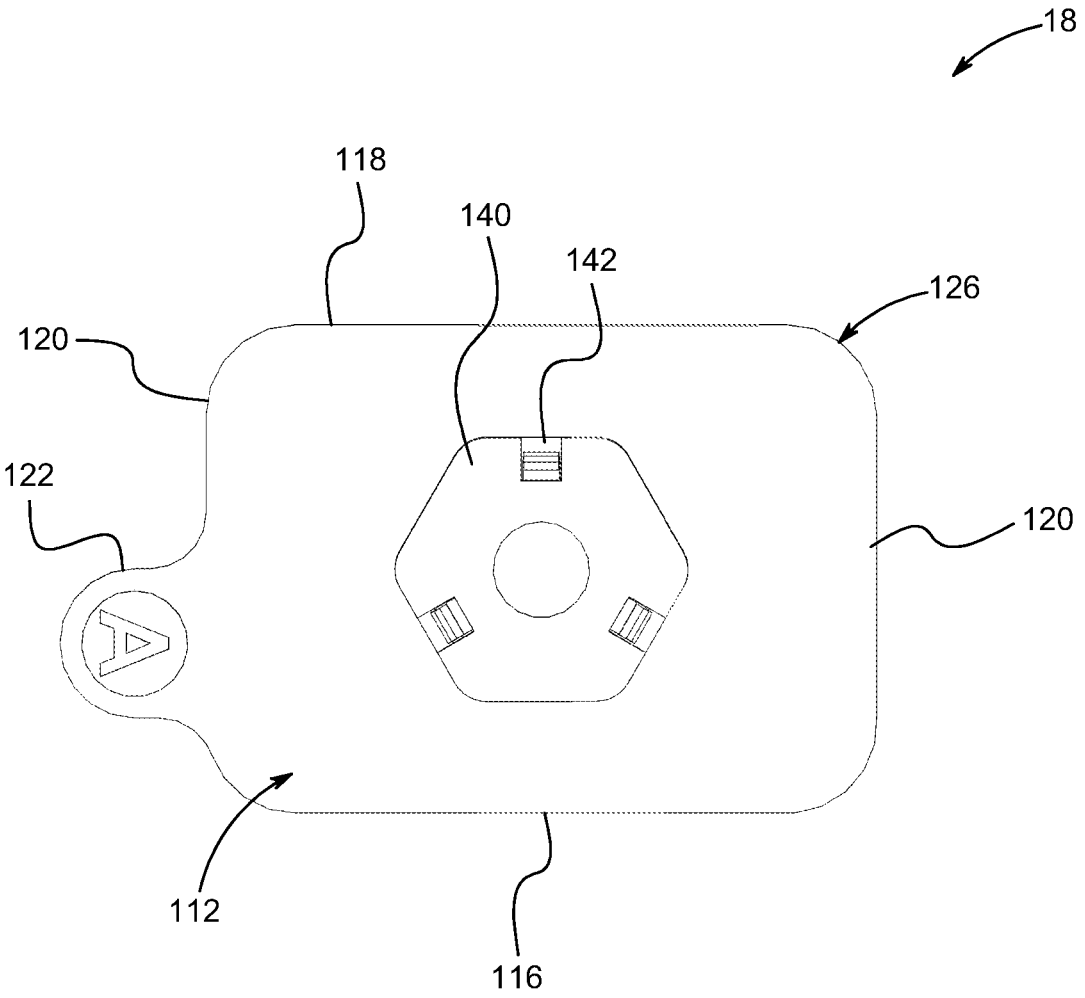
FIG. 29 is an alternate, bottom elevation view of the thin shim shown in FIG. 27, the view showing a cover of the shim which fits over and holds magnetically attracted material in the recess of the shim.
Figure 30:
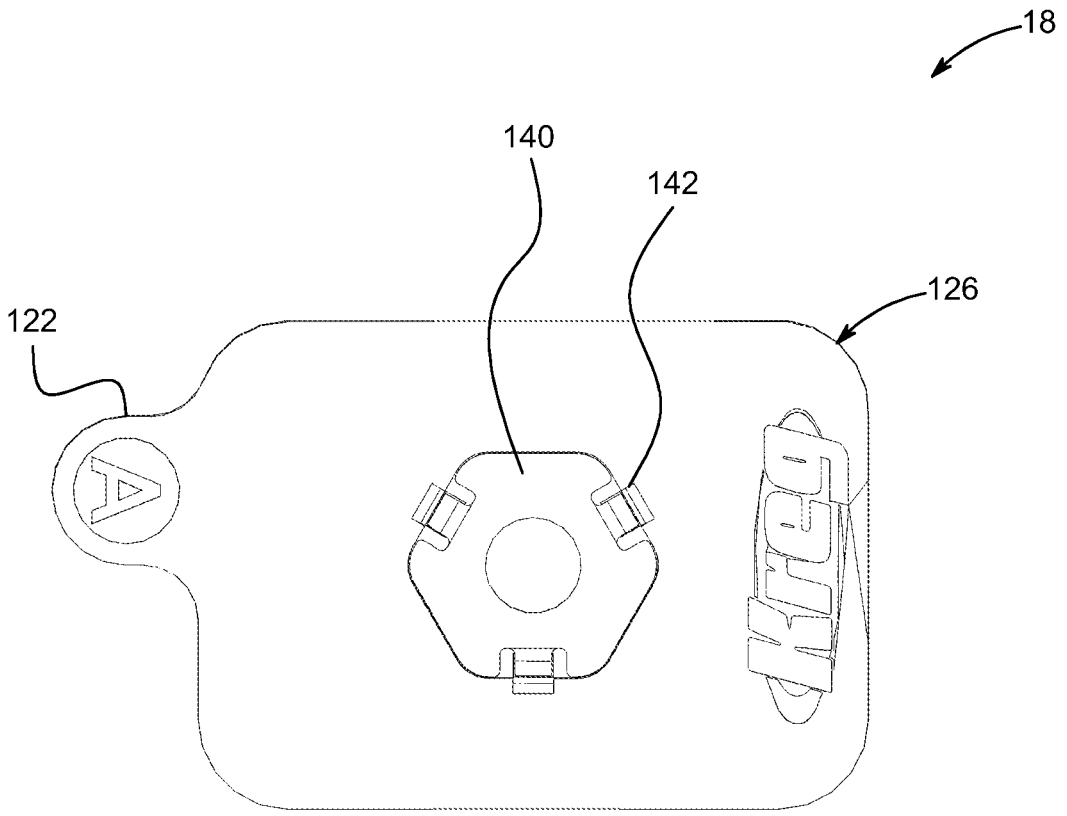
FIG. 30 is a top elevation view of the thin shim shown in FIG. 27, the view showing the cover of the shim and snap features of the cover.
Figure 31:
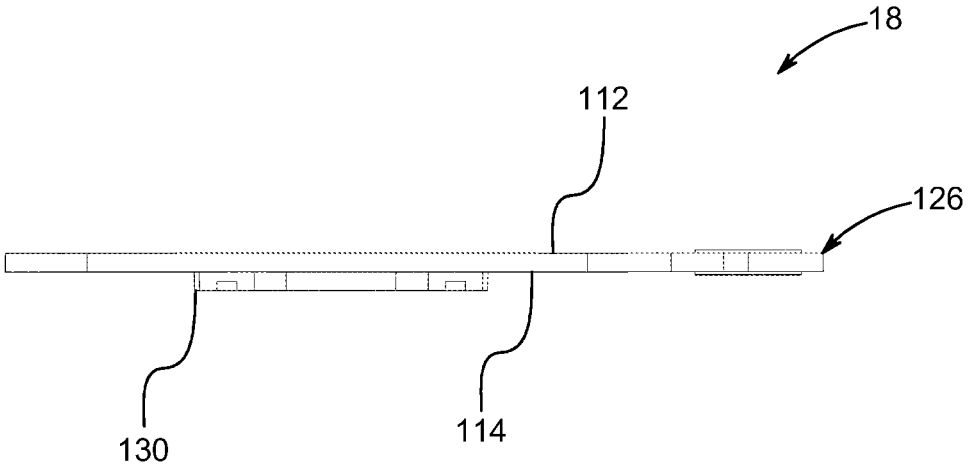
FIG. 31 is a side elevation view of the thin shim shown in FIG. 27.
Figure 32:
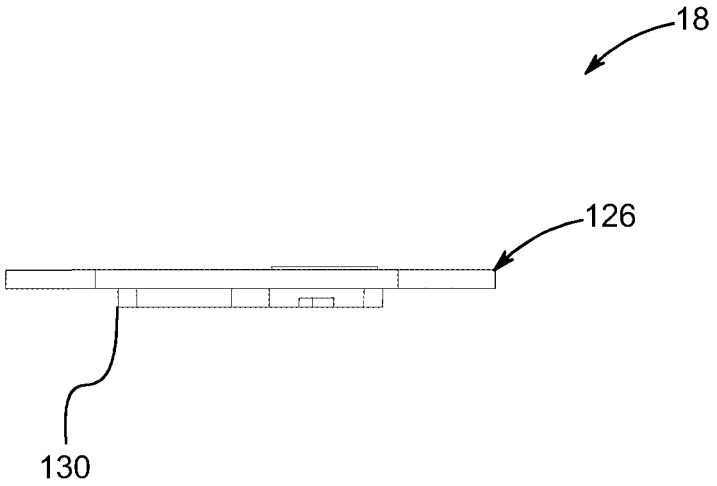
FIG. 32 is a side elevation view of the thin shim shown in FIG. 27; the view showing the elevation view from the opposing side.
Figure 33:
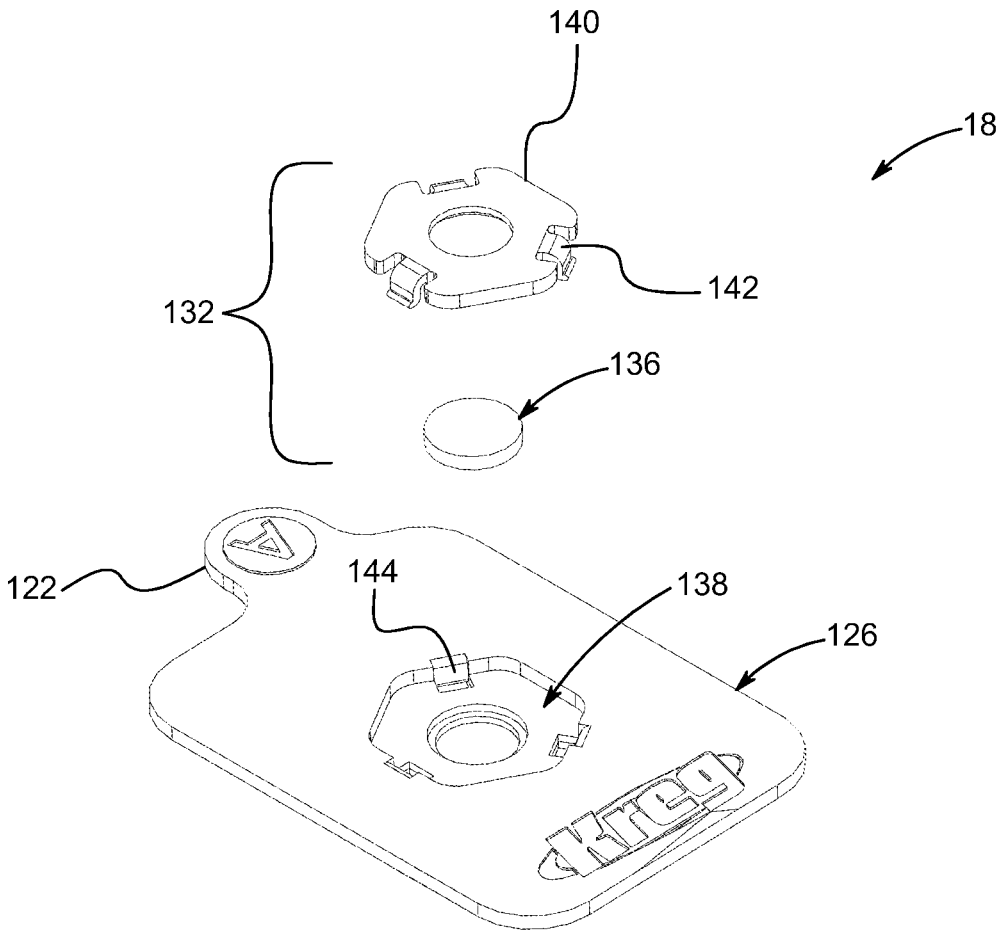
FIG. 33 is an exploded view of the thin shim shown in FIG. 27, the view showing the top of the thin shim having a recess and snap features, and a cover which fits over and holds the magnetically attracted materials also shown.
Figure 34:
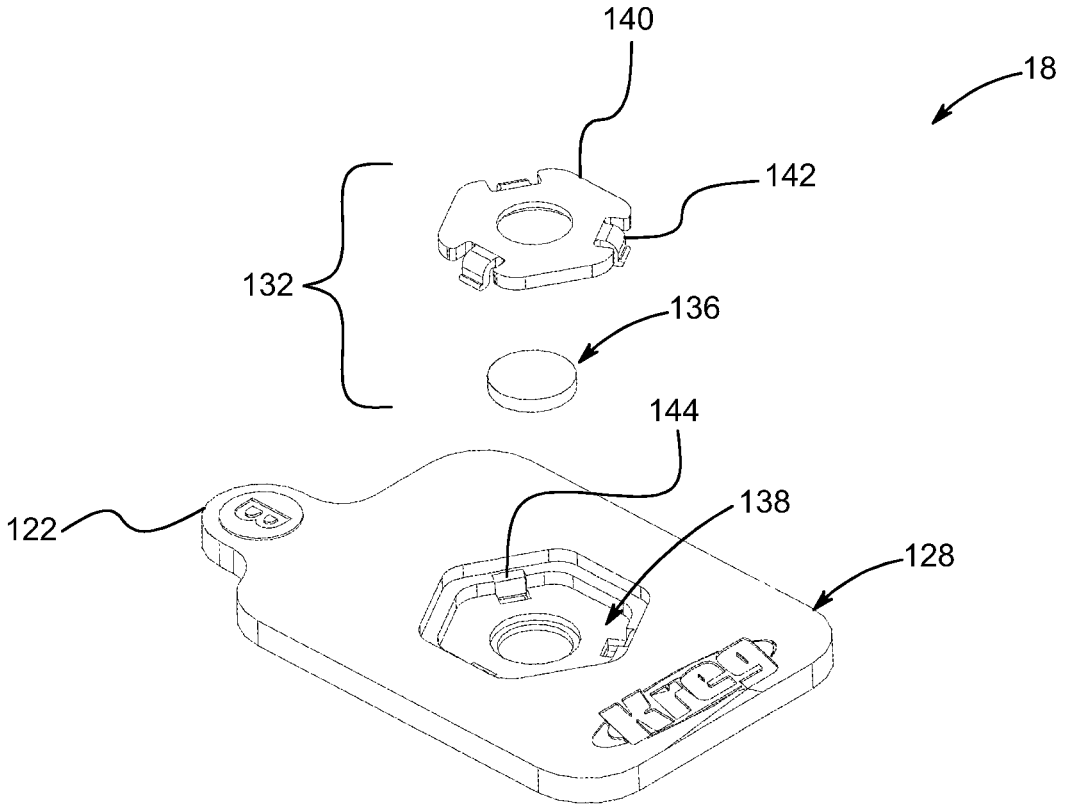
FIG. 34 is an exploded view of the thick shim shown in FIG. 21, the view showing the top of the thick shim having a recess and snap features, and a cover which fits over and holds the magnetically attracted materials also shown.
Figure 35:
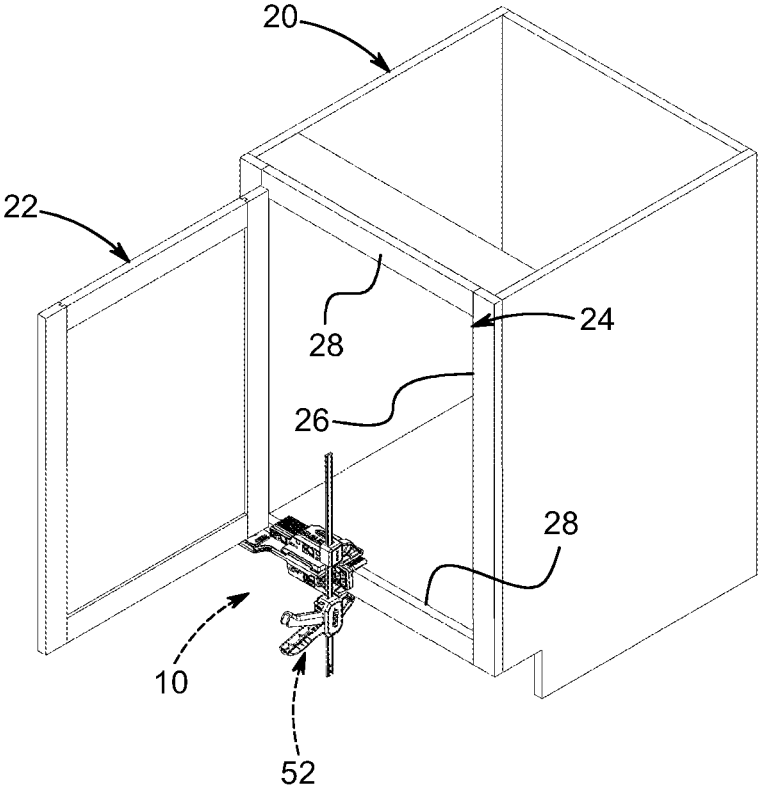
FIG. 35 is an angled perspective view showing the front side of a cabinet with the cabinet door ajar and supported by the adjustable support system for hanging cabinet doors, the view showing a clamp holding the system in place along the face frame of the cabinet.
Figure 36:
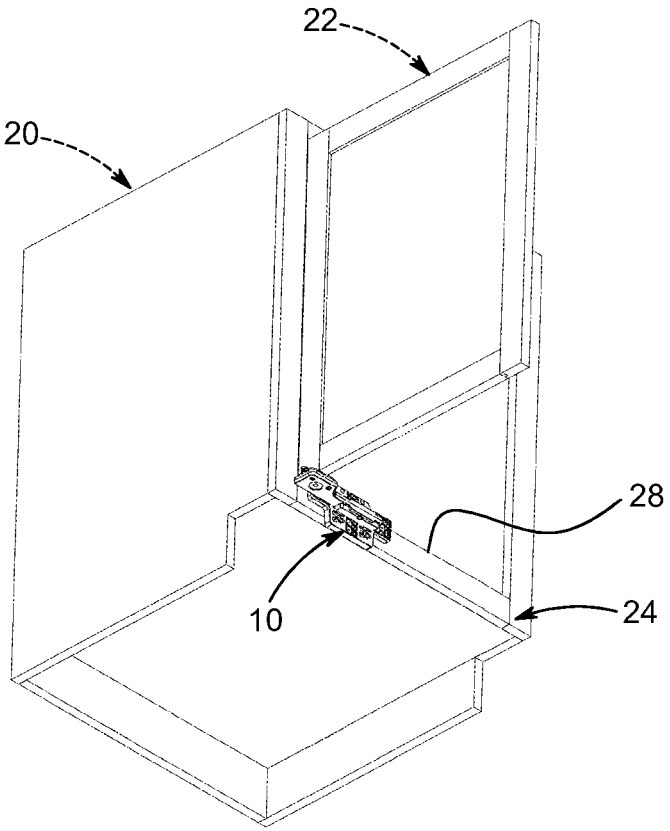
FIG. 36 is a bottom perspective view showing the system placed on a cabinet.
Figure 37:
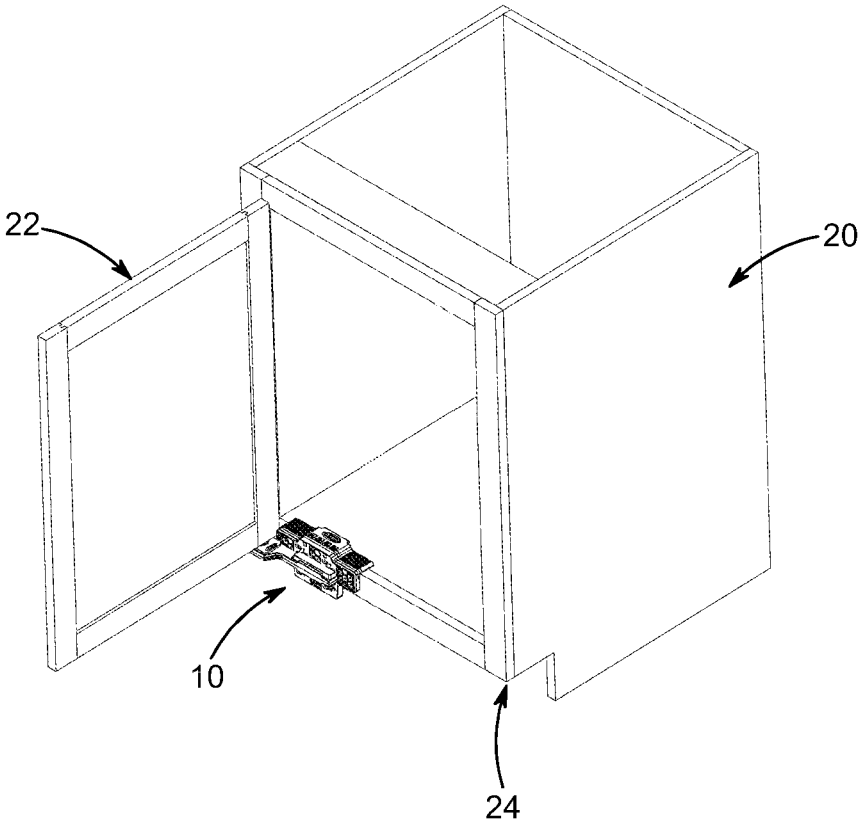
FIG. 37 is a top perspective view showing the support system placed on a cabinet, shown in FIG. 36.
Figure 38:
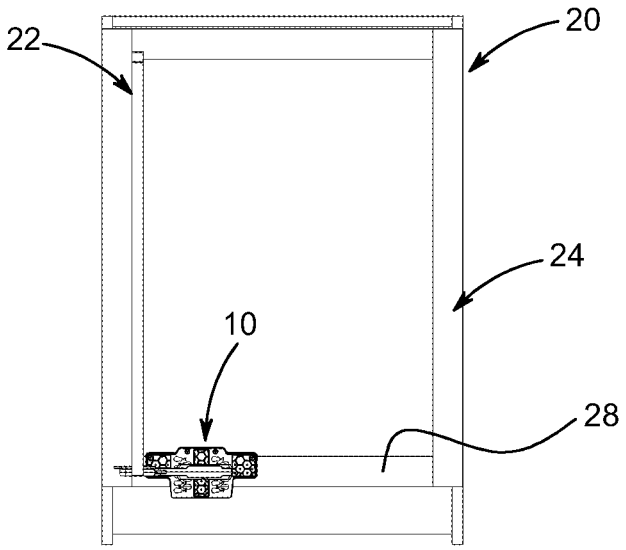
FIG. 38 is a front elevation view of the support system placed on a cabinet, shown in FIG. 36.
Figure 39:
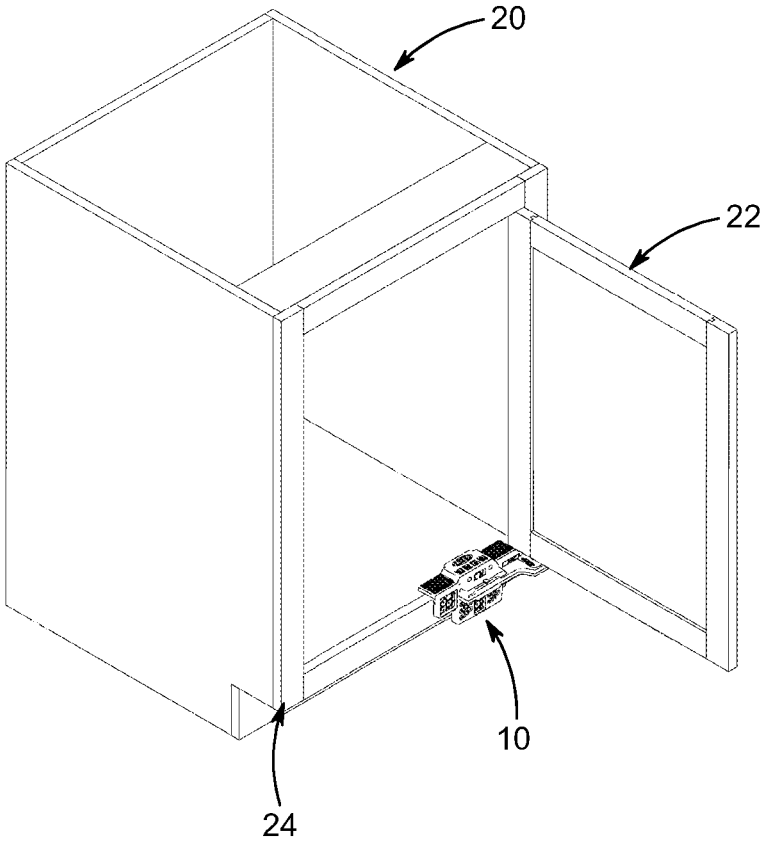
FIG. 39 is a front elevation view of the support system shown in FIG. 36, the view showing an alternate side and the capability of the system to be interchangeable depending on where the object being supported is located.
Figure 40:
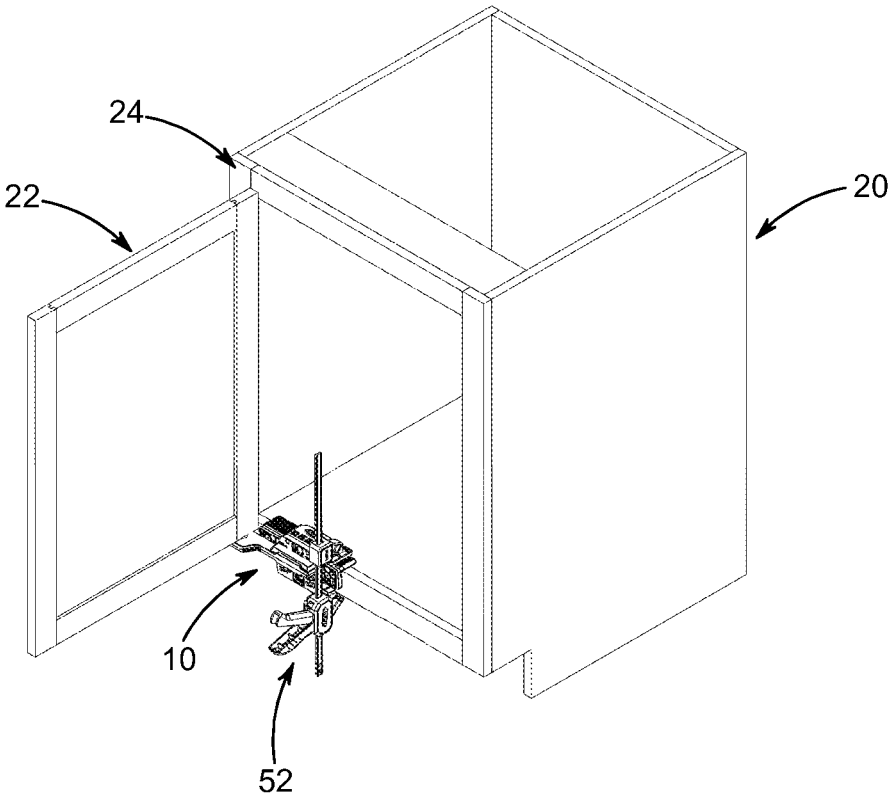
FIG. 40 is a top perspective view of the support system in use with a clamp.
Figure 41:
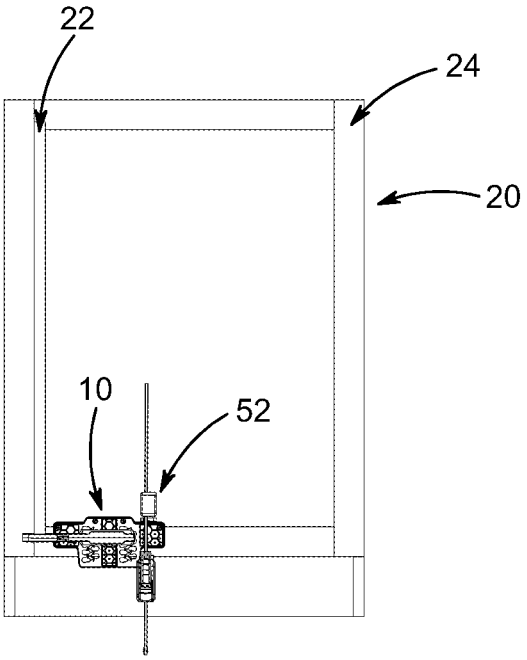
FIG. 41 is a front elevation view of the support system shown in FIG. 40.
Figure 42:
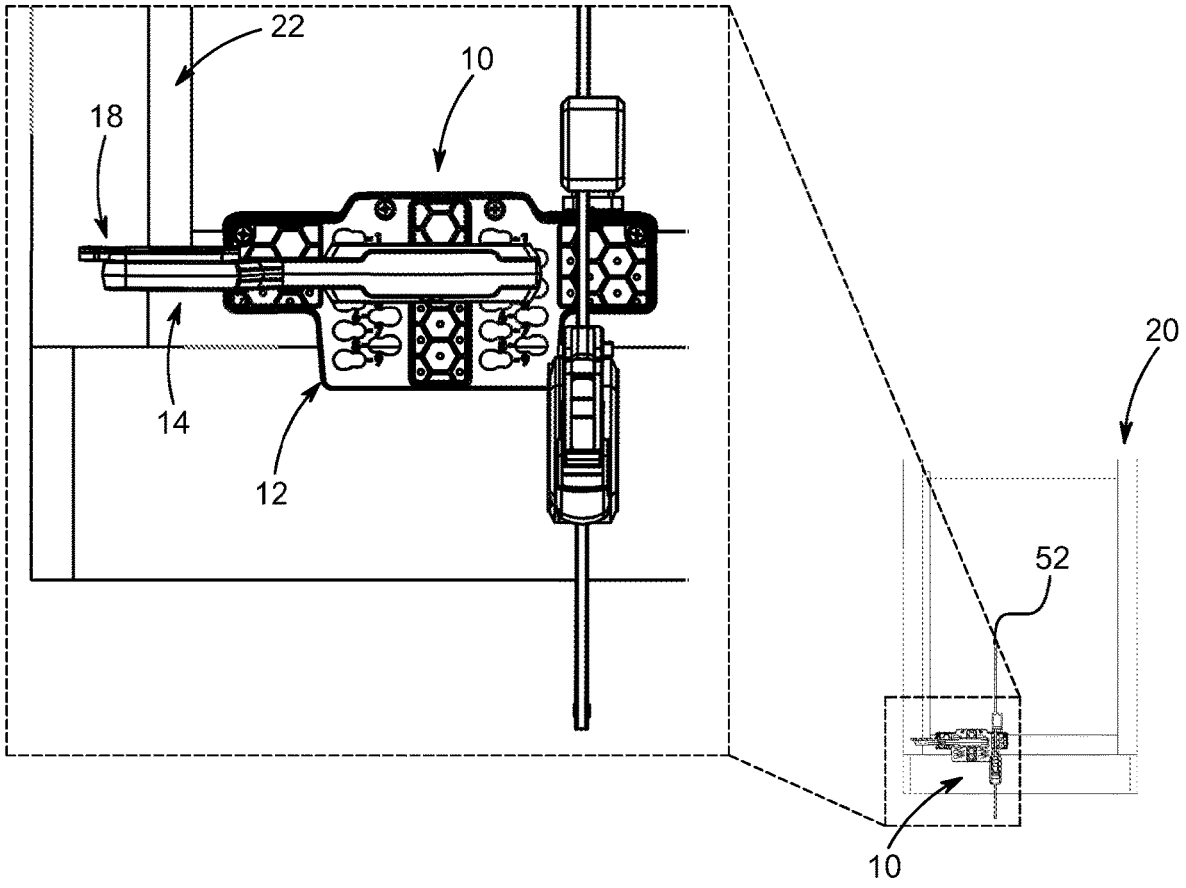
FIG. 42 is a zoomed in view of the support system shown in FIG. 40, the view showing the system with a main body and a support arm and shims in place on the support arm.
Figure 43:
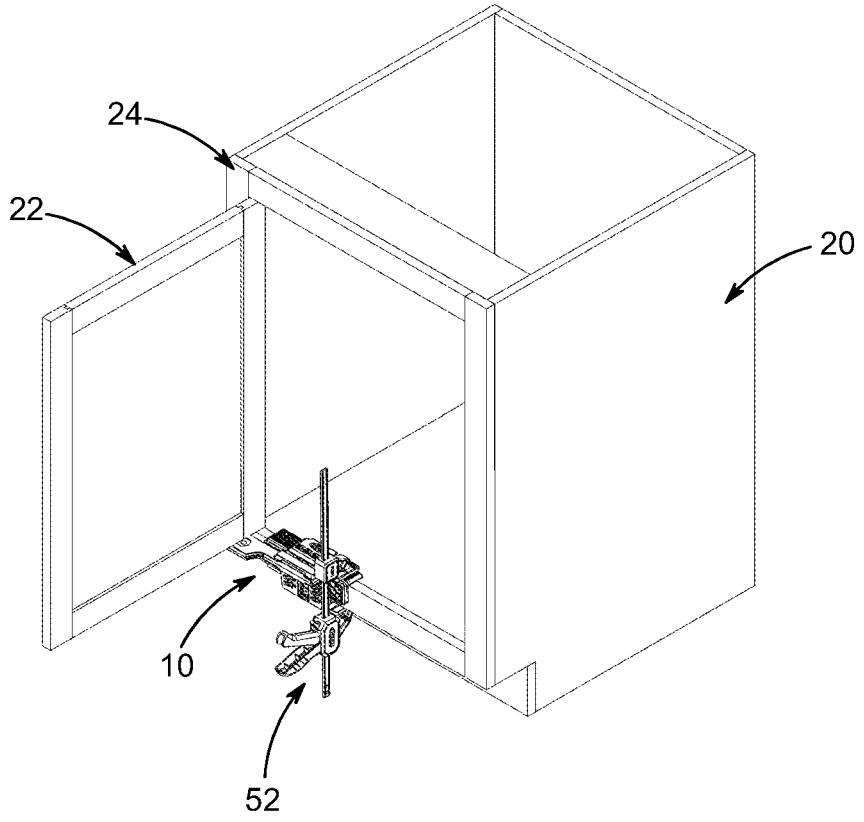
FIG. 43 is an alternate, top perspective view of the support system in use on a cabinet held in place by a clamp.
Figure 44:
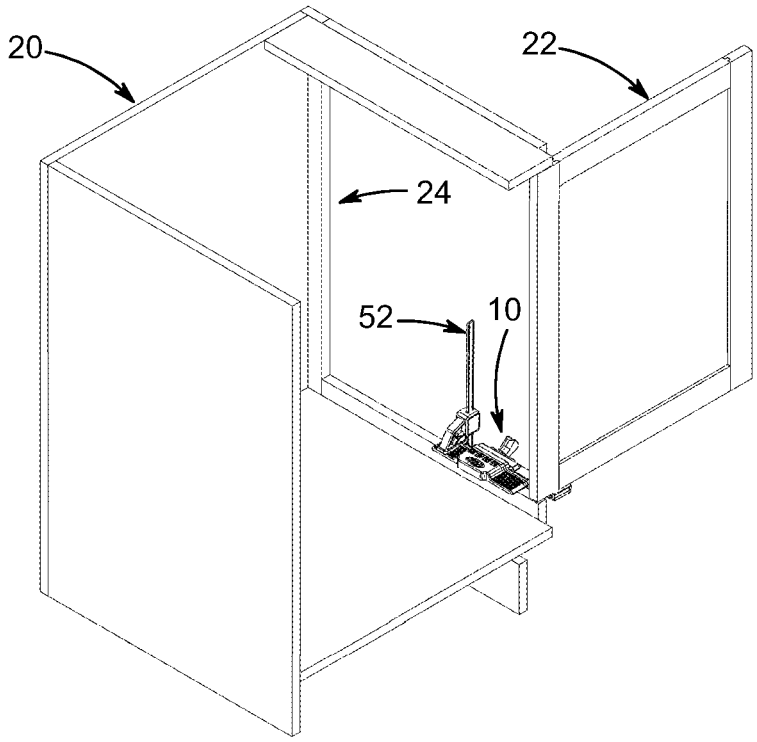
FIG. 44 is an alternate, top perspective view of the support system in use on a cabinet shown from the inside of the cabinet.
Figure 45:
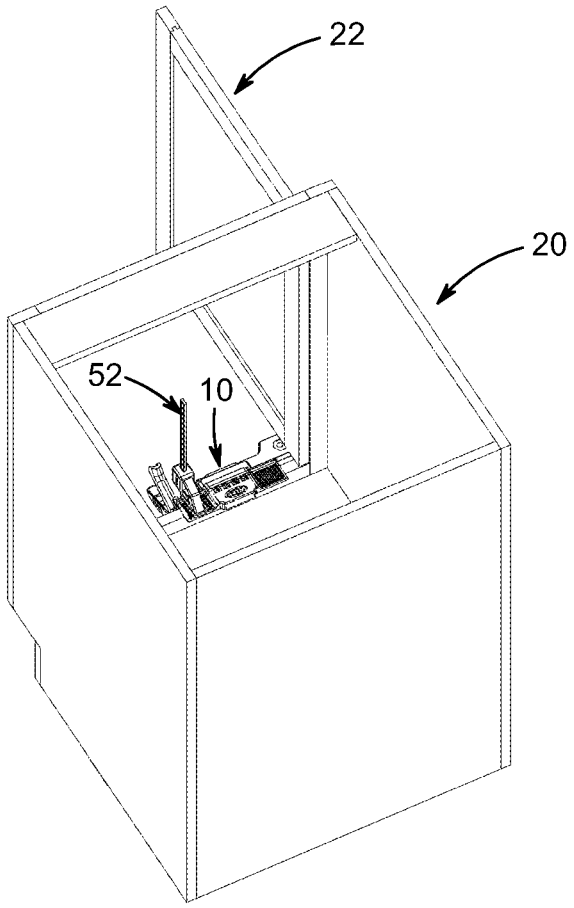
FIG. 45 is another top perspective view of the support system in use on a cabinet and held in place by a clamp, the view showing the perspective from inside the cabinet.
Figure 46:
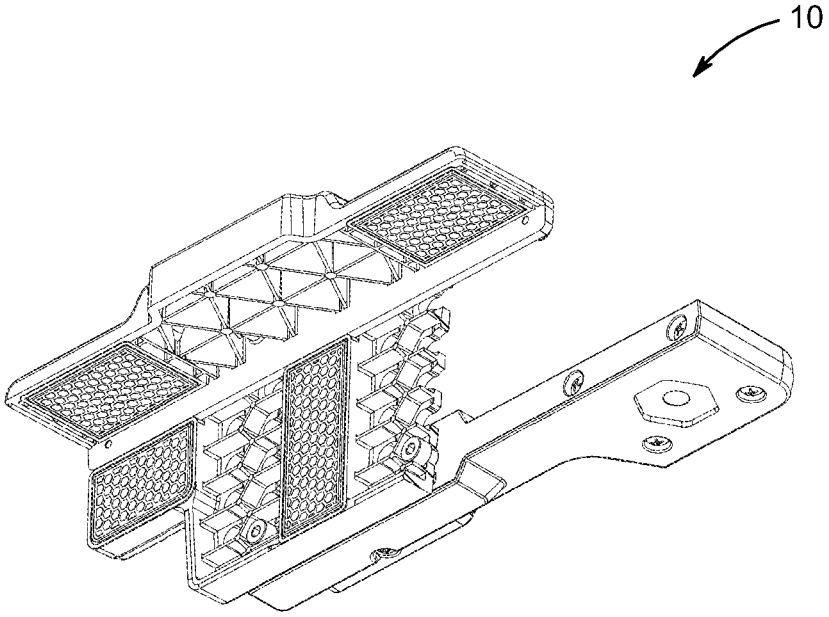
FIG. 46 is a perspective view of the system with one of the opposing sides removed to show how the lock features of the support arm fit into the lock features of the front member.
Figure 47:
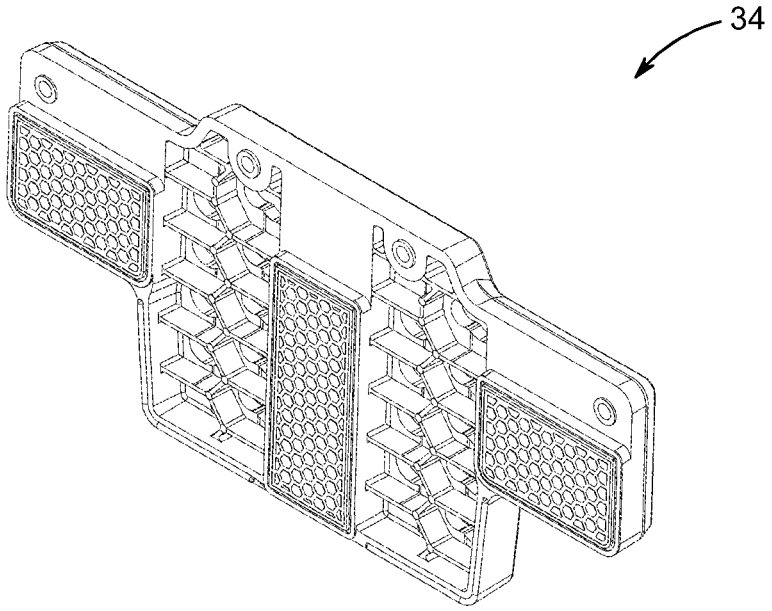
FIG. 47 is a rear perspective view of the front member.
Figure 48:
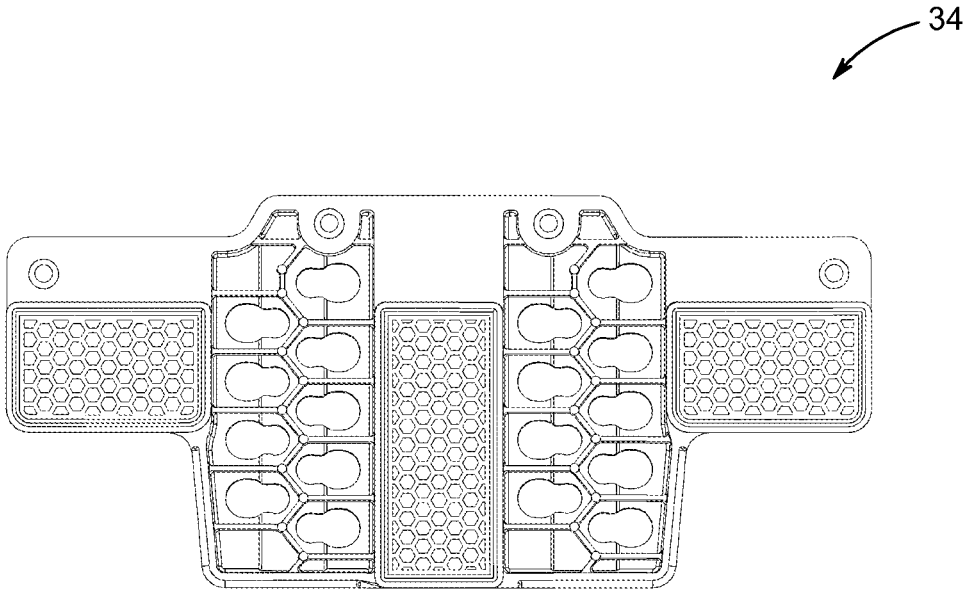
FIG. 48 is a rear elevation view of the front member.
Figure 49:
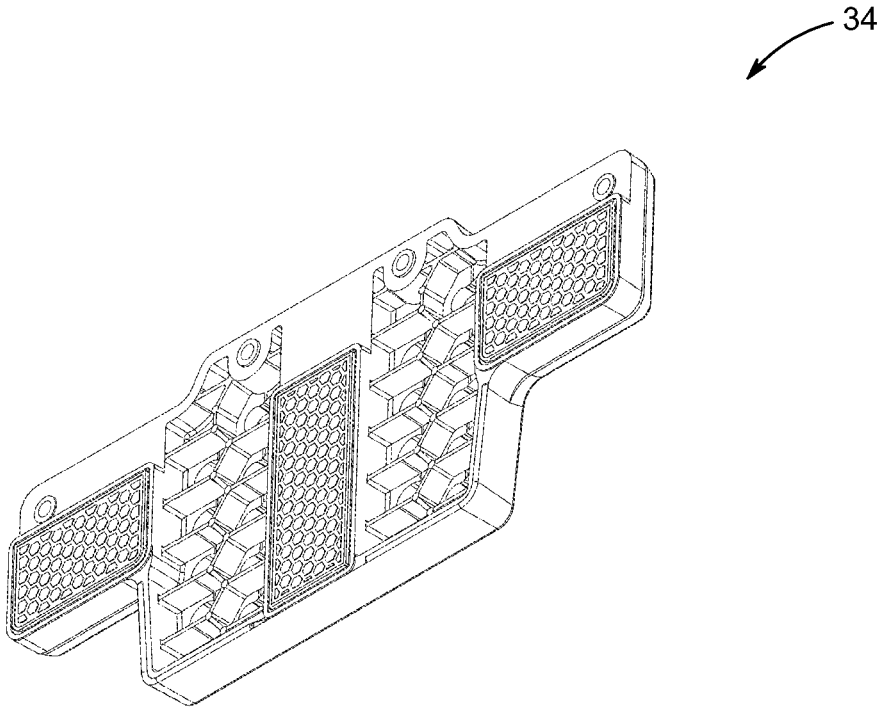
FIG. 49 is a bottom, rear, perspective view of the front member.
Figure 50:
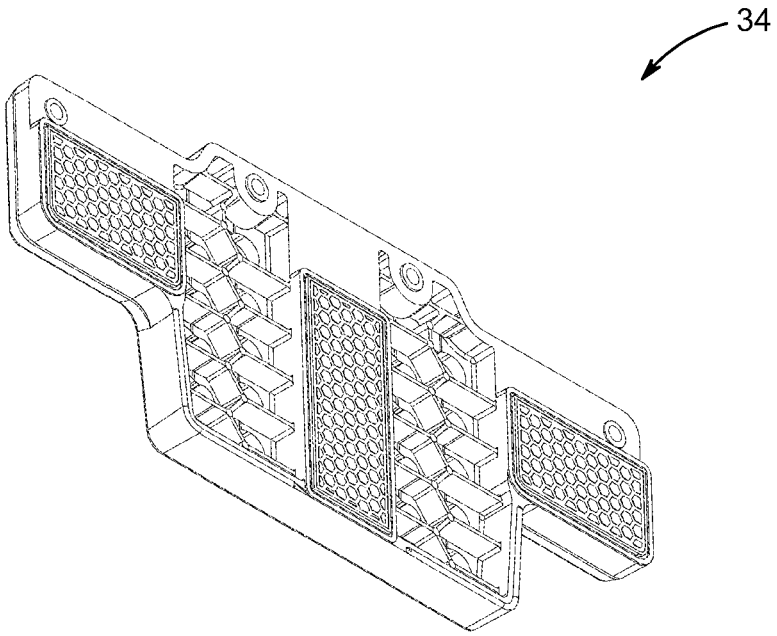
FIG. 50 is an alternate, bottom, rear, perspective view of the front member.
Figure 51:
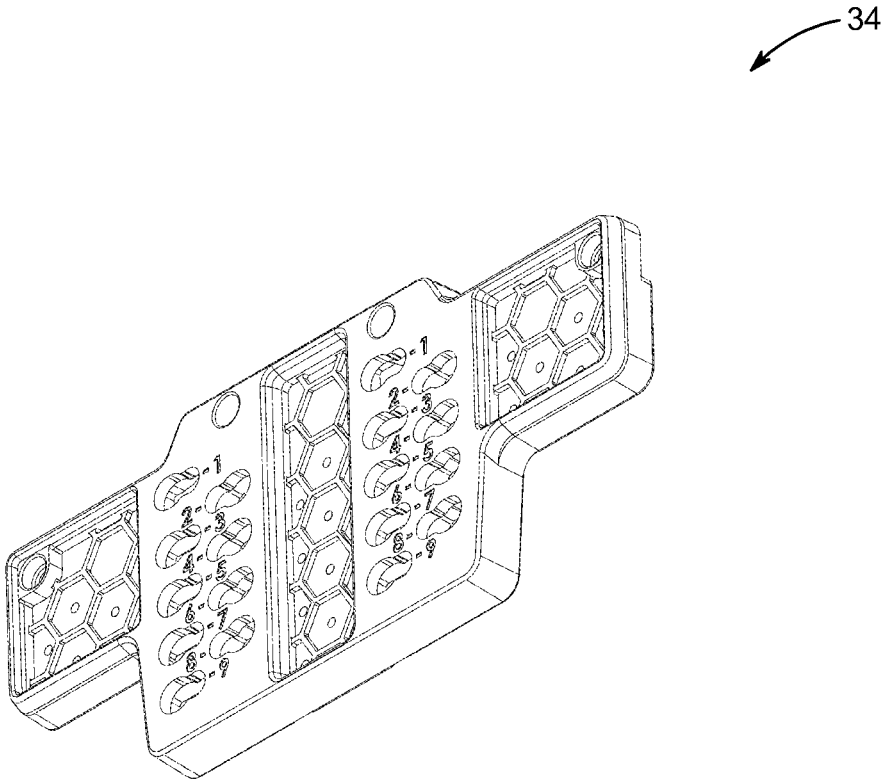
FIG. 51 is a bottom, front, perspective view of the front member.
Figure 52:
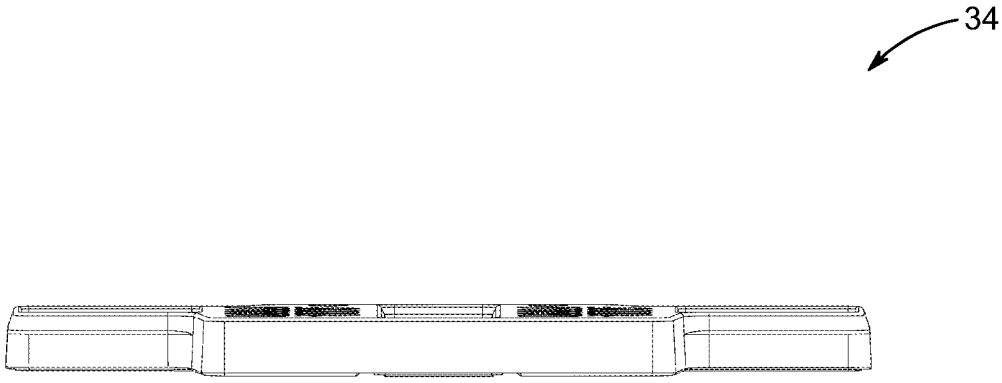
FIG. 52 is a bottom perspective view of the front member.
Figure 53:
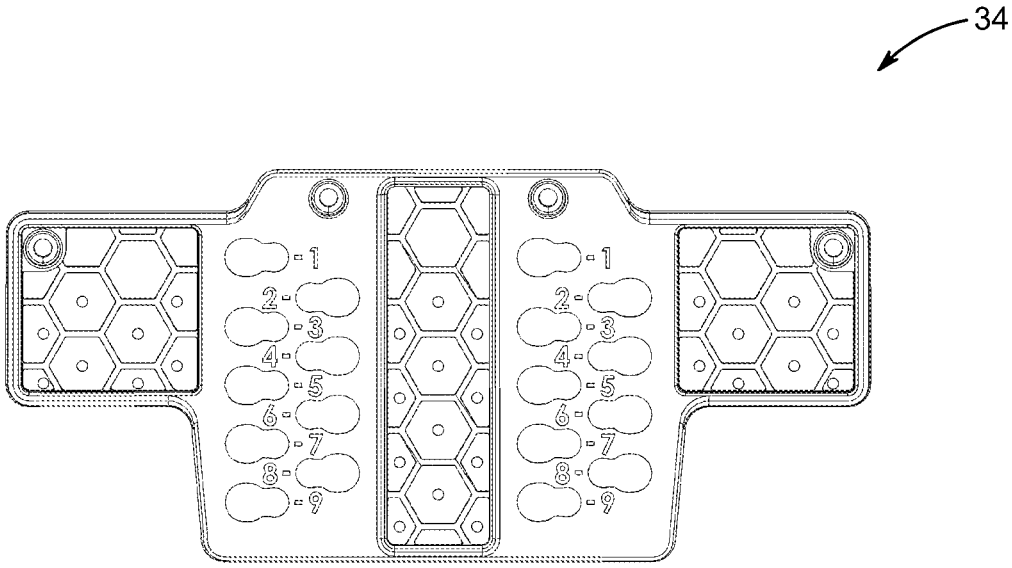
FIG. 53 is a front elevation view of the front member, the view fully showing the locking features of the front member.
Figure 54:
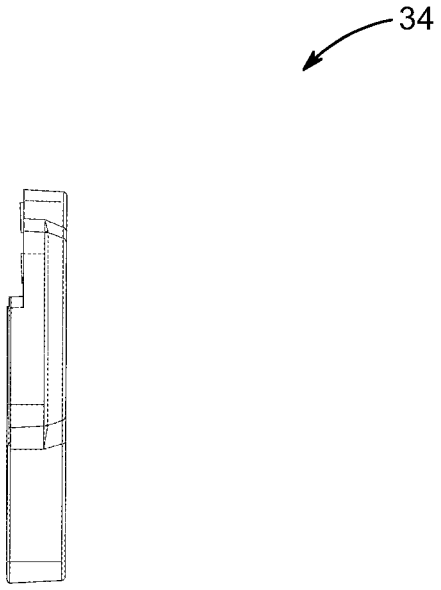
FIG. 54 is a side elevation view of the front member.
Figure 55:
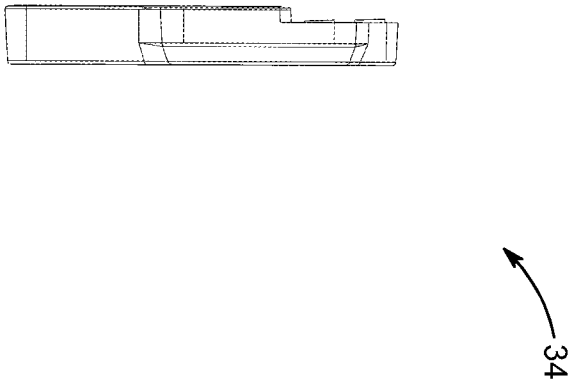
FIG. 55 is the opposing side elevation view of the front member.
Figure 56:
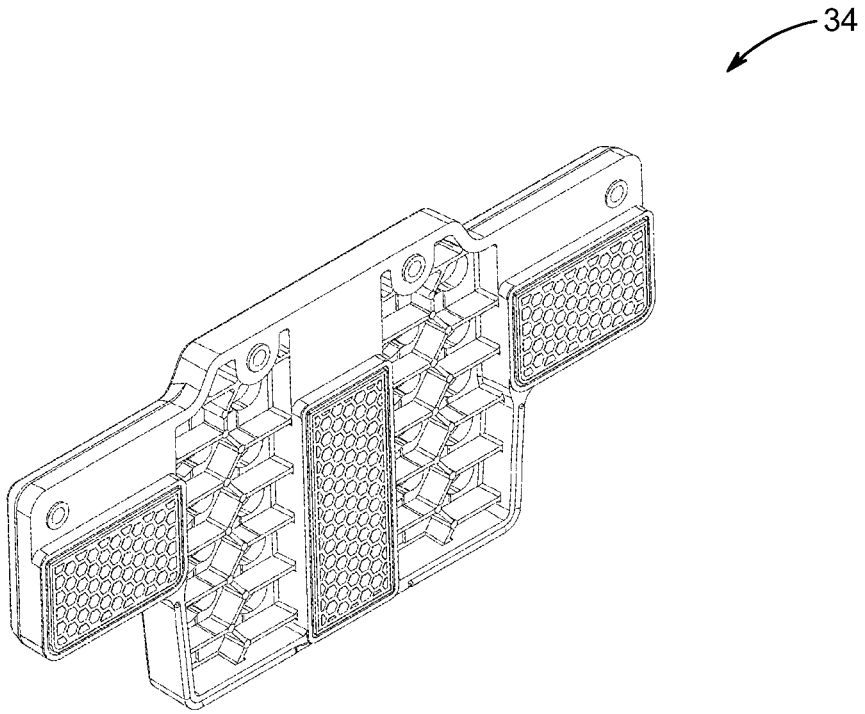
FIG. 56 is a top, rear, perspective view of the front member.
Figure 57:
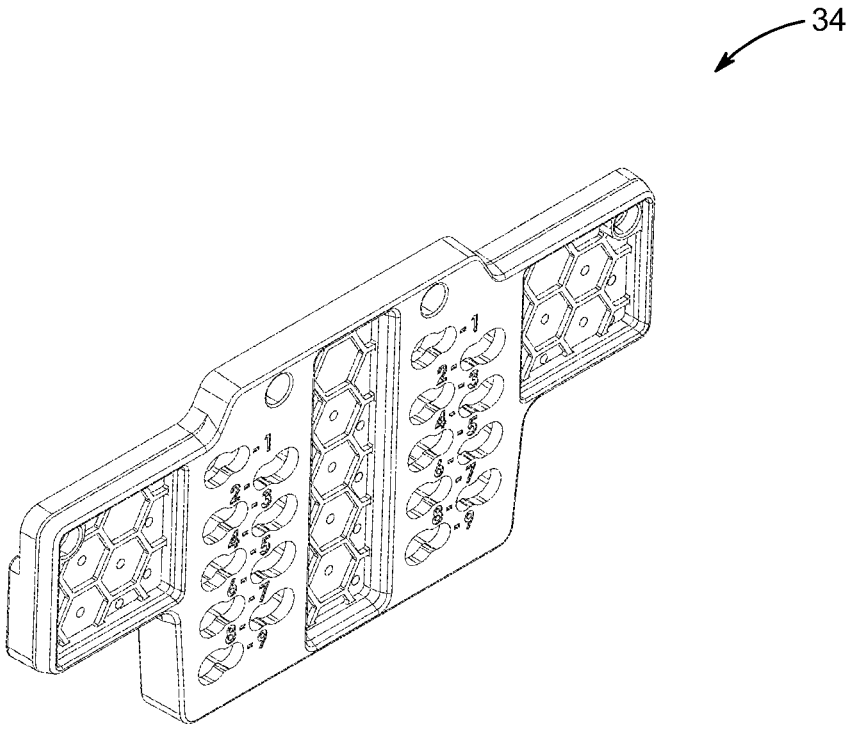
FIG. 57 is a top, front, perspective view of the front member.
Figure 58:
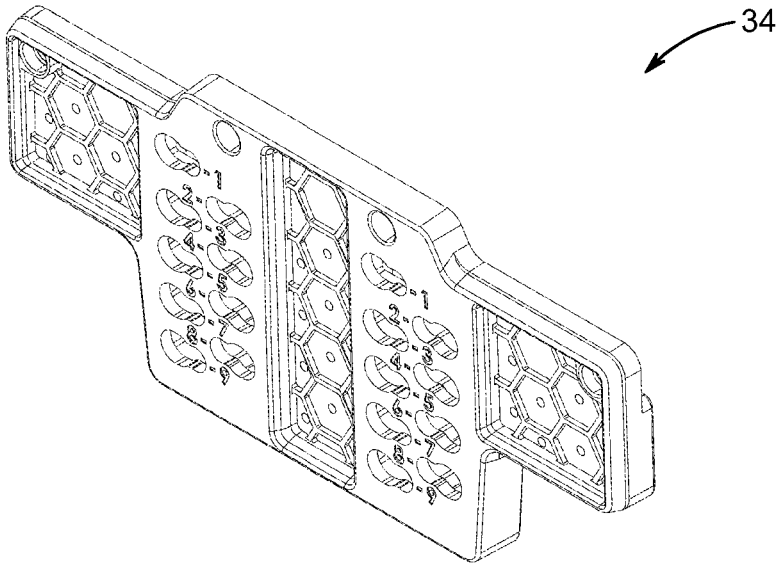
FIG. 58 is a top, front perspective view of the front member from the opposing side.
Figure 59:
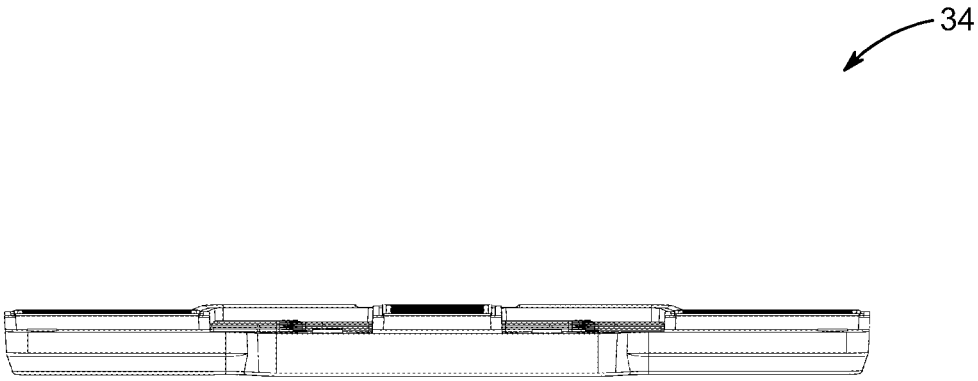
FIG. 59 is a top perspective view of the front member.
Figure 60:
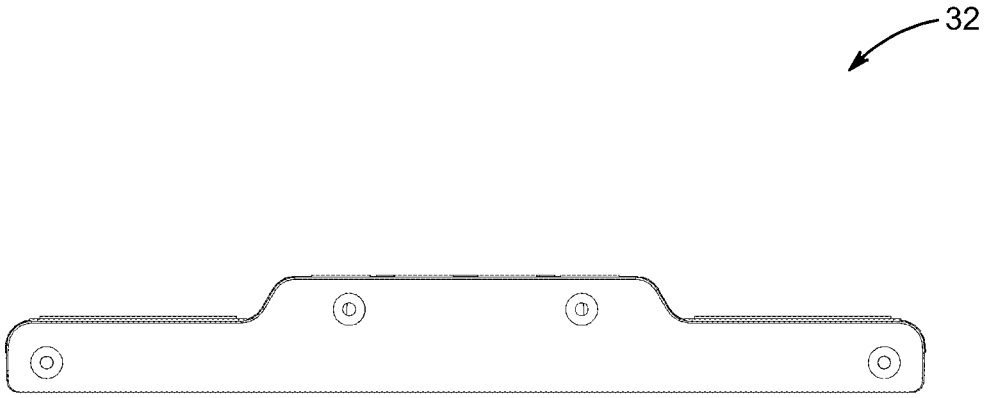
FIG. 60 is a front elevation view of the top member.
Figure 61:
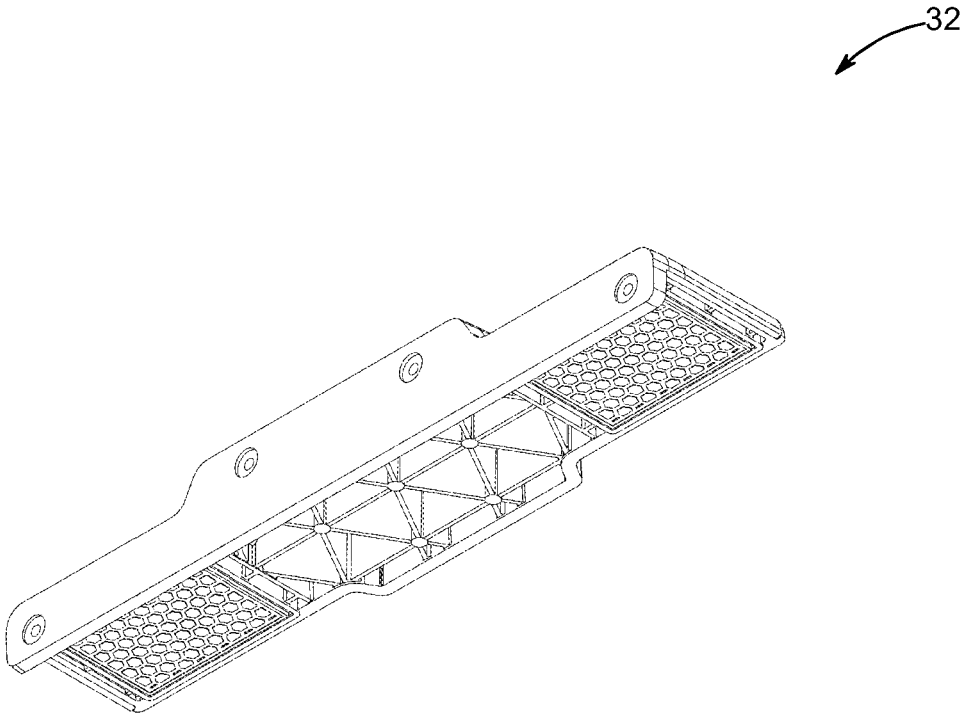
FIG. 61 is a front, bottom perspective view of the top member.
Figure 62:
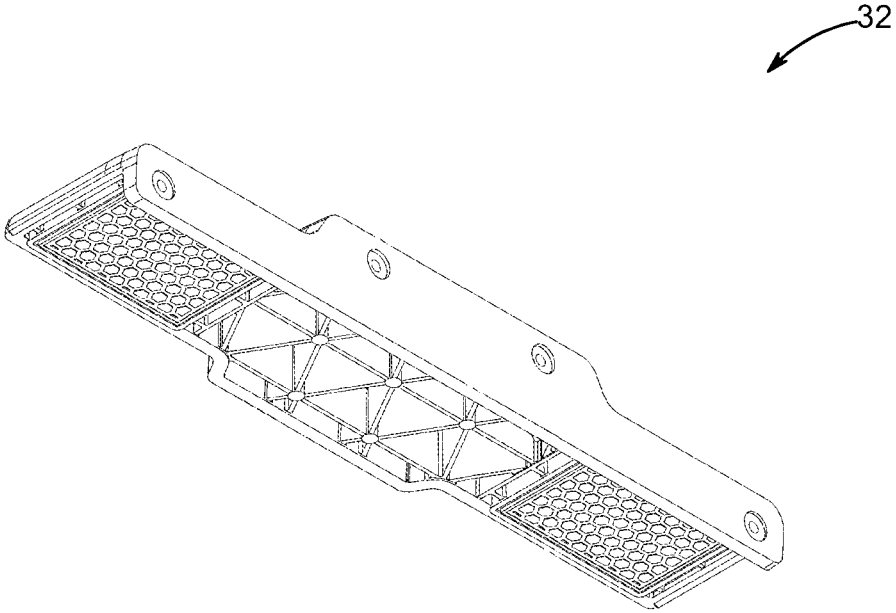
FIG. 62 is a front, bottom perspective view of the top member from the opposing side.
Figure 63:
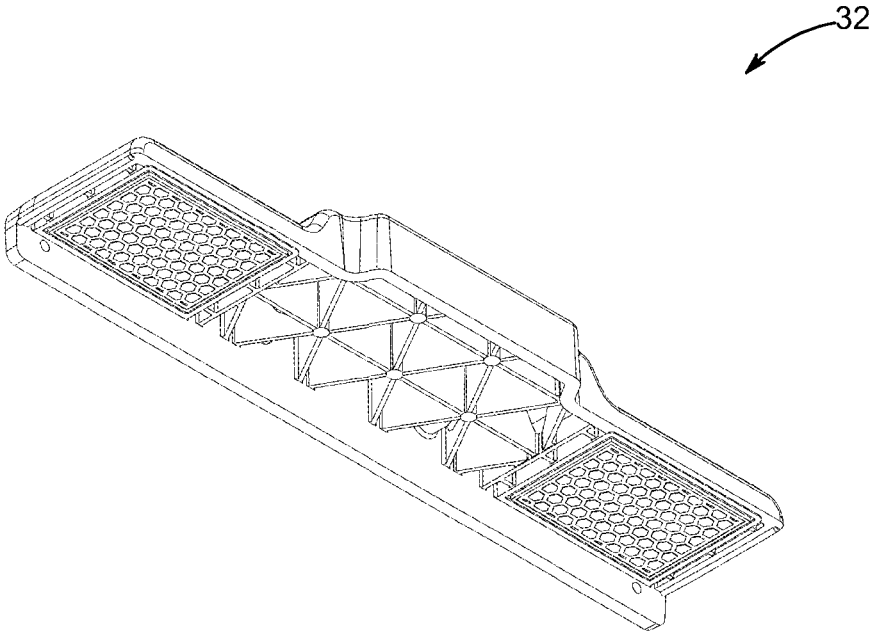
FIG. 63 is a rear, bottom perspective view of the top member.
Figure 64:
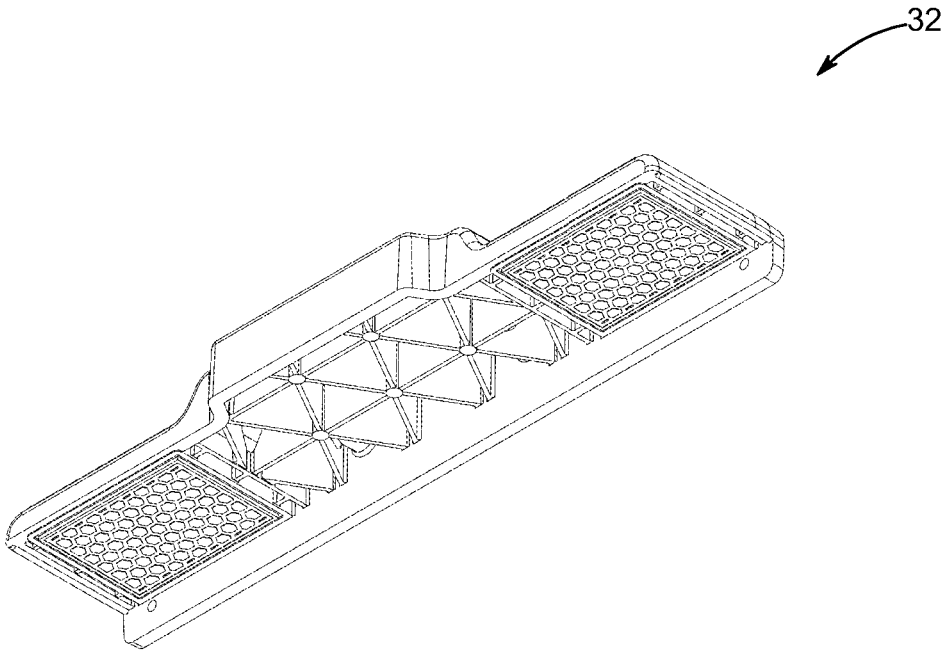
FIG. 64 is a rear, bottom perspective view of the top member from the opposing side.
Figure 65:
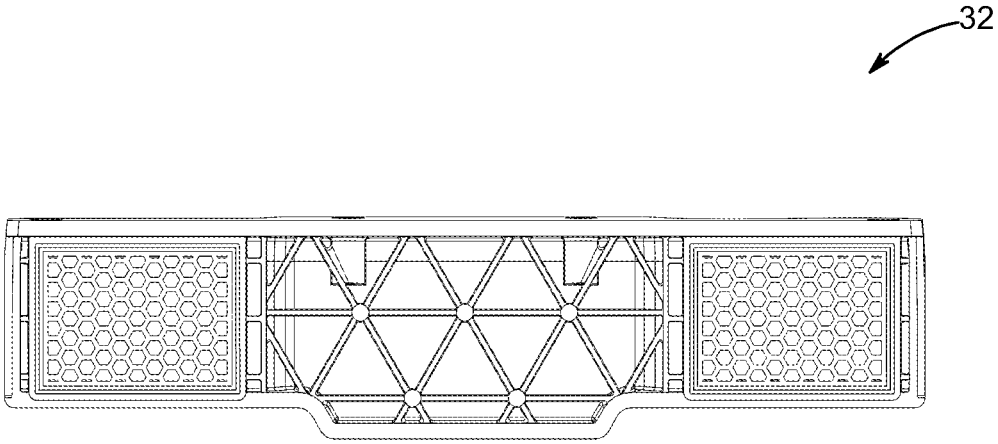
FIG. 65 is a bottom elevation view of the top member.
Figure 66:
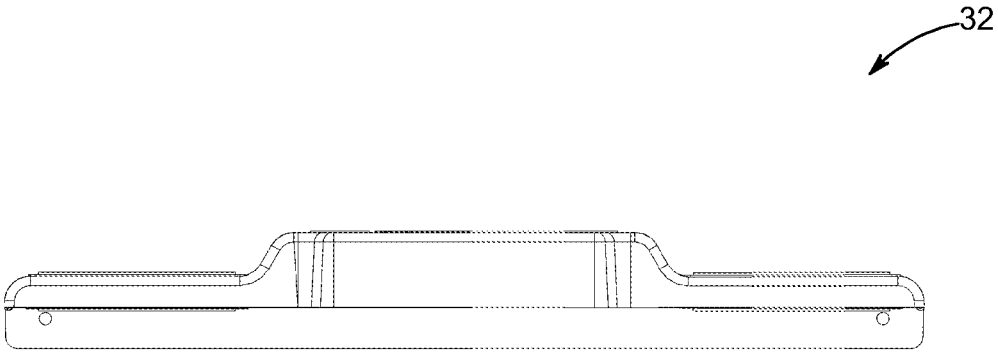
FIG. 66 is a rear elevation view of the top member.
Figure 67:
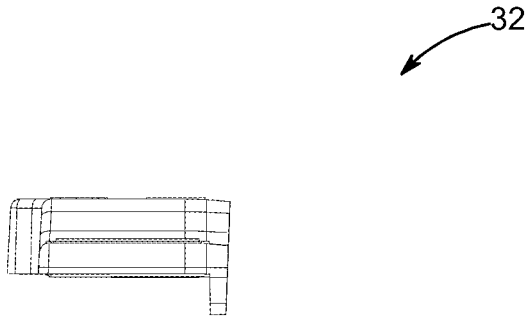
FIG. 67 is a side elevation view of the top member.
Figure 68:
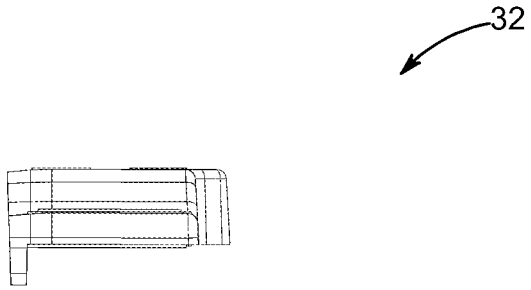
FIG. 68 is a side elevation view of the top member from the opposing side.
Figure 69:
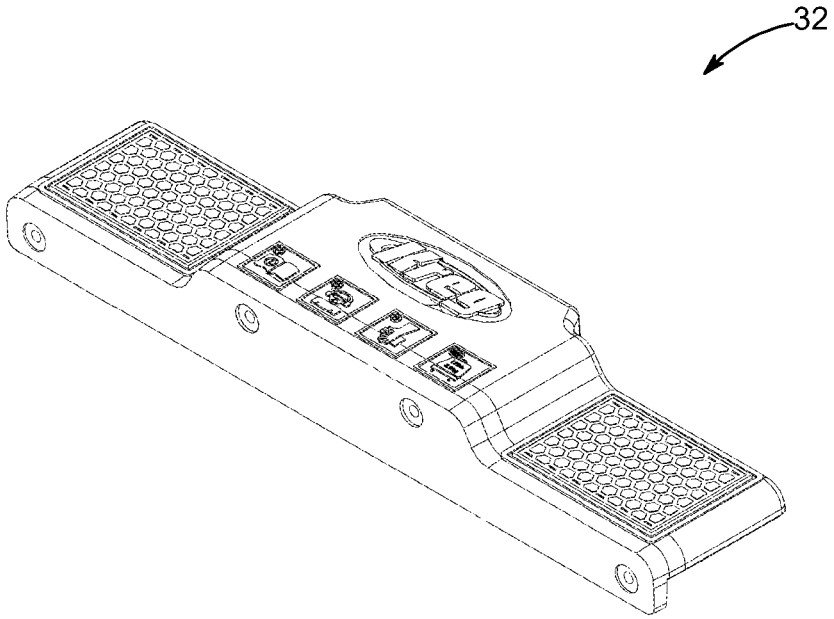
FIG. 69 is a top, side perspective view of the top member, the view showing the grip pads for use with a clamp.
Figure 70:
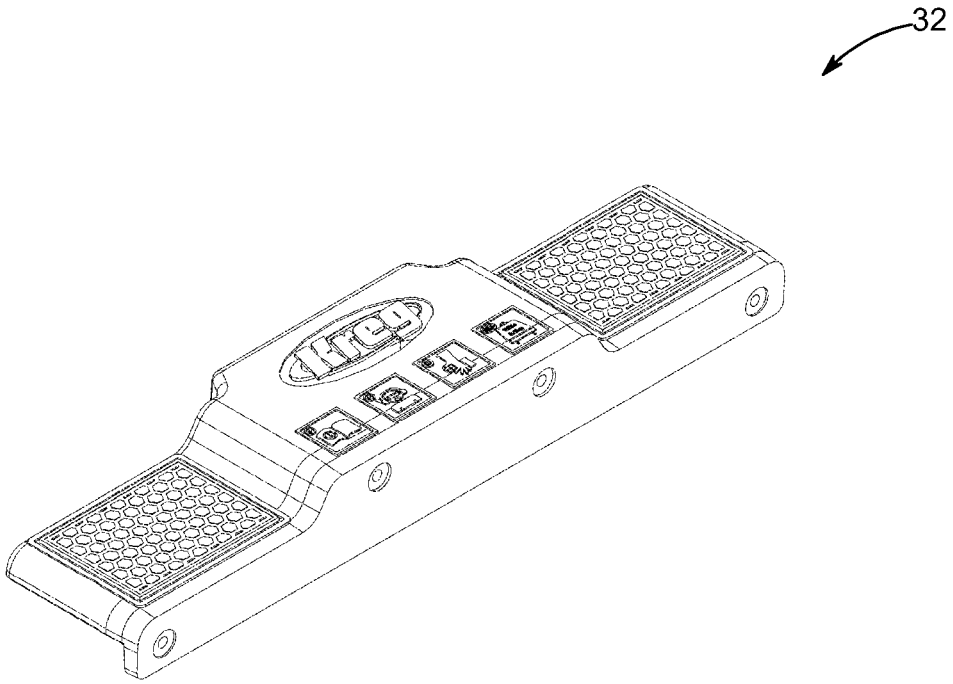
FIG. 70 is a top, side perspective view of the top member shown in FIG. 69; the view showing the perspective from the opposing side.
Figure 71:
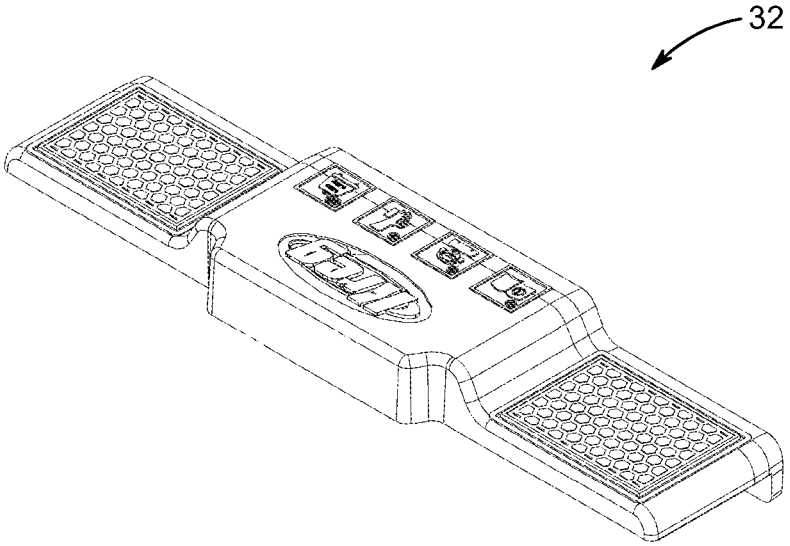
FIG. 71 is a rear, side perspective view of the top member.
Figure 72:
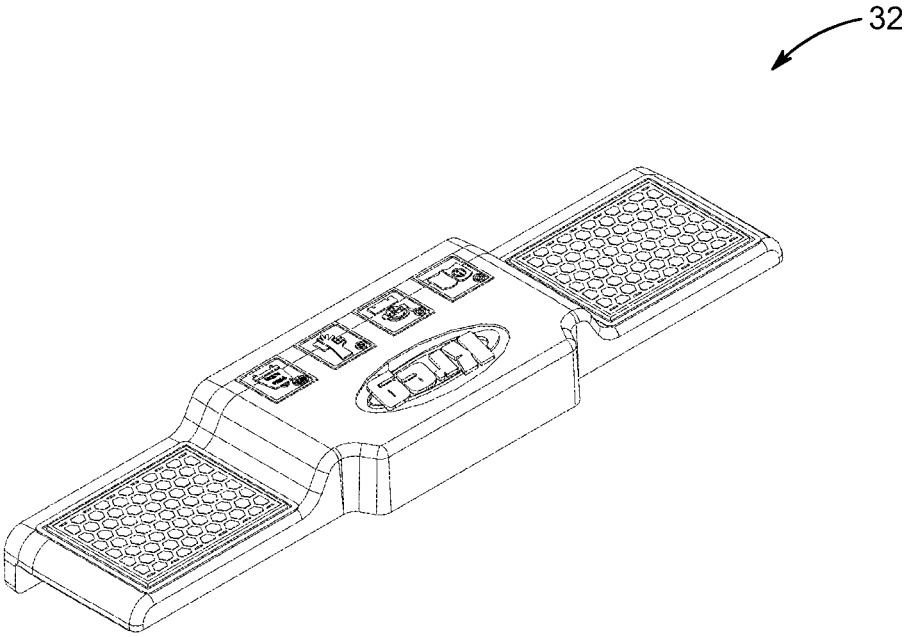
FIG. 72 is a rear, side perspective view of the top member shown in FIG. 71; the view showing the perspective from the opposing side.
Figure 73:
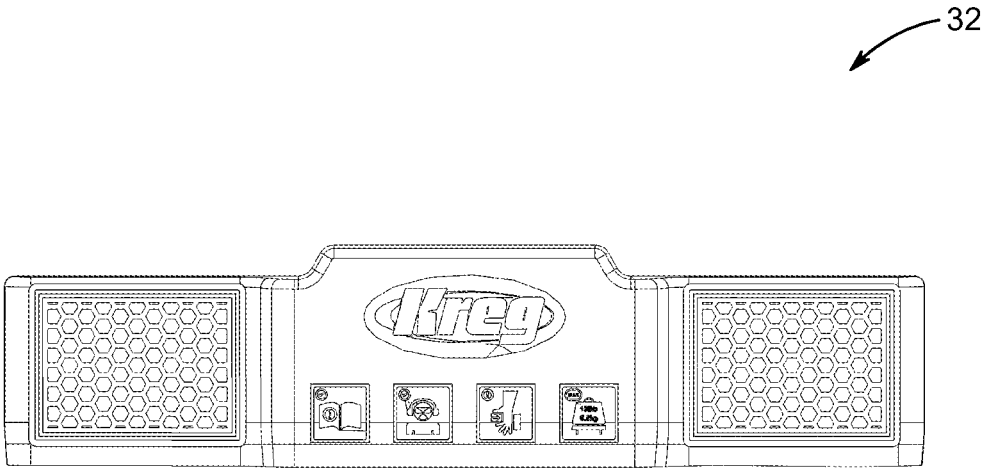
FIG. 73 is a top elevation view of the top member.
Figure 74:
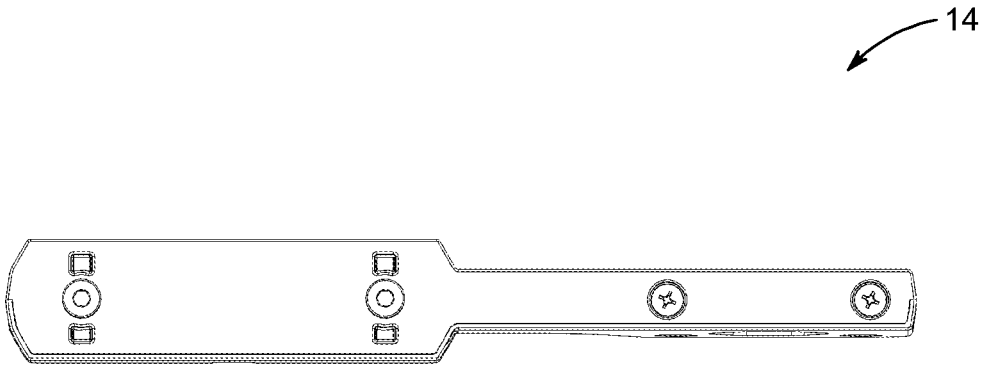
FIG. 74 is a rear elevation view of the support arm.
Figure 75:
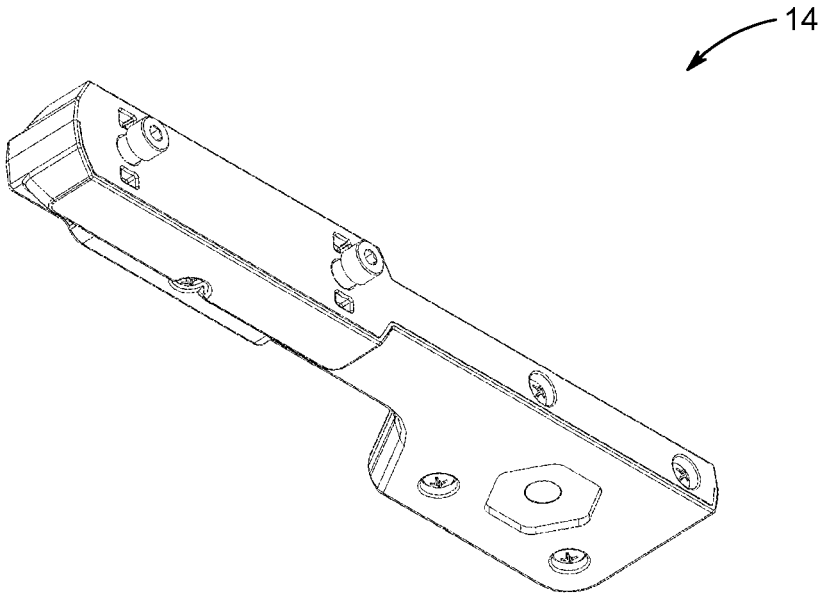
FIG. 75 is a bottom perspective view of the support arm.
Figure 76:
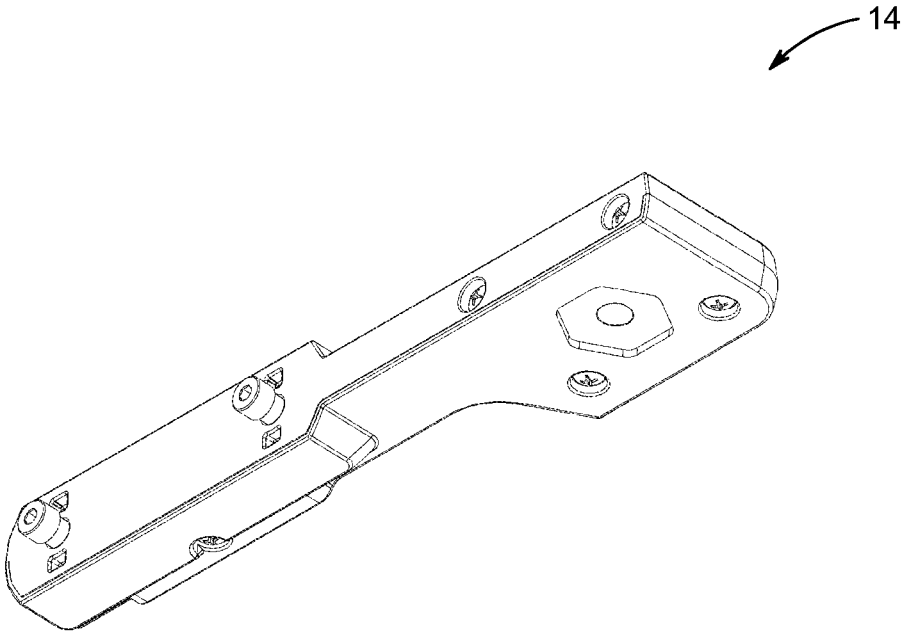
FIG. 76 is an alternate, bottom perspective view of the support arm; the view showing the perspective from the opposing side.
Figure 77:
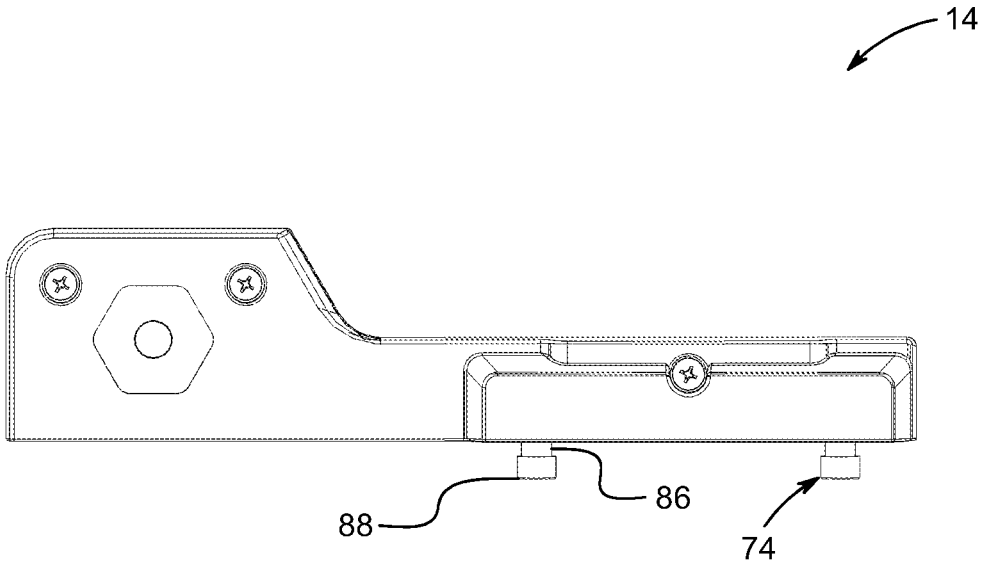
FIG. 77 is a bottom elevation view of the support arm.
Figure 78:
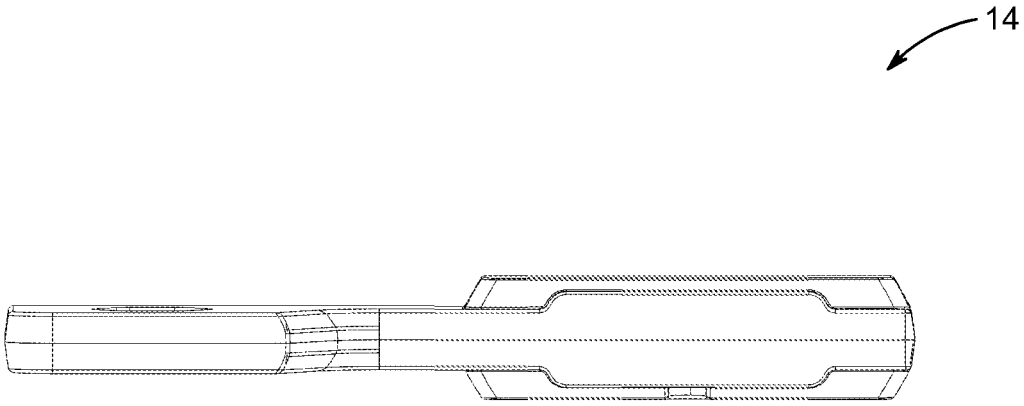
FIG. 78 is a front elevation view of the support arm.
Figure 79:
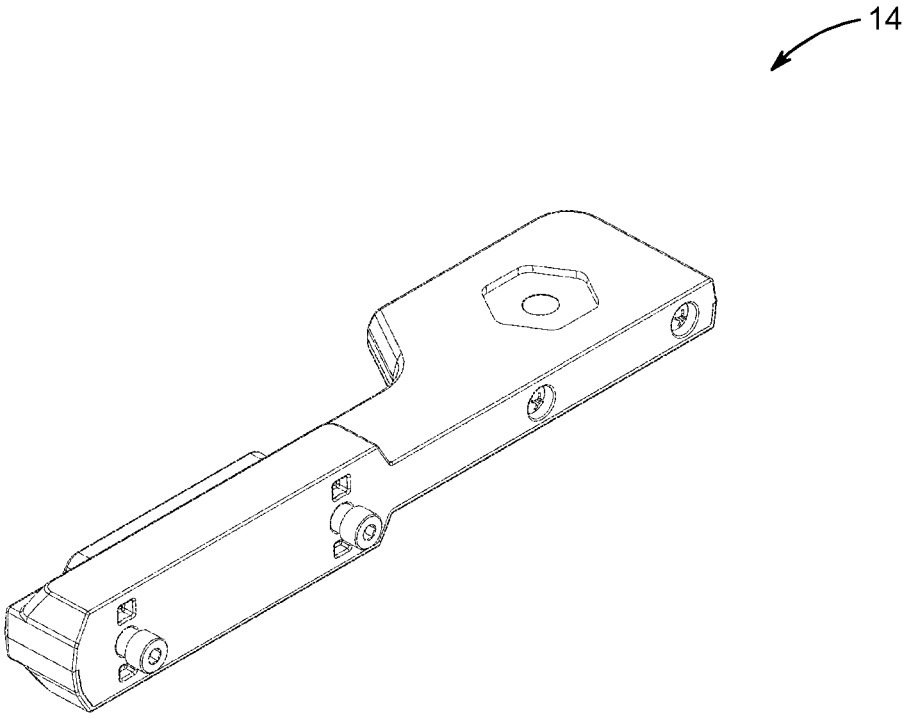
FIG. 79 is a top perspective view of the support arm; the view showing the locking features and platform of the support arm.
Figure 80:
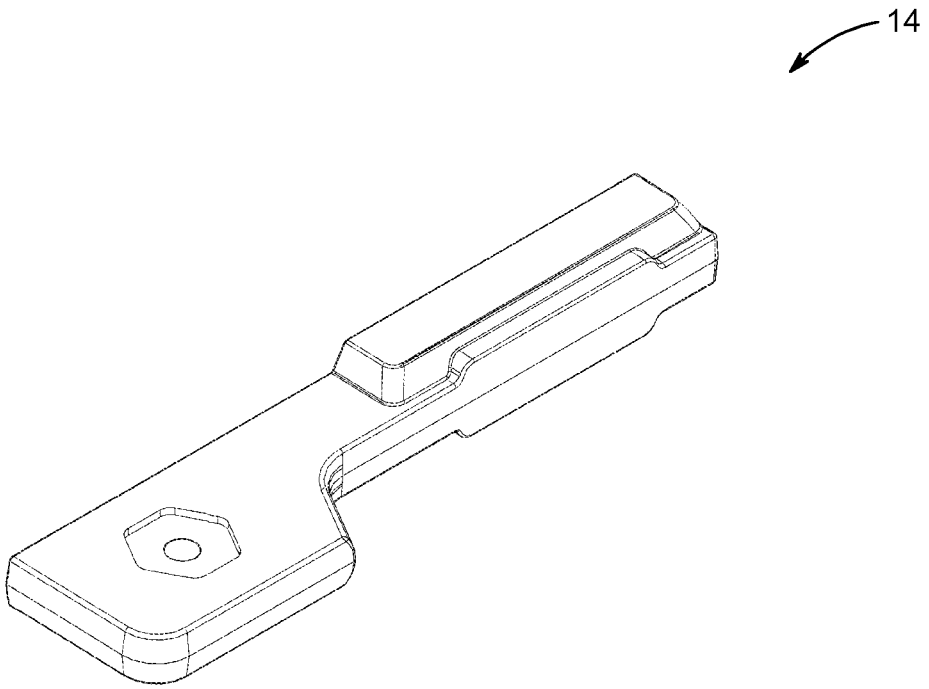
FIG. 80 is a top perspective view of the support arm; the view showing the platform of the support arm.
Figure 81:
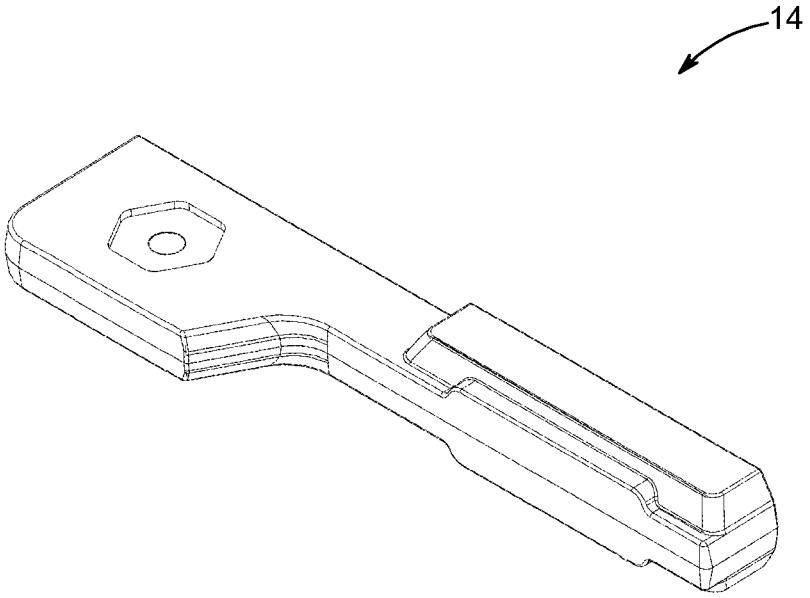
FIG. 81 is a top perspective view of the support arm; the view showing the platform of the support arm.
Figure 82:
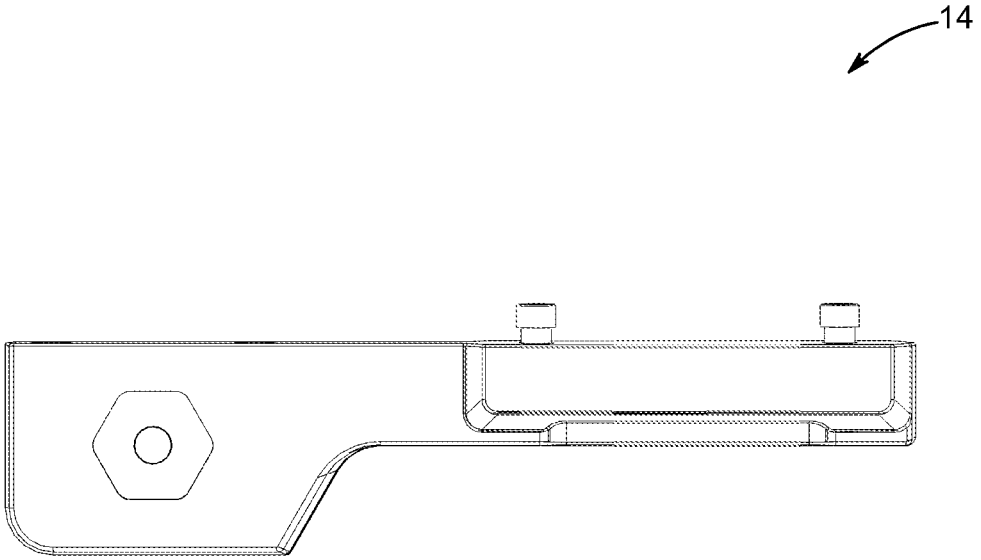
FIG. 82 is a top elevation view of the support arm.
Figure 83:
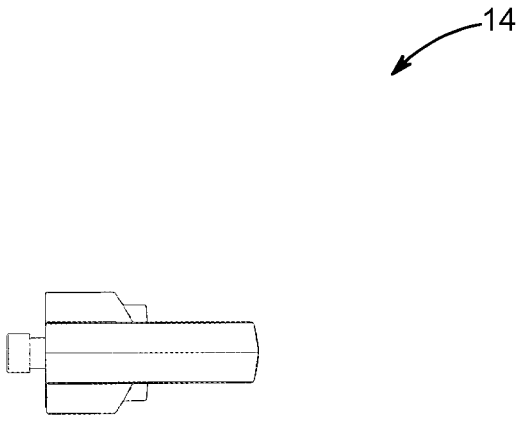
FIG. 83 is a side elevation view of the support arm.
Figure 84:
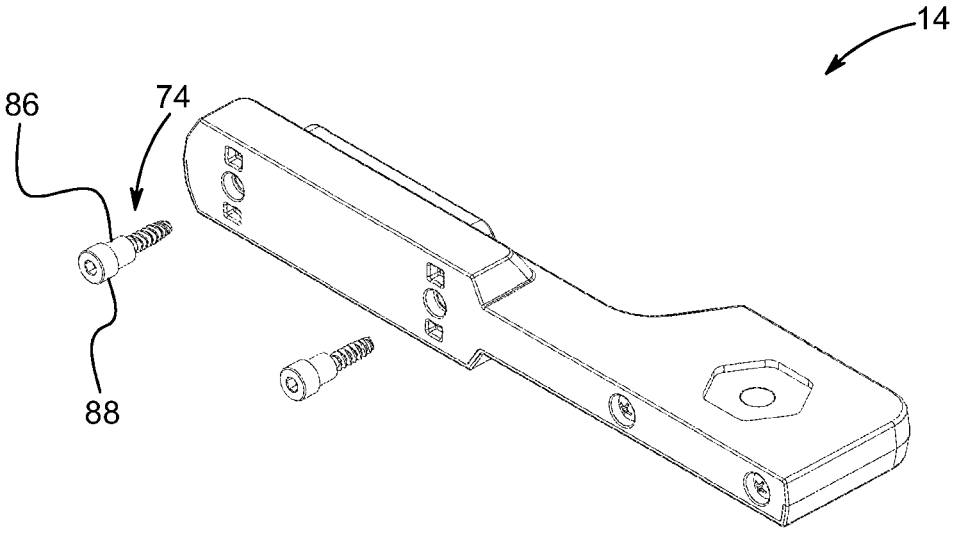
FIG. 84 is an exploded view of the support arm; the view showing the lock features of the support arm having a shaft and a head.
Figure 85:
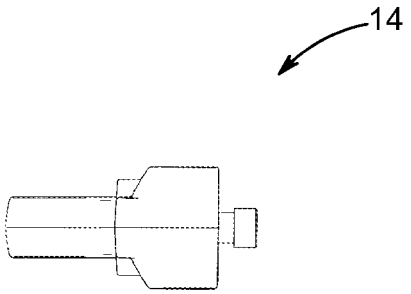
FIG. 85 is a side elevation view of the support arm shown in FIG. 83; the view showing the elevation from the opposing side.
Figure 86:
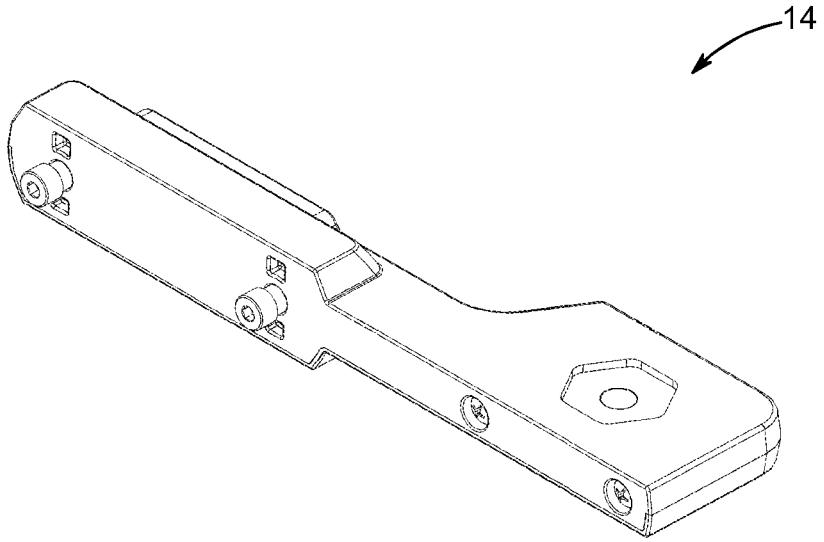
FIG. 86 is a top perspective view of the support arm; the view showing the lock features installed in the support arm.

In one or more embodiments, a support system for hanging of a cabinet door is provided. The support system includes a main body having a top member and a front member and a support arm. The top member has a top surface and a bottom surface. The top member extends between a forward end and a rearward end and between opposing sides. The front member having a front surface and a back surface. The front member extends between an upper end and a lower end and between opposing sides. The upper end of the front member is operably connected to the forward end of the top member. The front member has a plurality of lock features located at a plurality of positions between the upper end and the lower end on the front surface. The support arm has an elongated shape extending between a connection end and a support end. The support arm has one or more lock features configured to engage and lock with lock features of the front member. The support end of the support arm having a platform configured to support a cabinet door during installation onto a cabinet. The support arm is movable between the plurality of positions to facilitate adjustment of a height at which the cabinet door is supported.

In one or more arrangements, the support arm is configured to be reversible between a first configuration where the platform is on a left side of the support system and a second configuration where the platform is on a right side of the support system.

In one or more arrangements, the support system includes shims configured to engage and attach to the platform of support arm. In one or more arrangements, the one or more shims include a magnetically attracted material. The magnetically attracted material is configured to maintain connection of the one or more shims to the platform of support arm by a magnetic force.

In one or more arrangements, the support system includes grip pads on one or more surfaces of the main body and/or support arm grip between the system and a face frame of a cabinet and/or between the system and the cabinet door supported by the support end of the support arm.

DETAILED DESCRIPTION OF THE DISCLOSURE

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof, unless expressly indicated otherwise. For example, if an embodiment of a system is described as comprising an article, it is understood the system is not limited to a single instance of the article unless expressly indicated otherwise, even if elsewhere another embodiment of the system is described as comprising a plurality of articles.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of supports for installation of cabinet doors. However, the embodiments are not so limited. It is appreciated that the embodiments may be adapted for use for supporting of various other objects in various other applications. The support system is merely shown and described as being used in the context of supports for installation of cabinet doors for ease of description and as one of countless examples.

System 10:

With reference to the figures, a support system 10 (or simply system 10) is presented. The support system 10 is formed of any suitable size, shape and design and is configured to provide a height adjustable support platform to facilitate installation of cabinet doors. In the arrangement shown, as one example, support system 10 includes the following component pieces: a main body 12, a support arm 14, grip pads 16, and shims 18 among other components, features, elements and aspects.

In this example arrangement, main body 12 and support arm 14 are configured to connect with one another and support a cabinet door 22, workpiece, or other object from a face frame 24 of a cabinet 20 to facilitate attachment of the door 22 to a stile 26 of face frame 24. In this example arrangement, main body 12 and support arm 14 are configured to engage and suspend from a rail 28 of face frame 24 and support cabinet door 22 at a desired height relative to face frame 24. Because height is set relative to face frame, once system 10 is set for installation of doors 22 at a particular height, system 10 can be moved and used for installation of other doors at the same height without measuring height and adjusting system 10. This allows for installation of multiple doors 22 in rapid succession.

For ease of illustration and explanation, the arrangements are primarily discussed and illustrated with reference to installation of doors 22 on cabinets 20 having a face frame 24. However, the embodiments are not so limited. Rather, it is contemplated that system 10 may additionally or alternatively be used for installation of doors 22 on cabinets 20 having a face frame, box frame, other type or frame, or even cabinets 20 having no frame.

Main Body 12:

In the arrangement shown, as one example, system 10 includes a main body 12. Main body 12 is formed of any suitable size, shape and design and is configured to provide a main body 12 to connect with and support the support arm 14 from face frame 24 of cabinet 20. In the arrangement shown, as one example, main body 12 includes a top member 32 and a front member 34, among other components. In this example arrangement, top member 32 and front member 34 are operably connected together in an L-shape when viewed from the side. In this example arrangement, the top member 32 and front member 34 facilitate engagement with the upper surface and front surface of face frame 24, respectively, to provide support for support arm 14.

Top Member 32:

In the arrangement shown, as one example, system 10 includes a top member 32. Top member 32 is formed of any suitable size, shape and design and is configured to engage an upward facing surface of the lower rail 28 of face frame 24 of cabinet 20 and facilitate support of system 10 and door 22 thereon. In the arrangement shown, as one example, top member 32 has a top surface 38 and a bottom surface 40 and extends between a forward end 42 and a rearward end 44 and between opposing sides 46. In this example arrangement, bottom surface 40 of top member 32 is configured to engage a top surface of a rail 28 of face frame 24 to facilitate supporting of system 10 and door 22 thereon.

In the arrangement shown, as one example, top surface 38 includes platform areas 48 positioned proximate to opposing sides 46. In this example arrangement, the platform areas 48 provide a flat and secure surface to facilitate secure connection of system 10 to face frame 24 of cabinet 20 (e.g., with a clamp 52). In this example arrangement, thickness of the top member 32 is reduced in the platform areas 48 to facilitate clamping with smaller clamps 52.

In the arrangement shown, as one example, platform areas 48 are generally flat and generally square or rectangular in shape when viewed from above with one platform area 48 positioned adjacent each opposing side 46. In the arrangement shown, as one example, a thicker centrally positioned portion of top member 32 separates platform areas 48 adjacent each end of platform area 48.

In the arrangement shown, as one example, the bottom surface 40 of top member 32 forms a generally flat and straight surface that is configured to engage a top surface of a lower rail 28 of face frame 24 to facilitate supporting of system 10 and door 22 thereon. In the arrangement shown, the generally flat and straight bottom surface 40 of top member 32 extends in approximate parallel spaced alignment to the generally flat and straight upper surfaces formed by platform areas 48. In this way, a clamp that engages platform areas 48 can clamp system 10 to face frame 24 in a generally flat and square and perpendicular manner thereby providing a strong, durable and rigid connection between top member 32 and face frame 24.

In the arrangement shown, as one example, top member 32 has a front flange 50 extending downward from forward end 42 to facilitate a secure connection with front member 34.

Any other configuration is hereby contemplated for use as top member 32.

Front Member 34:

In the arrangement shown, as one example, system 10 includes a front member 34. Front member 34 is formed of any suitable size, shape and design and is configured to connect with top member 32 to form main body 12 of support system 10 and to engage a front surface of a lower rail 28 of face frame 24 of cabinet 20 and to facilitate support and stability of system 10. In the arrangement shown, as one example, front member 34 has a front surface 54 and a back surface 56 and extends between an upper end 58 and a lower end 60 and between opposing sides 62.

In the arrangement shown, as one example, upper end 58 of front member 34 is attached to front flange 50 of top member 32 by a set of fasteners 66. Fasteners 66 may be formed of any suitable size, shape and design and are configured to facilitate attachment of two components. For example, fasteners 66 may include but not be limited to pins, clamps, bolts, screws, rivets, welds, adhesives, chemical bonding, and/or any other process or means that results in a permanent or semi-permanent connection. In the arrangement shown, as one example, fasteners are screws that extend through holes in front member 34 and into holes 67 in top member 32. In the arrangement shown, as one example, these fasteners 66 extend through holes 67 positioned in the upper forward end of top member 32.

In the arrangement shown, as one example front member 34 includes a center section 68 and side sections 70 extending outward from the sides of the center section 70 to opposing sides 62 of front member 34. In this example arrangement, front surface 54 of front member 34 includes platform areas 76 positioned in side sections 70 and in center section 68 between sets of lock features 72. In this example arrangement, the platform areas 76 provide a flat and secure surface to facilitate secure connection of system 10 to face frame 24 of cabinet 20 (e.g., with a clamp 52). In this example arrangement platform areas 76 are generally flat recesses in front surface 54 that extend in approximate parallel spaced alignment to the generally flat and straight back surface 56.

In the arrangement shown, as one example, the back surface 56 of front member 34 forms a generally flat and straight surface that is configured to engage a front surface of lower rail 28 of face frame 24 to facilitate supporting of system 10 and door 22 thereon. In the arrangement shown, as one example, the generally flat and straight back surface 56 of front member 34 extends in approximate parallel spaced alignment to the generally flat and straight front surfaces formed by platform areas 76.

In this example arrangement, a center section 68 extends a full height of front member 34 from upper end 58 to lower end 60. In this example arrangement, side sections 70 extend a height that is shorter than the center section. The taller height of the center section 68 permits lock features 72 to be positioned at a larger number of vertical positions in the center section to facilitate connection of support arm 14 at different heights. This increased height allows for a greater number of vertical positions that door 22 can be positioned at during installation.

Any other configuration is hereby contemplated for use as front member 34.

Lock Features 72 and 74:

In the arrangement shown, front member 34 includes a number of or plurality of lock features 72 that are configured to facilitate connection with lock features 74 of support arm 14. Lock features 72 of front member 34 and lock features 74 of support arm 14 are formed of any suitable size, shape and design and are configured to facilitate connection and locking with one another to connect support arm 14 to main body 12 in a removable and replaceable manner.

In this example arrangement, lock features 74 of support arm 14 are anchor screws having a narrower shaft 86 and a wider head 88. In this example arrangement, the lock features 72 of front member 34 are keyhole shaped receivers having a round opening 78 connected to a smaller slot 80. The round opening 78 is configured to allow passage of the head 88 of lock feature 74 therethrough, thereby allowing the insertion of the head 88 of lock features 74. Slot 80 is configured to receive the shaft 86 of lock feature 74 while retaining the head 88 of lock features 74, thereby preventing the lock features 74 from pulling out of lock feature 72 when force is applied. In the arrangement shown, the round opening 78 is positioned to one side of the slot 80, however any other arrangement is hereby contemplated for use such as above, below, or any other angle.

In the arrangement shown, lock features 72 include a waist 82 positioned between round opening 78 and slot 80. Waist 82 is narrower than slot 80 and is configured to allow the passage of shaft 86, but as the shaft 86 moves through waist 82 the waist 82 applies frictional force to the shaft 86 thereby holding it in place and requiring force to move the shaft 86 into or out of slot 80. In this way, the friction imparted between shaft 86 and waist 82 helps to maintain connection between lock features 72 and lock features 74.

In one or more arrangements, lock features 72 are positioned at a number of different heights between upper end 58 and lower end 60 of front member 34 to facilitate repositioning of support arm 14 at a desired height relative to face frame 24 of cabinet 20. In the arrangement shown, lock features 72 are positioned at nine different heights uniformly spaced by ¼ inch increments. However, embodiments are not so limited. Rather, it is contemplated that front member 34 may include any number of lock features 72 at any number of different positions, which may be separated by any uniform or non-uniform distance.

In the arrangement shown, as one example, front member 34 includes two columns of lock features 72 that extend vertically between the upper end 58 and lower end 60 of the center section 68 of front member 34. In the arrangement shown, as one example, to provide enough room for fine vertical adjustment each set of lock features 72 are slightly offset laterally (to the left or right) of the immediately above or immediately below set of lock features 72. This lateral offsetting allows for finer adjustments or a narrower vertical distance between vertically adjacent sets of lock features 72. This lateral offsetting is not disadvantageous as the lateral position in this application is not critical when supporting the door 22 during installation on cabinet 20. Instead, the vertical position is the critical position.

Any other configuration is hereby contemplated for use as lock features 72.

Support Arm 14:

In the arrangement shown, system 10 includes a support arm 14. Support arm 14 is formed of any suitable size, shape and design and is configured to connect with main body 12 and facilitate supporting of cabinet door 22, workpiece and/or any other object during installation. In the arrangement shown, as one example, support arm 14 has a generally elongated shape having a back side 96, front side 98, top side 100 and bottom side 102 and extending from a connection end 92 to a support end 94. In this example arrangement, a pair of lock features 74 are positioned on a back side 96 of support arm 14 near the connection end 92 to facilitate connection of connection end 92 with lock features 72 of front member 34 of main body 12. Any other number of lock features 74 are hereby contemplated for use. These lock features 74 correspond in size, shape and number to the lock features 72 of front member 34.

In this example arrangement, support arm 14 has a support platform 106 positioned at the support end 94. Support platform 106 is formed of any suitable size, shape, and design and is configured to provide a support surface for supporting cabinet door 22, workpiece and/or other object thereon during installation. In the arrangement shown, as one example, support platform 106 provides a support surface on the top side 100 as well as on the bottom side 102 to facilitate positioning of support platform 106 on either to the left or to the right of main body 12. For example, support arm 14 may be connected to main body 12 with support platform 106 positioned on the left to support cabinet door 22 on top side 100 of support platform 106, for example, to facilitate installation of door 22 with hinges on the left. Conversely, support arm 14 may be flipped and connected to main body 12 with support platform 106 positioned on the right to support cabinet door 22 on the bottom side 102 of support platform 106, which is now facing upward, for example, to facilitate installation of door 22 with hinges on the right. In this way, in one arrangement, support arm 14 is generally symmetric along a center line that extends from back side 96 to front side 98 equally positioned between top side 100 and bottom side 102 so as to allow support arm 14 to be flipped over and used on either side.

In the arrangement shown, support platform 106 includes connection features 108. Connection features 108 are formed of any suitable size, shape, and design and are configured to facilitate connection of shims 18 to support platform 106 of support arm 14. In the arrangement shown, as one example, connection features 108 are generally hexagonal shaped recesses in the both the upper side and lower side of support platform 106. These hexagonal shaped recesses in the upper side and lower side of support platform 106 are configured to mate and connect with hexagonal shaped protrusions forming connection features 130 of shims 18. In the arrangement shown, as one example, connection features 108 are generally centrally positioned within support platform 106 of support arm 14 and include a magnet and/or magnetically attracted material 136 therein to help hold shims 18 to support platform 106. However, any other form of a connection is hereby contemplated for use such as a friction fit, snap fit, threaded engagement, locking engagement or any other method or means of connecting two components together and holding two components together when desired while also allowing for selective separation of the two components when desired.

Shims 18:

In one or more arrangements, system 10 includes shims 18. Shims 18 are formed of any suitable size, shape, and design and are configured to connect with support platform 106 to raise the height at which cabinet door 22, workpiece, or other object is supported by system 10 during installation. In the arrangement shown, as one example, shims 18 have a generally rectangular planar shape having a top surface 112, a bottom surface 114 and extending between a front 116 and rear 118 and between opposing sides 120. In this example arrangement, shims 18 include a tab 122 protruding from one side 120 to facilitate easy handling by user. This tab 122 also includes indicia thereon that indicates the thickness of the shim 18.

In the arrangement shown, as one example, shims 18 include a thinner shim (A) 126 having 1/16 inch thickness and a thicker shim (B) 128 having ⅛ inch thickness. In this example arrangement, shims 18 may be used to raise the height of support platform 106 a variety of heights.

As one example, system 10 and shims 18 may be used to raise the position of door 22 by 1/16 inch by connecting shim A 126 to support platform 106.

As another example, system 10 and shims 18 may be used to raise the position of door 22 by ⅛ inch by connecting shim B 128 to support platform 106.

As yet another example, system 10 and shims 18 may be used to raise the position of door 22 by 3/16 inch by connecting shim B 128 to support platform 106 and connecting shim A 126 on top of shim B 128.

When used in conjunction with height adjustment provided by lock features 72, which are positioned in ¼ inch increments, door 22, workpiece or other object may be adjusted upward or downward in increments of 1/16 inch throughout the height range of lock features 72 of front member 34.

In this example arrangement, shims 18 have connection features 130 on the bottom surface 114. Connection features 130 are formed of any suitable size, shape, and design and are configured to connect with connection features 108 of support platform 106 to facilitate connection of shims 18 to support platform 106 for height adjustment. In the arrangement shown, as one example, connection features 130 are generally hexagonal shaped protrusions configured to mate and connect with hexagonal shaped recesses forming connection features 108 of support platform 106. Any other size, shape or configuration for connection features 130 (and connection features 108) are hereby contemplated for use, such as triangular, square, rectangular, octagonal, oblong, curved, straight, circular, or any other shape and any number of connection features 130 (and connection features 108) are hereby contemplated for use such as one, two, three, four or more.

In this example arrangement, thicker shim B 128 also has a connection feature 130 on the top surface 112. In this arrangement, connection feature 130 on the top surface 112 of thicker shim B 128 is formed of a recess whereas the connection feature 130 on the bottom surface 114 of thicker shim B 128 is a protrusion. Connection features 130 on the bottom surface 114 of thinner shim A 126 is configured to alternatively connect with connection feature 130 on the top surface 112 of shim B 128 in the same or similar manner as it would connect with connection features 108 of support platform 106. In this manner thinner shim A 126 may be placed directly on support platform 106 or may be stacked on top of thicker shim B 128. In this way, a greater range of height adjustability is facilitated.

Notably, the height adjustability provided by system 10 is achieved without measurement. That is, the user simply selects which set of lock features 72 of front member 34 to insert the lock features 74 of support arm 14 into and then the user determines whether one or both shims 18 are to be installed on support platform 106 of support arm 14. In this way, any height in the range of heights is easily selected in a fast, easy, repeatable, accurate manner by simply insertion of support arm 14 and insertion of shims 18.

In various arrangements, connection features 130 and 108 may include one or more lock features 132. Lock features 132 are formed of any suitable size, shape, and design and are configured to maintain connection between the connection features 130 and 108 once connected. In the arrangement shown, lock features 132 of connection features 130 and 108 include magnetically attracted materials 136 configured to magnetically attract connection features 130 and 108 toward one another thereby holding one or both shims 18 into and against support platform 106 of support arm 14.

This may be accomplished by support platform 106 of support arm 14 having a magnetically attracted material 136 that is a magnet and shim 18 having a magnetically attracted material 136 that is also a magnet. In this arrangement, care is taken to ensure the poles of the magnets are properly aligned such that when shim 18 is placed on support platform 106 of support arm 14 the magnet of shim 18 is attracted (and not repelled) to the magnet of support platform 106 of support arm 14.

Alternatively, this may be accomplished by one of support platform 106 of support arm 14 or shim 18 having a magnetically attracted material 136 that is a magnetic member such as a piece of ferrous material that is attracted to a magnet, and the other of support platform 106 of support arm 14 or shim 18 having a magnetically attracted material 136 that is a magnet. In this arrangement, when shim 18 is placed on support platform 106 of support arm 14 the magnet of one of the shims 18 or support platform 106 of support arm 14 is attracted to the magnetic member and/or ferrous material of the other of the shim 18 or support platform 106 of support arm 14.

This magnetic attraction between the magnetically attracted material 136 of support platform 106 of support arm 14 the magnetically attracted material 136 of shim 18 serves several purposes. This magnetic attraction helps to hold shims 18 to support platform 106 of support arm 14. This magnetic attraction helps to securely seat shims 18 to support platform 106 of support arm 14, thereby making this connection accurate and repeatable. This magnetic attraction also eases connection thereby making the installation of shims 18 on support platform 106 of support arm 14 faster and easier for the user.

In this example arrangement, magnetically attracted materials 136 (e.g. magnets or ferrous materials) are held and/or housed within recesses 138 of connection features 130 and 108. In this example arrangement, covers 140 fit over and hold magnetically attracted materials 136 within recesses 138. In the arrangement shown, as one example, covers 140 have snap features 142 configured to and/or snap onto corresponding snap features 144 of connection features 130 and 108 recesses. In addition to or in lieu of magnetic materials, lock features 132 of connection features 130 and 108 include frictional fittings, snaps, threads, or any other method or means for connecting.

Materials and Construction

Main body 12, support arm 14 and/or various other components of system 10 are formed of any materials having suitable durability and strength to support the doors 22, workpieces, or other objects intended to be supported. Such materials may include but are not limited to for example, metallic materials, rigid plastic, composite materials, other non-metallic materials or a combination thereof. In one or more arrangements, as one example, main body 12 and support arm 14 are formed of a plastic material or composite material in a molding process or the like to provide strength, rigidity, permanence. and accuracy. In one example arrangement, top member 32 and front member 34 are separate components that are joined together to form main body 12 using fasteners 66. However, embodiments are not so limited. Rather, it is contemplated that main body 12 and/or support arm 14, and/or various other components of system 10 may be formed by any number of components. For example, in one or more arrangements, main body 12 may be formed as a single unitary component. That is, instead of top member 32 and front member 34 being joined together using fasteners 66, top member 32 and front member 34 may be formed of a single monolithic member thereby avoiding a secondary assembly step.

In the arrangement shown, as one example, top member 32 is formed of a hollow core construction having hollow cells 150 formed by interconnecting support structures 152 that extend between exterior walls 154 of the top member 32. Such construction helps to reduce weight and material cost while retaining relatively high compression and sheer properties. In this example arrangement, support structures 152 are arranged to form hollow triangular shaped cells 150. However, embodiments are not so limited. Rather, it is contemplated that top member 32 and various other components of system 10 may be formed with cells 150 of any shape (e.g., round, square, triangular, rectangular, hexagonal, honeycomb or the like) or may be formed of solid core construction without any cells 150.

Grip Pads 16:

In one or more arrangements, the main body 12 and support arm 14 of system 10 is formed of a hard or rigid material (e.g., plastic, metal, and/or composite). This combination of using a hard or rigid plastic, metal, or composite material provides a strong, durable and long lasting tool that can handle daily use and abuse without significant wear or damage. One drawback, however, of using a hard or rigid plastic, metal, or composite material for the main body 12 and support arm 14 is that these materials tend to have a low coefficient of friction. Or, said another way, when the main body 12 is placed on a face frame 24 of a cabinet 20, there is a low amount of friction between the main body 12 and the face frame 24. This means that the main body 12 may easily slide on face frame 24. Similarly, there may be low frictional engagement between support platform 106 of support arm 14 and cabinet door 22, workpiece, or other object placed thereon. It is undesirable to have the main body 12 easily move on face frame 24 during use. Similarly, it is undesirable to have door 22, workpiece, or other object easily move on support platform 106 during use. Such movement can cause an inaccurate installation or injury to a user.

In one or more arrangement, system 10 includes one or more grip pads 16 formed of a material that is more flexible and/or more compressible than the plastic, metal, or composite material that forms the main body 12, support arm 14 and/or other component on which grip pads 16 are positioned. Grip pads 16 are formed of any suitable size shape or design and of any material that that has a higher coefficient of friction than the material of the surface in which grip pads 16 are positioned upon (e.g., the main body 12 or support arm 14) to facilitate improved grip of system 10 with surfaces of other objects during use. In various arrangements, grip pads 16 may be formed of various materials including but not limited to, for example, a rubber material, a natural rubber material, a synthetic rubber material, a silicone material, an isoprene rubber material, ethylene propylene diene (EPDM) material, a nitrile rubber (NBR) material, a styrene butadiene rubber (SBR) material, a silicone rubber material, a butyl rubber material, a isobutylene isoprene rubber material, a polybutadiene rubber material, a foam rubber material, any compressible or high coefficient of friction plastic material, or any other material that is more-compressible than and/or has a higher coefficient of friction than the rigid materials used to form other components of the support system 10 that the grip pads 16 are attached to.

The enhanced grip of the grip pads 16 helps system 10 to better stay in place during use. The enhanced grip of the grip pads 16 helps to reduce the clamping pressure required to hold system 10 in place. The enhanced grip of the grip pads 16 helps to prevent marking of face frame 24 and/or door 22 when in use. The enhanced grip of the grip pads 16 helps to prevent door 22 from sliding upon support platform 106 when in use. It is hereby contemplated that system 10 may include grip pads 16 on any place or portion of system 10 that comes into contact with or could come into contact other objects during use as is further described herein.

Grip Pads for Improved Grip with Face Frame:

In one or more arrangements, system 10 includes grip pads 16 on bottom surface 40 of top member 32 and on back surface 56 of front member 34 to increase frictional engagement and grip with the upper surface and/or front surface of face frame 24 of cabinet 20 during use. In the arrangement shown, as one example, system 10 includes two grip pads 16 on bottom surface 40 of top member 32, one adjacent each side of, and three grip pads 16 on back surface 56 of front member 34, one adjacent each side and one generally centrally positioned.

In this example arrangement, the grip pads 16 on bottom surface 40 and back surface 56 are generally rectangular in shape and cover only a portion of the bottom surface 40 and back surface 56. However, embodiments are not so limited. Rather, it is contemplated that bottom surface 40 and back surface 56 may include any number of grip pads 16, which may have any size shape or design, and which may cover any amount of bottom surface 40 and back surface 56.

Grip Pads for Improved Grip with Clamps:

In one or more arrangements, system 10 includes grip pads 16 on top surface 38 of top member 32 to provide a clamping surface having increased frictional engagement. In the arrangement shown, as one example, system 10 includes a two grip pads 16 in and/or on platform areas 48 on top surface 38 of top member 32. In this example arrangement, the two grip pads 16 on top surface 38 of top member 32 are generally rectangular in shape and cover a portion of the top surface 38. However, embodiments are not so limited. Rather, it is contemplated that top surface 38 may include any number of grip pads 16, which may have any size shape or design, and which may cover any amount of top surface 38. Grip pads 16 of top member 32 may be used, for example, to facilitate clamping of the top member 32 to face frame 24.

Additionally or alternatively, in one or more arrangements, system 10 may include one or more grip pads 16 on front surface 54 of front member 34. As one illustrative example, grip pads 16 (not shown) may be positioned on platform areas 76 of front member 34. Grip pads 16 on platform areas 76 on front surface 54 of front member 34 may be used, for example, to facilitate clamping of the front member 34 to face frame 24.

Grip Pads on Support Platform:

In one or more arrangements, system 10 includes grip pads 16 on support platform 106 (not shown) to inhibit slipping of door 22, workpiece, or other objects placed on support platform 106. Additionally or alternatively, in one or more arrangements, shims 18 may include one or more grip pads to inhibit slipping of door 22, workpiece, or other objects placed on the shims. Additionally or alternatively, shims 18 may be formed of a same material as grip pads 16 or any other material having a higher coefficient of friction than material forming support arm 14.

Grip Pad Formation:

In one arrangement, the grip pads 16 are formed of a single piece construction with and as a single unitary component of system 10 on which the grip pads 16 are positioned (e.g., on main body 12, support arm 14, and/or shims 18), such as by molding the two components together such that they are essentially inseparable. This monolithic formation may be made through various manufacturing processes such as dual durometer molding or dual material molding, or any other operation where two different materials are molded together to form a single monolithic and unitary member. Alternatively, the grip pads 16 of system 10 may be formed independently and are then connected to system 10 by any manner, method or means such as by using two-sided tape, adhesive, gluing, cementing, screwing, bolting, welding, using fitting features, using snap fitting features, heat-activating, bonding, or the like, or any combination thereof or by connecting by any other manner, method or means. In another arrangement, a first component is formed (e.g., either the grip pads 16 or the main body 12) through any process such as extrusion, molding, casting, machining, forming or the like and the second component (e.g., the other of the grip pads 16 or the main body 12) is added to the formed first component in a secondary manufacturing process such as molding, extrusion, spray deposition or the like processes identified herein or any other manufacturing process.

In one or more arrangements, one or more grip pads 16 are formed in a portion of a surface of system 10 and are to be flush or approximately flush with an exposed portion of the surface that is not covered by the grip pads 16. Additionally or alternatively, in one or more arrangements, one or more the grip pads 16 may protrude slightly outward from the surface in which they are positioned. In some implementations, the grip pads 16 may compress when pressure is applied such that grip pads 16 become flush with the surface when compressed. Any other arrangement of grip pads 16 is hereby contemplated for use.

Durometer or Shore Durometer is one of several standards of measurement of the hardness of a material. Higher numbers indicate harder materials whereas lower numbers indicate softer materials. Hardness may be defined as a material's resistance to indentation. Durometer is typically used as a measure of hardness in plastics, composites, polymers, elastomers, and rubbers, although it is applicable to most if not all other materials as well. While the durometer of a material does not necessarily or always define or correlate to the coefficient of friction of a material (e.g. how much grip or stick a material has when placed on another material) there is often a high correlation with a material's durometer and its coefficient of friction. That is, it is often the case that higher durometer materials, which are harder, tend to have a low coefficient of friction, meaning they are slicker, whereas in contrast lower durometer materials, which are softer, tend to have a high coefficient of friction, meaning they are sticker or provide more grip when in contact with another material.

In Operation:

The support system 10 provides a versatile support that can be quickly and easily reconfigured by a craftsman, for example, to support a cabinet door 22 at a desired height. More specifically, support system 10 is configured to support cabinet door 22 at a desired height relative to a lower rail 28 of a face frame 24 on to which cabinet door 22 is to be installed.

In the arrangement shown, the height at which a cabinet door 22 is supported is adjustable by connecting support arm 14 to lock features 72 of front member 34 of main body 12 at a desired one of a plurality of vertical positions. At any one of the different vertical positions, support arm 14 may be connected to lock features 72 in a left configuration, with support platform 106 positioned to the left side of support system 10, or in a right configuration, with support platform 106 positioned to the right side of support system 10. The left configuration may be used, for example, to install cabinet door 22 with hinges on the left side. Conversely, the right configuration may be used, for example, to install cabinet door 22 with hinges on the right side. This is accomplished by simply removing support arm 14 from main body 12 and flipping support arm 14 over and reinstalling it upon main body 12. In this way, support arm 14 may be quickly and easily installed on main body 12 at the same height with a left or right configuration. In the event shims 18 are used, the shims 18 are quickly and easily removed from one side of support platform 106 (e.g. the bottom side) and installed on the other side (e.g. now the top side) thereby achieving the same desired height for a left configuration and a right configuration.

In the arrangement shown, support system 10 has lock features 72 at nine different vertical positions on front member 34. In this example arrangement, topmost position 1 is configured to support a cabinet door 22 for inset installation, where cabinet door 22 is set into the cabinet face frame 24 and fits flush with the face of the cabinet 20 when closed. In this example arrangement, position 1 support cabinet door 22 approximately 3/32" above the top surface of bottom rail 28 of the face frame 24 to provide clearance for opening and closing of the cabinet door 22.

In this example arrangement, lock features 72 at positions 2 through 9 are configured to support cabinet door 22 at different heights below the top surface of bottom rail 28 of face frame 24 for overlay installation, where edges of cabinet door 22 overlap the cabinet face. In this example arrangement, positions 2 through 9 are vertically separated by increments of ¼ inch thereby providing options to support cabinet door 22 at ¼, ½, ¾, 1, 1¼, 1½, 1¾, or 2 inches below the bottom rail 28 of the face frame 24.

If a height between the positions of lock features 72 is desired, a workman may connect the support arm 14 to lock features 72 at the next lower position and connect one or more shims 18 to support platform 106 of support arm 14. In the arrangement shown, as one example, system 10 includes a thinner 1/16 inch shim 126 and a thicker ⅛ inch shim 128. Shims 18 may be used individually or in combination to achieve 1/16 inch increments by connecting the 1/16 inch shim 126 to support platform 106 to achieve a 1/16 inch rise; by connecting the ⅛ inch shim 128 to support platform 106 to achieve a ⅛ inch rise; and by connecting the ⅛ shim 128 to support platform 106 and connecting the 1/16 inch shim 126 on top of shim 128 to achieve a 3/16 inch rise. In this manner, cabinet door 22 may be supported at any 1/16 inch increment between 1/16 inch below the bottom rail 28 of the face frame 24 to 2 inches below the bottom rail 28 of the face frame 24. Any other number of increments or spacing between increments of lock features 72 is hereby contemplated for use as is any other number of or thickness of shims 18 to essentially achieve any spacing and/or height.

With support system 10 configured to support the cabinet door 22 at a desired height, the support system 10 is placed on the bottom rail 28 of the face frame 24 and positioned for support platform 106 to support cabinet door 22 proximate to the stile 26 of face frame 24 to which cabinet door 22 will be attached. More specifically, the support system 10 is positioned on the bottom rail 28 of the face frame 24 such that bottom surface 40 of top member 32 of main body 12 is in contact with an upper surface of the bottom rail 28 while simultaneously the back surface 56 of front member 34 of main body 12 is in contact with a front surface of bottom rail 28. In this position, grip pads 16 on back surface 56 of front member 34 and grip pads 16 on bottom surface 40 of top member 32 provide maximum grip with face frame 24 and stability for support of cabinet door 22.

In some instances, a workman may clamp support system 10 to bottom rail 28 of face frame 24 to ensure support system 10 will remain stable during use. As an illustrative example, a workman may place a first end of a clamp 52 onto a platform area 48 on top surface 38 of top member 32 of main body 12 and a second end of clamp 52 onto face frame 24 or other portion of the cabinet 20. The clamp is then tightened to secure the support system 10 to bottom rail 28 of face frame 24. A grip pad 16 on the platform area 48 helps to ensure the first end of clamp 52 remains in place on the platform area 48 while clamping and during use of support system 10. More specifically, top member 32 may be clamped to face frame 24 on either side or even the center of top member 32; front member 34 may be clamped to face frame 24 on either side or even the center; or top member 32 and front member 34 may be clamped to face frame 24. In this way, system 10 provides a great amount of clamping versatility that is usable in almost any application or cabinet 20 that provides for a secure attachment of system 10 to cabinet 20.

Once the support system 10 is configured for the desired height and the support system is placed at the desired position on face frame 24, and the support system 10 is clamped (if desired) in place, cabinet door 22 may be placed on support platform 106 and/or shims 126 and/or 128. In some arrangements, grip pads 16 on support platform 106 and/or shims 126 and/or 128 help to maintain placement of cabinet door 22 and prevent slipping. With the lower end of cabinet door 22 supported by support system 10, a craftsman may use one hand to hold an upper end of cabinet door and use the other free hand to attach an upper hinge to the cabinet door 22 and/or face frame 24. With upper end of cabinet door 22 attached, the craftsperson may similarly then attach a lower hinge to the cabinet door 22 and/or face frame 24 to complete installation of cabinet door 22. Additional hinges may be added in this way.

From the above discussion, it will be appreciated that the support system 10 improves upon the state of the art. Specifically, various embodiments provide a support system: that improves functionality over prior art support systems; that can be reconfigured for a variety of different tasks and/or workpieces; that can support a cabinet door a particular height relative to the cabinet face; that is easily and quickly adjusted to support a cabinet door at multiple heights; that can adjust the height at which a door is supported with fine granularity; that can be used to install cabinet doors on either the right or left side; that is strong, robust, and durable; that provides unique functionality; that is fast to use; that is safe to use; that saves time; that is compact in size; that is easily stored; that is portable; that is easy and intuitive to use; that has a long useful life; that is high quality; that prevents doors, workpieces, or other supported objects from slipping; and/or that has surfaces with a high coefficient of friction. These and other objects, features, or advantages of the disclosure will become apparent from the specification, figures and claims.

It will be appreciated by those skilled in the art that other various modifications could be made to the device without parting from the spirit and scope of this disclosure. All such modifications and changes fall within the scope of the claims and are intended to be covered thereby.

What is claimed:

1. A support system for hanging a cabinet door, comprising:

a top member;

the top member having a top surface and a bottom surface;

the top member extending between a forward end and a rearward end;

the top member extending between opposing sides;

a front member;

the front member having a front surface and a back surface;

the front member extending between an upper end and a lower end;

the front member extending between opposing sides;

wherein the upper end of the front member is operably connected to the forward end of the top member;

the front member having a plurality of lock features;

wherein the plurality of lock features of the front member are located at a plurality of positions between the upper end and the lower end on the front surface;

a support arm;

the support arm extending between a connection end and a support end;

the support arm having one or more lock features;

wherein the lock features of the support arm are configured to engage and lock with lock features of the front member;

the support end of the support arm having a platform configured to support a cabinet door during installation onto a cabinet.

2. A support system for hanging a cabinet door on a frame of a cabinet, comprising:

a top member;

a front member;

wherein the top member and front member are operatively connected to one another;

the front member having a plurality of lock features;

a support arm;

the support arm extending between a connection end and a support end;

the support arm having one or more lock features;

the support end of the support arm having a platform;

the platform of the support end of the support arm is configured to support a cabinet door during installation onto a cabinet;

wherein the support arm is configured to be set at a plurality of vertical positions relative to the front member.

3. A support system for hanging a cabinet door on a cabinet, comprising:

a top member;

a front member;

wherein the top member and front member are operatively connected to one another;

a support arm;

the support arm extending between a connection end and a support end;

the support end of the support arm having a platform;

the platform of the support end of the support arm is configured to support a cabinet door during installation onto a cabinet;

wherein the support arm is configured to be set at a plurality of vertical positions relative to the front member.

4. The support system of claim 3, wherein when the support system is clamped to a frame of a cabinet, the cabinet door is supported by the platform of the support system thereby facilitating installation of the cabinet door to the frame of the cabinet.

5. The support system of claim 3, wherein the front member and top member are formed of a single unitary member.

6. The support system of claim 3, wherein the front member and top member are separate components that are operably connected to one another.

7. The support system of claim 3, wherein the top member and front member are fastened to one another.

8. The support system of claim 3, wherein the top member and front member form an L-shaped member when viewed from an end.

9. The support system of claim 3, wherein a bottom surface of the top member and a back surface of the front member form planes that extend in an approximate perpendicular alignment to one another.

10. The support system of claim 3, wherein the support arm is configured to be movable between the plurality of positions for adjustment of a height at which the cabinet door is supported.

11. The support system of claim 3, wherein the support arm is configured to be reversible between a first configuration where the platform is on a left side of the support system and a second configuration where the platform is on a right side of the support system.

12. The support system of claim 3, wherein the support system is configured to be clamped to a frame of a cabinet.

13. The support system of claim 3, wherein the support system is configured to be clamped to a frame of a cabinet by clamping the top member to the frame of the cabinet.

14. The support system of claim 3, wherein the support system is configured to be clamped to a frame of a cabinet by clamping the front member to the frame of the cabinet.

15. The support system of claim 3, further comprising one or more grip pads on a back surface of the front member.

16. The support system of claim 3, further comprising one or more grip pads on a bottom surface of the front member.

17. The support system of claim 3, further comprising one or more grip pads on a top surface of the top member.

18. The support system of claim 3, wherein a top surface of the top member includes a platform configured to facilitate clamping of the top member to a frame of a cabinet.

19. The support system of claim 3, wherein a top surface of the top member includes a platform configured to facilitate clamping of the top member to a frame of a cabinet; and wherein one or more grip pads are formed on the platform of the top surface of the top member.

20. The support system of claim 3, further comprising one or more grip pads formed on the platform of support arm.

21. The support system of claim 3, further comprising one or more shims;

wherein the shims are configured to engage and attach to the platform of support arm.

22. The support system of claim 3, further comprising one or more shims;

wherein the one or more shims include a magnetically attracted material;

wherein the magnetically attracted materials are configured to maintain connection of the one or more shims to the platform of support arm by a magnetic force.

23. A support system for hanging a cabinet door on a frame of a cabinet, comprising:

a top member;

a front member;

wherein the top member and front member are operatively connected to one another;

the front member having a plurality of lock features;

a support arm;

the support arm extending between a connection end and a support end;

the support arm having one or more lock features;

the support end of the support arm having a platform;

the platform of the support end of the support arm is configured to support a cabinet door during installation onto a cabinet;

wherein the support arm is configured to be reversible between a configuration where the platform is on a left side of the support system and a configuration where the platform is on a right side of the support system.

24. A support system for hanging a cabinet door on a frame of a cabinet, comprising:

a top member;

a front member;

wherein the top member and front member are operatively connected to one another;

a support arm;

the support arm extending between a connection end and a support end;

the support end of the support arm having a platform;

the platform of the support end of the support arm is configured to support a cabinet door during installation onto a cabinet;

wherein the support arm is configured to be reversible between a configuration where the platform is on a left side of the support system and a configuration where the platform is on a right side of the support system.

25. The support system of claim 24, wherein when the support system is clamped to a frame of a cabinet, the cabinet door is supported by the platform of the support system thereby facilitating installation of the cabinet door to the frame of the cabinet.

26. The support system of claim 24, wherein the front member and top member are formed of a single unitary member.

27. The support system of claim 24, wherein the front member and top member are separate components that are operably connected to one another.

28. The support system of claim 24, wherein the top member and front member are fastened to one another.

29. The support system of claim 24, wherein the top member and front member form an L-shaped member when viewed from an end.

30. The support system of claim 24, wherein the bottom surface of the top member and the back surface of the front member form planes that extend in an approximate perpendicular alignment to one another.

31. The support system of claim 24, wherein the support arm is configured to be movable between the plurality of positions for adjustment of a height at which the cabinet door is supported.

32. The support system of claim 24, wherein the support arm is configured to be reversible between a first configuration where the platform is on a left side of the support system and a second configuration where the platform is on a right side of the support system.

33. The support system of claim 24, wherein the support system is configured to be clamped to a frame of a cabinet.

34. The support system of claim 24, wherein the support system is configured to be clamped to a frame of a cabinet by clamping the top member to the frame of the cabinet.

35. The support system of claim 24, wherein the support system is configured to be clamped to a frame of a cabinet by clamping the front member to the frame of the cabinet.

36. The support system of claim 24, further comprising one or more grip pads on the back surface of the front member.

37. The support system of claim 24, further comprising one or more grip pads on the bottom surface of the front member.

38. The support system of claim 24, further comprising one or more grip pads on the top surface of the top member.

39. The support system of claim 24, wherein the top surface of the top member includes a platform configured to facilitate clamping of the top member to a frame of a cabinet.

40. The support system of claim 24, wherein the top surface of the top member includes a platform configured to facilitate clamping of the top member to a frame of a cabinet; and wherein one or more grip pads are formed on the platform of the top surface of the top member.

41. The support system of claim 24, further comprising one or more grip pads formed on the platform of support arm.

42. The support system of claim 24, further comprising one or more shims;

wherein the shims are configured to engage and attach to the platform of support arm.

43. The support system of claim 24, further comprising one or more shims;

wherein the one or more shims include a magnetically attracted material;

wherein the magnetically attracted materials are configured to maintain connection of the one or more shims to the platform of support arm by a magnetic force.

44. A support system for hanging a cabinet door on a frame of a cabinet, comprising:

a top member;

a front member;

wherein the top member and front member are operatively connected to one another;

a support arm;

the support arm extending between a connection end and a support end;

the support end of the support arm having a platform;

the platform having a connection member;

a shim;

the shim having a connection member;

wherein the connection member of the shim and the connection member of the platform are configured to engage one another in a locking arrangement;

wherein the platform of the support end is configured to support a cabinet door during installation onto a cabinet.

45. The support system of claim 44, wherein the shim includes a magnetically attracted material;

wherein the magnetically attracted materials are configured to maintain connection of the shim to the platform of support arm by a magnetic force.

46. The support system of claim 44, further comprising one or more grip pads formed on the shim.

47. A support system for hanging a cabinet door on a frame of a cabinet, comprising:

a top member;

a front member;

wherein the top member and front member are operatively connected to one another;

a support arm;

the support arm extending between a connection end and a support end;

the support end of the support arm having a platform;

the platform having a magnet member;

a shim;

the shim having a magnet member;

wherein the magnet member of the shim is configured to be magnetically connected to the magnet member of the platform;

wherein the platform of the support end of the support arm is configured to support a cabinet door during installation onto a cabinet.

48. The support system of claim 47, wherein the magnetic member of the platform is either a magnet or a piece of ferrous material.

49. The support system of claim 47, wherein the magnetic member of the shim is either a magnet or a piece of ferrous material.

* * * * *